US010071555B2

(12) United States Patent
Nakazawa

(10) Patent No.: US 10,071,555 B2
(45) **Date of Patent: *Sep. 11, 2018**

(54) LIQUID EJECTION APPARATUS

(71) Applicant: BROTHER KOGYO KABUSHIKI KAISHA, Nagoya-shi, Aichi-ken (JP)

(72) Inventor: Fumio Nakazawa, Okazaki (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 11 days.

This patent is subject to a terminal disclaimer.

(21) Appl. No.: 15/450,118

(22) Filed: Mar. 6, 2017

(65) Prior Publication Data

US 2017/0239952 A1 Aug. 24, 2017

Related U.S. Application Data

(63) Continuation of application No. 14/581,501, filed on Dec. 23, 2014, now Pat. No. 9,586,404.

(30) Foreign Application Priority Data

Dec. 26, 2013 (JP) ..... 2013-269512

(51) Int. Cl.
*B41J 2/165* (2006.01)

(52) U.S. Cl.
CPC ..... *B41J 2/16523* (2013.01); *B41J 2/16505* (2013.01)

(58) Field of Classification Search
CPC ..... B41J 2/16508; B41J 2/16511; B41J 2/16505; B41J 2/16523; B41J 2/1652
(Continued)

(56) References Cited

U.S. PATENT DOCUMENTS 7,841,690 B2 11/2010 Ogawa
9,586,404 B2 * 3/2017 Nakazawa ..... B41J 2/16508
(Continued)

FOREIGN PATENT DOCUMENTS

JP 2001-130030 5/2001
JP 2006-088673 4/2006
(Continued)

OTHER PUBLICATIONS

Notification of Reasons for Refusal for Japanese Application No. 2014-259583 dated Jun. 26, 2018.

*Primary Examiner* — Jannelle M Lebron
(74) *Attorney, Agent, or Firm* — Haug Partners LLP

(57) ABSTRACT

A liquid ejection apparatus comprises a liquid ejection head, a nozzle cap, and a suction pump. The liquid ejection head includes first nozzles, second nozzles, and an ejection surface in which the first nozzles and the second nozzles are formed. The nozzle cap includes a first cap section for covering the first nozzles, a second cap section for covering the second nozzles, a communication section connected with the first cap section and the second cap section, a suction port for being connected with the suction pump, and an atmosphere communication port for communication with atmosphere. At least one of the suction port and the atmosphere communication port is provided at non-connection end portions which are end portions in the one direction of the first cap section and the second cap section and are not connected with the communication section.

10 Claims, 32 Drawing Sheets

(58) Field of Classification Search
USPC ..... 347/20, 30, 32
See application file for complete search history.

(56) References Cited

U.S. PATENT DOCUMENTS

| | | | | |
|---|---|---|---|---|
| 2010/0128084 | A1* | 5/2010 | Nakazawa ..... | B41J 2/16508 347/30 |
| 2013/0135367 | A1 | 5/2013 | Petruchik et al. | |

FOREIGN PATENT DOCUMENTS

| | | |
|---|---|---|
| JP | 2007-331269 | 12/2007 |
| JP | 2008-149486 | 7/2008 |
| JP | 2008-213216 | 9/2008 |
| JP | 4197822 | 12/2008 |
| JP | 2010-162690 | 7/2010 |
| JP | 2013-188969 | 9/2013 |

* cited by examiner

CONVEYANCE DIRECTION
SCANNING DIRECTION
LEFTWARD
RIGHTWARD
IVA
IVB
IVC
W1
W2
3
60
63
31
31b
31c
31d
41
42
43
43a
44
46
47
48
49
51a
51b
51c
51d
65
71
71a
71b
72
72a
72b
73
73a
73b
74
74a
74b
23a
23b
23c

SCANNING DIRECTION
LEFTWARD
RIGHTWARD
CONVEYANCE DIRECTION
UP-DOWN DIRECTION
CONVEYANCE DIRECTION
31
31a
31b
31c
41
42
42a
43
43a
44
46
47
48
49
51a
51b
51c
51d
A
F
P
3
21a
10a
10b 301
302
303
306
41
42
42a
43
43a
44
46
47
48
49
33
P
SCANNING DIRECTION
LEFTWARD
RIGHTWARD
CONVEYANCE DIRECTION

LIQUID EJECTION APPARATUS

CROSS REFERENCE TO RELATED APPLICATION

The present application is a continuation of U.S. patent application Ser. No. 14/581,501 filed on Dec. 23, 2014, which claims priority from Japanese Patent Application No. 2013-269512 filed on Dec. 26, 2013, the disclosures of which are incorporated herein by reference in their entirety.

BACKGROUND OF THE INVENTION

The present invention relates to a liquid ejection apparatus configured to eject liquid from nozzles.

As a liquid ejection apparatus configured to eject liquid from nozzles, there is an inkjet recording apparatus which perform recording by ejecting ink from nozzles. The inkjet recording apparatus includes two ejection units configured to eject ink from nozzles, two caps provided for the two ejection units, respectively, and one suction pump connected to the two caps. The two caps and the one suction pump are connected with one another by a tube which is connected to the suction pump and is branched in the middle to be connected to the two caps. At a part between the branch of the tube and each cap, a switching valve is provided. When clogging of the nozzles occurs in both of the two ejection units, to begin with, the suction pump is driven while only the cap covering one of the ejection units is connected to the suction pump, so that the ink in the one of the ejection units is discharge and the clogging of the nozzles is resolved. Subsequently, as the suction pump is driven while only the cap covering the other one of the ejection units is connected to the suction pump, the ink in the other one of the ejection units is discharge and the clogging of the nozzles is resolved.

SUMMARY OF THE INVENTION

In this case, however, because the tube connected to the suction pump branches in the middle to be connected to the two caps, ink in one of the ejection units may not be sufficiently ejected when the suction pump is driven while both of the caps are connected with the suction pump. Furthermore, after the discharge of the ink from the ejection unit, the ink remaining on one cap may not be sufficiently ejected.

An object of the present invention is to provide a liquid ejection apparatus in which ink remaining in two cap sections is certainly discharged at once.

A liquid ejection apparatus of the present invention includes: a liquid ejection head including first nozzles which are lined up in predetermined one direction, second nozzles which are lined up in the one direction and positionally deviated from the first nozzles in a direction orthogonal to the one direction, and an ejection surface in which the first nozzles and the second nozzles are formed; a nozzle cap configured to contact with and move away from the ejection surface, and cover the first nozzles and the second nozzles when contacting with the ejection surface; a moving device configured to cause the nozzle cap to contact with or move away from the ejection surface by moving at least one of the liquid ejection head and the nozzle cap; and a suction pump connected with the nozzle cap, wherein, the nozzle cap includes: a first cap section for covering the first nozzles; a second cap section for covering the second nozzles; a communication section connected with the first cap section and the second cap section; a suction port for being connected with the suction pump; and an atmosphere communication port for communication with atmosphere, at least one of the suction port and the atmosphere communication port is provided at non-connection end portions which are end portions in the one direction of the first cap section and the second cap section and are not connected with the communication section.

BRIEF DESCRIPTION OF THE DRAWINGS

Other and further objects, features and advantages of the invention will appear more fully from the following description taken in connection with the accompanying drawings in which:

FIG. 1 is viewed in the direction indicated by the arrow VI.

FIG. 1 is viewed in the direction indicated by the arrow VI.

DESCRIPTION OF THE PREFERRED EMBODIMENTS

[First Embodiment]

The following will describe preferred First Embodiment of the present invention.

(Overall Structure of Printer)

Figure 1:
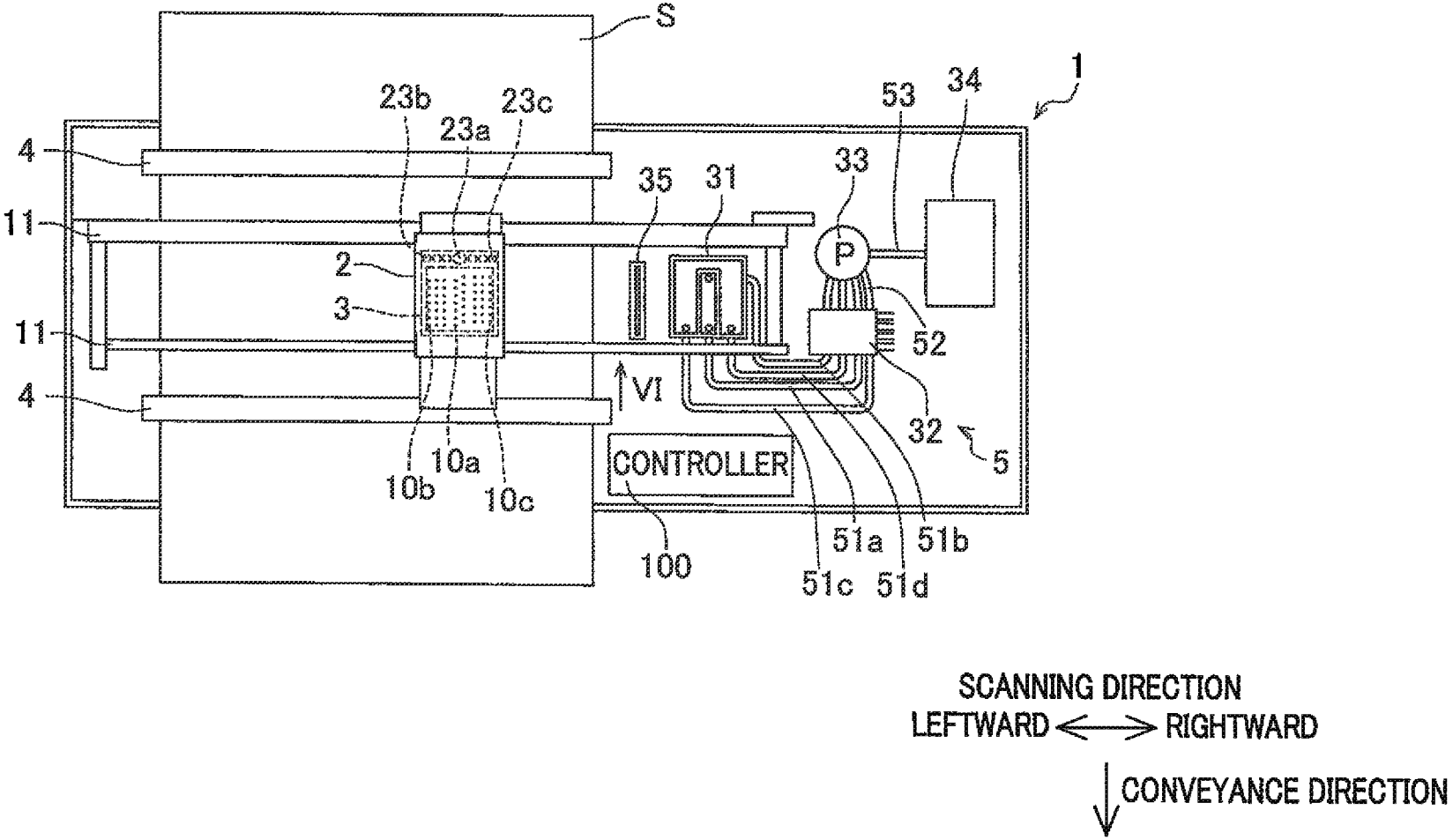
FIG. 1 is a schematic diagram of a printer of First Embodiment.

As shown in FIG. 1, a printer 1 (which is equivalent to a liquid ejection apparatus of the present invention) of First Embodiment includes a carriage 2, an inkjet head 3 (which is equivalent to a liquid ejection head of the present invention), sheet feeding rollers 4, and a maintenance unit 5.

The carriage 2 is configured to reciprocate in a scanning direction along two guide rails 11 extending in the scanning direction. Hereinafter, as shown in FIG. 1, the leftward and the rightward in the scanning direction will be used as definitions of directions in the description. The inkjet head 3 is mounted on the carriage 2 and ejects ink from nozzles 10*a* to 10*c* made through an ejection surface 21*a* (see FIG. 4) which is the lower surface of the inkjet head 3. The sheet feeding rollers 4 are provided on the respective sides of the carriage 2 in a conveyance direction orthogonal to the scanning direction so as to convey a record sheet S in the conveyance direction. In the printer 1, while the record sheet S is conveyed by the sheet feeding rollers 4 in the conveyance direction, the ink is ejected from the inkjet head 3 which is configured to reciprocate in the scanning direction together with the carriage 2. Printing onto the record sheet S is carried out in this way.

(Inkjet Head)

Figure 2:
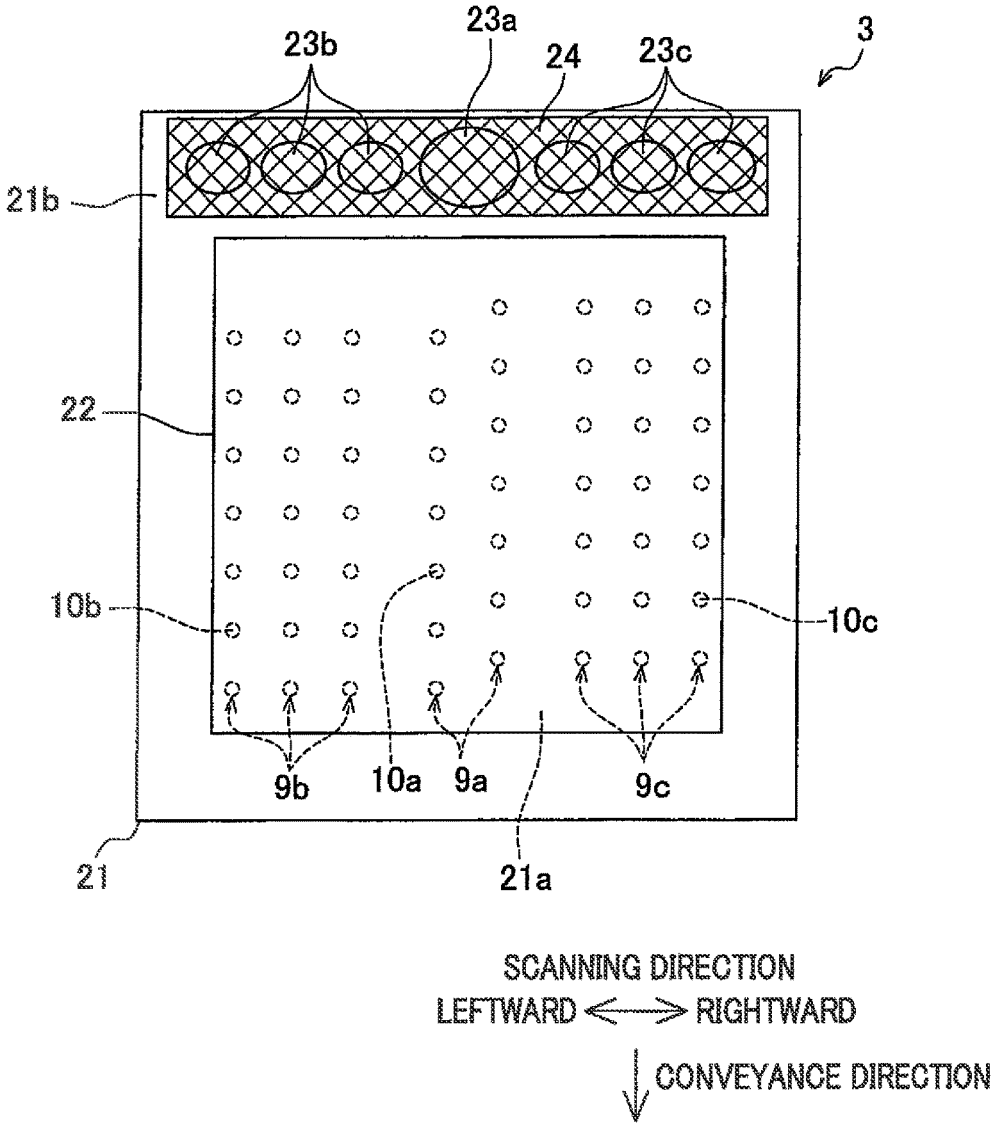
FIG. 2 is a plan view of the inkjet head of FIG. 1.

Now, the inkjet head 3 will be described. As shown in FIG. 2, the inkjet head 3 includes a passage unit 21 and a piezoelectric actuator 22. In the passage unit 21, ink passages including the nozzles 10*a*, 10*b*, and 10*c*, and ink supply openings 23*a* to 23*c* are formed.

The nozzles 10*a* (equivalent to third nozzles in the present invention) are formed at a central part in the scanning direction of the ejection surface 21*a* which is the lower surface of the passage unit 21. The nozzles 10*a* are lined up in the conveyance direction to form nozzle rows 9*a*. On the passage unit 21, two nozzle rows 9*a* are lined up in the scanning direction. The nozzles 10*a* eject black pigment ink.

The nozzles 10*b* (equivalent to second nozzles of the present invention) are formed to the left of the nozzles 10*a* in the scanning direction on the ejection surface 21*a*. The nozzles 10*b* are lined up in the conveyance direction (equivalent to one direction in the present invention) to form nozzle rows 9*b*. On the ejection surface 21*a*, three nozzle rows 9*b* are lined up in the scanning direction. The nozzles 10*b* eject yellow, cyan, and magenta dye inks. The nozzle rows 9*b* correspond, from the rightmost one, yellow, cyan, and magenta dye inks, respectively.

The nozzles 10*c* (equivalent to first nozzles of the present invention) are formed to the right of the nozzles 10*a* in the scanning direction on the ejection surface 21*a*. The nozzles 10*c* are lined up in the conveyance direction to form nozzle rows 9*c*. On the ejection surface 21*a*, three nozzle rows 9*c* are lined up in the scanning direction. The nozzles 10*c* eject yellow, cyan, and magenta dye inks. The nozzle rows 9*c* correspond, from the leftmost one, yellow, cyan, and magenta dye inks, respectively.

The ink supply opening 23*a* is formed at a central part in the scanning direction of an upstream end portion of the upper surface 21*b* of the passage unit 21 in the conveyance direction (i.e., an end portion on the one side in one direction in the present invention). The ink supply opening 23*a* is connected to an unillustrated ink cartridge filled with black ink, via an unillustrated tube or the like. With this, black ink to be ejected from the nozzles 10*a* is supplied from the ink supply opening 23*a* to the inkjet head 3.

The three ink supply openings 23*b* are formed to the left of the ink supply opening 23*a* on the upper surface 21*b* of the passage unit 21 and are lined up in the scanning direction. The three ink supply openings 23*b* are, from the rightmost one, connected to unillustrated ink cartridges filled with yellow, cyan, and magenta inks, respectively, via unillustrated tubes or the like. With this, yellow, cyan, and magenta inks to be ejected from the nozzles 10*b* are supplied to the inkjet head 3 from the three ink supply openings 23*b*.

The three ink supply openings 23*c* are formed to the right of the ink supply opening 23*a* on the upper surface 21*b* of the passage unit 21 and are lined up in the scanning direction. The three ink supply openings 23*c* are, from the leftmost one, connected to unillustrated ink cartridges filled with yellow, cyan, and magenta inks, respectively, via unillustrated tubes or the like. With this, yellow, cyan, and magenta inks to be ejected from the nozzles 10*c* are supplied to the inkjet head 3 from the three ink supply openings 23*c*.

In addition to the above, on the upper surface 21*b* of the passage unit 21, a filter 24 is provided to cover the ink supply openings 23*a* to 23*c*. With this, the filter 24 captures bubbles, foreign matters or the like in the ink when the ink is supplied from the ink supply openings 23*a* to 23*c* to the inkjet head 3, and hence the bubbles, foreign matters or the like in the ink do not flow into the inkjet head 3.

The piezoelectric actuator 22 is provided on the upper surface 21*b* of the passage unit 21. This piezoelectric actuator 22 imparts an ejection energy to the ink in the passage unit 21. For example, the ink passages of the passage unit 21 have unillustrated pressure chambers between the nozzles 10*a* to 10*c* and the ink supply openings 23*a* to 23*c*, and the piezoelectric actuator 22 pressurizes the ink in the pressure chambers.

(Maintenance Unit)

Now, the maintenance unit 5 will be described. As shown in FIG. 1, the maintenance unit 5 includes a nozzle cap 31, a switching unit 32, a suction pump 33, a waste liquid tank 34, and a wiper 35.

As shown in FIG. 4, the nozzle cap 31 is made of rubber or the like and includes a bottom wall portion 31*a* and lip portions 31*b* and 31*c* which are integrally molded. The bottom wall portion 31*a* is a rectangular plate and the upper surface 31*a*1 thereof opposes the ejection surface 21*a* when the carriage 2 is at a substantially rightmost position. The lip portion 31*b* is provided on the entirety of the outer circumference of the upper surface 31*a*1 of the bottom wall portion 31*a*, and protrudes upward from the upper surface 31*a*1 of the bottom wall portion 31*a*. The lip portion 31*c* is provided on the entirety of the circumference of a region the upper surface 31*a*1 of the bottom wall portion 31*a* which region surrounds a part opposing the nozzles 10*a*, and protrudes upward from the upper surface 31*a*1 of the bottom wall portion 31*a*. The downstream end portion in the conveyance direction of the lip portion 31*c* is a part of the downstream end portion in the conveyance direction of the lip portion 31*b*. Furthermore, the upstream end portion in the conveyance direction of the lip portion 31*b* is detached in the conveyance direction from the upstream end portion in the conveyance direction of the lip portion 31*c*.

As the lip portions 31*b* and 31*c* are formed on the upper surface 31*a*1 of the bottom wall portion 31*a* in this manner, on the nozzle cap 31, cap sections 41 to 43 and a communication section 44 which are surrounded by the bottom wall portion 31*a* and the lip portions 31*b* and 31*c* are formed.

As shown in FIG. 4, the cap section 41 (equivalent to a third cap section of the present invention) is surrounded by the bottom wall portion 31*a* and the lip portion 31*c* and opposes the nozzles 10*a* when the nozzle cap 31 opposes the ejection surface 21*a*. The cap section 42 (equivalent to a second cap section of the present invention) is provided to the left of the lip portion 31*c* and opposes the nozzles 10*b* when the nozzle cap 31 opposes the ejection surface 21*a*. The cap section 43 (equivalent to a first cap section of the present invention) is provided to the right of the lip portion 31*c* and opposes the nozzles 10*c* when the nozzle cap 31 opposes the ejection surface 21*a*. As such, the cap section 41 is provided between the cap section 42 and the cap section 43 in the scanning direction.

Figures 3A, 3B:
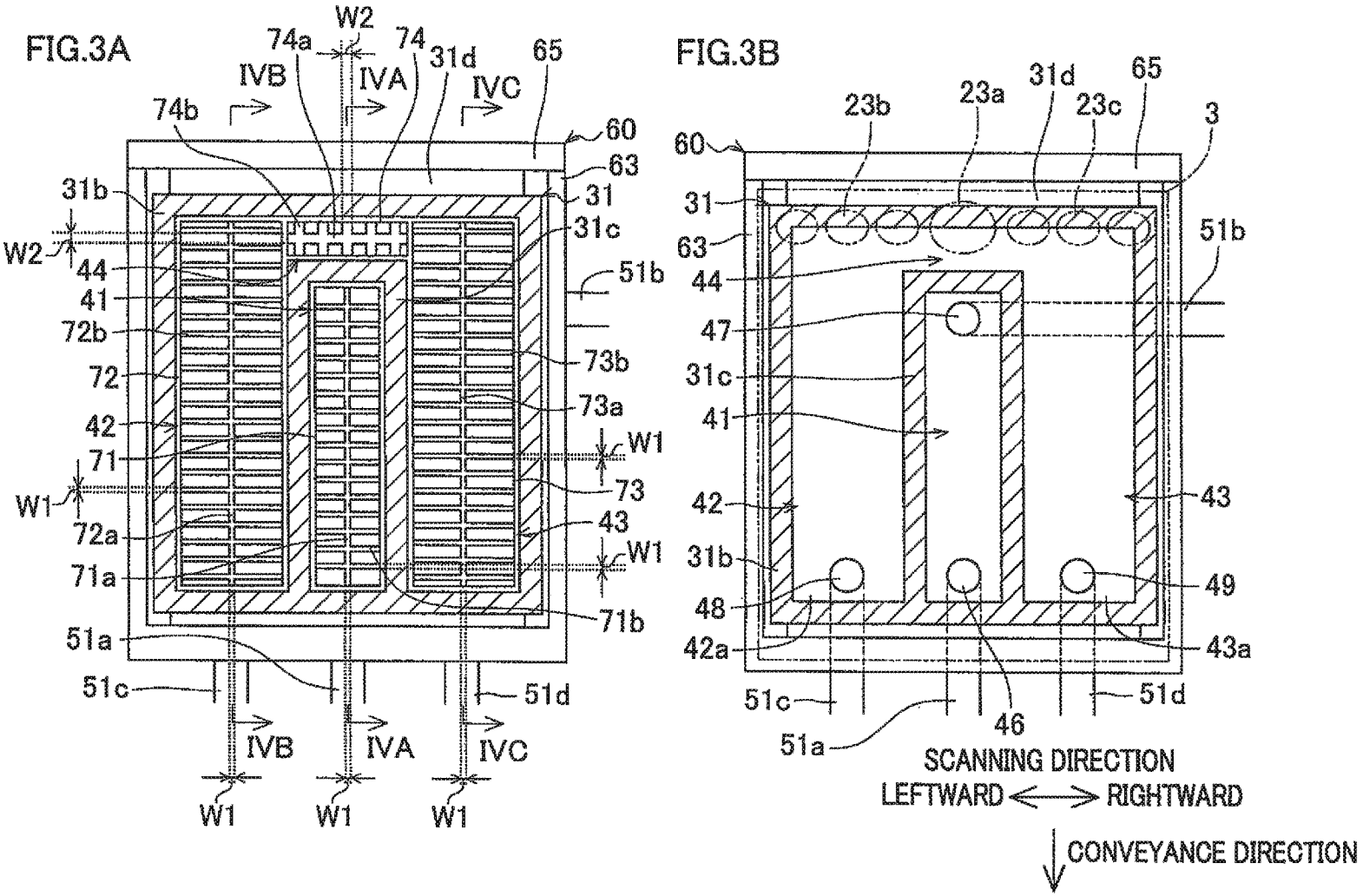
FIG. 3A is a plan view of the nozzle cap of FIG. 1.
FIG. 3B shows a state that the cap chips are removed from the state shown in FIG. 3A.

As shown in FIG. 3, the communication section 44 is provided on the upstream in the conveyance direction of the lip portion 31*c*. As such, the communication section 44 is provided between the cap section 42 and the cap section 43 and is deviated from the cap section 41 in the conveyance direction. The communication section 44 extends in the scanning direction to be connected to the upstream end portion in the conveyance direction of the cap section 42 and the upstream end portion in the conveyance direction of the cap section 43. With this, the cap section 42 communicates with the cap section 43 via the communication section 44. Furthermore, the communication section 44 overlaps the ink supply openings 23*a* to 23*c* in the up-down direction when the nozzle cap 31 opposes the ejection surface 21*a*.

When the communication section 44 for causing the cap section 42 to communicate with the cap section 43 is provided in the nozzle cap 31, the length of the nozzle cap 31 is accordingly increased in the conveyance direction. In the meanwhile, the ink supply openings 23*a* to 23*c* for which the filter 24 is provided are arranged to be large in size to some extent, in order to prevent the passage resistance from being too high. In this regard, First Embodiment is arranged such that, as described above, the communication section 44 is provided to overlap the large ink supply openings 23*a* to 23*c* in the up-down direction, and hence the increase in the size of the printer 1 in the conveyance direction due to the increase in the length of the nozzle cap 31 in the conveyance direction is restrained.

The inner bottom surfaces of the cap sections 41 to 43 and the communication section 44 are all constituted by the upper surface 31*a*1 of the bottom wall portion 31*a*. For this reason, the inner bottom surfaces of the cap sections 41 to 43 and the communication section 44 are on the same plane, and the inner bottom surfaces of the cap sections 42 and 43 are continuously connected to the inner bottom surface of the communication section 44. When the nozzle cap 31 is arranged so that the cap sections 41 to 43 and the communication section 44 are formed by providing the lip portions 31*b* and 31*c* on the upper surface 31*a*1 of the bottom wall portion 31*a*, the number of components of the nozzle cap 31 is small as compared to a case where the cap section 42 communicates with the cap section 43 via tubes or the like instead of the communication section 44, because such tubes are unnecessary in the nozzle cap 31.

In addition to the above, as shown in FIG. 3, at upstream and downstream end portions in the conveyance direction of the cap section 41 of the bottom wall portion 31*a*, connection ports 46 and 47 are formed, respectively. Furthermore, at a downstream end portion 42*a* (equivalent to a non-connecting end portion of the present invention) in the conveyance direction of the cap section 42 of the bottom wall portion 31*a* (i.e., on the other end side in one direction in the present invention), a connection port 48 (equivalent to a suction port of the present invention) is formed. Furthermore, at a downstream end portion 43*a* (equivalent to a non-connecting end portion of the present invention) in the conveyance direction of the cap section 43 of the bottom wall portion 31*a*, a connection port 49 (equivalent to an atmosphere communication port of the present invention) is formed. The connection ports 46 to 49 are connected to tubes 51*a* to 51*d* (equivalent to passage members of the present invention), respectively.

The cap sections 41 to 43 and the communication section 44 house cap chips 71 to 74, respectively. Each of the cap chips 71 to 74 is a rectangular plate made of a synthetic resin material or the like, and is slightly smaller than the corresponding one of the cap sections 41 to 43 and the communication section 44 in plan view. In First Embodiment, the cap chips 72, 73, and 74 are equivalent to a first plate-shaped member, a second plate-shaped member, and a third plate-shaped member of the present invention, respectively.

In the cap chips 71 to 73, grooves 71*a* to 73*a* and grooves 71*b* to 73*b* are formed. Each of the grooves 71*a* to 73*a* is formed at central parts in the scanning direction of the upper surface and the lower surface of each of the cap chips 71 to 73, and extends over the full length of the cap chip 71 in the conveyance direction. The grooves 71*b* to 73*b* are lined up in the conveyance direction in the upper surfaces and the lower surfaces of the cap chips 71 to 73, and each of the grooves 71*b* to 73*b* extends over the full length of each of the cap chips 71 to 73 in the scanning direction and intersects with each of the grooves 71*a* to 73*a*.

In the cap chip 74, a groove 74*a* and grooves 74*b* are formed. The groove 74*a* is formed at a central part in the conveyance direction of the upper surface and the lower surface of the cap chip 71, and extends over the full length of the cap chip 71 in the scanning direction. The grooves 74*b* are lined up in the conveyance direction on the upper surface and the lower surface of the cap chip 74, and each of the grooves 74*b* extends over the full length of the cap chip 74 in the conveyance direction and intersects with the groove 74*a*.

In First Embodiment, because the cap chips 71 to 74 are provided in the cap sections 41 to 43 and the communication section 44, the capacities of the internal spaces of the cap sections 41 to 43 and the communication section 44 are small. For this reason, the flow of the ink is facilitated even if the amounts of the ink in the cap sections 41 to 43 and the communication section 44 are small. Furthermore, because the grooves 71*a* to 74*a* and 71*b* to 74*b* are formed in the cap chips 71 to 74, the flow of the ink in the cap sections 41 to 43 and the communication section 44 is facilitated in the scanning direction and the conveyance direction along the grooves 71*a* to 74*a* and 71*b* to 74*b*. Furthermore, as the cap chips 71 to 74 are housed in the cap sections 41 to 43 and the communication section 44, the nozzle cap 31 is reinforced. Because in First Embodiment the cap chip 74 is stored in the communication section 44 in addition to the cap chips 71 to 73 stored in the cap sections 41 to 43, the above-described effect of providing the cap chips is enhanced as compared to a case where only the cap chips 71 to 73 are housed.

In addition to the above, as shown in FIG. 3, First Embodiment is arranged such that, while the widths of the grooves 71*a* to 73*a* (i.e., the lengths in the scanning direction) and the widths of the grooves 71*b* to 73*b* (i.e., the lengths in the conveyance direction) are W1, the width of the groove 74*a* (i.e., the length in the scanning direction) and the width of the groove 74*b* (i.e., the length in the conveyance direction) are W2 larger than W1 above. In this connection, while the communication section 44 is larger in plan view and higher in the passage resistance than the cap sections 42 and 43, the widths W2 of the grooves 74*a* and 74*b* of the cap chip 74 are longer than the widths W1 of the grooves 72*a*, 72*b*, 73*a*, and 73*b* of the cap chips 72 and 73, and hence the amounts of the ink flowing in the grooves 74*a* and 74*b* are larger than the amounts in a case where the widths W2 of the grooves 74*a* and 74*b* are arranged to be more or less identical with W1. As such, the flow of the ink between the cap section 42 and the cap section 43 via the communication section 44 is facilitated.

In addition to the above, the nozzle cap 31 is movable in the up-down direction by a cap driving mechanism 60. As shown in FIG. 3 to FIG. 5, the cap driving mechanism 60 includes a cam 61, a cam driving motor 62, and a cap holder 63. The cap holder 63 is an open-top box and houses the nozzle cap 31 therein. Furthermore, on the inner bottom surface of the cap holder 63 is provided a coil spring 64, and this coil spring 64 biases the nozzle cap 31 upward.

The nozzle cap 31 has a protruding portion 31*d* which protrudes toward the upstream side in the conveyance direction from the upstream end portion of the bottom wall portion 31*a* in the conveyance direction. In the meanwhile, at an upstream end portion in the conveyance direction of the cap holder 63, a protruding stopper 65 is provided to be engaged with an engaging protrusion 31*d*. The stopper 65 is positioned above the engaging protrusion 31*d*. As the engaging protrusion 31*d* contacts with the stopper 65, the positional upper limit of the nozzle cap 31 biased by the coil spring 64 is defined.

At a downstream end portion in the conveyance direction of the nozzle cap 31, a pivoting shaft 66 is provided to extend in the scanning direction. Furthermore, at an end portion of the cap holder 63 which portion is on the side opposite to the stopper 65, a shaft supporting portion 67 is provided to slidably support the pivoting shaft 66 in the up-down direction. The lower surface of the cap holder 63 contacts with the outer circumferential surface of the cam 61. The cam 61 has a predetermined profile and is rotationally driven by a cam driving motor 62.

Figure 4A:
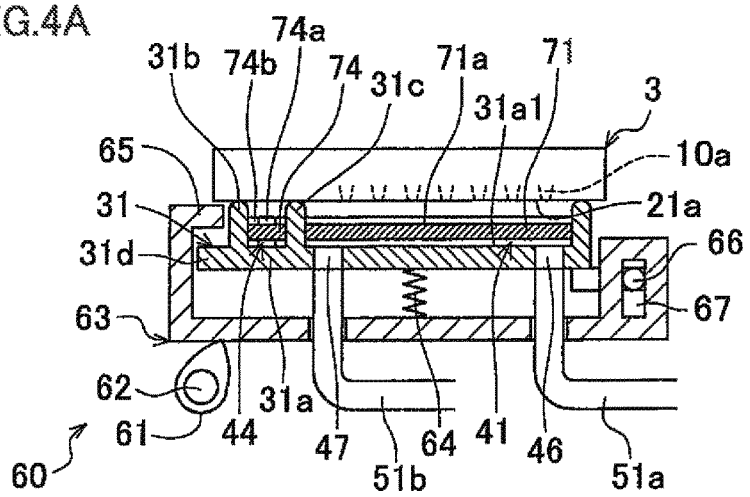
FIG. 4A is a cross section of the nozzle cap in the capped state taken at the IVA-IVA line in FIG. 3A.
Figure 4B:
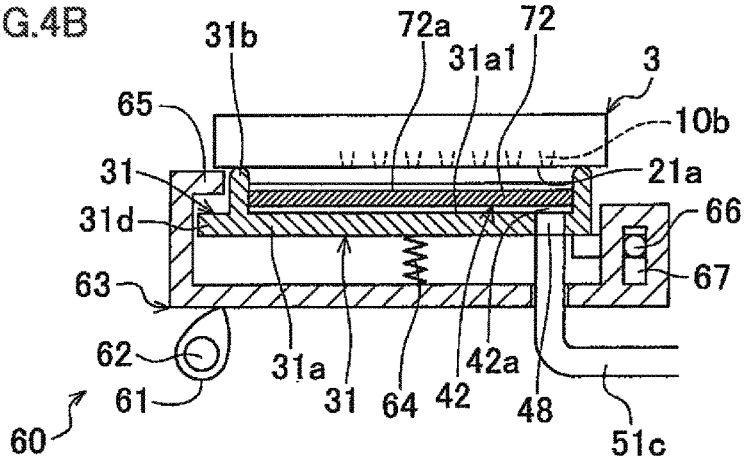
FIG. 4B is a cross section of the nozzle cap in the capped state taken at the IVB-IVB line in FIG. 3A.
Figure 4C:
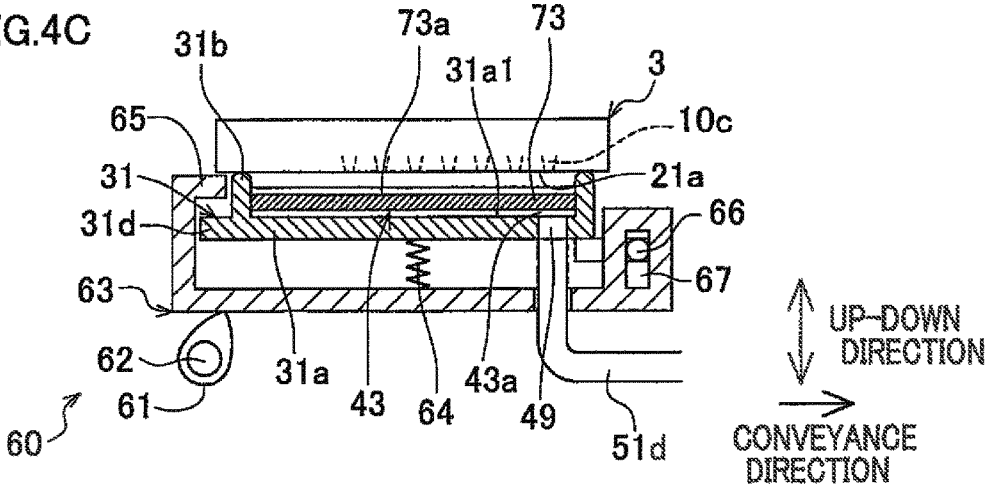
FIG. 4C is a cross section of the nozzle cap in the capped state taken at the IVC-IVC line in FIG. 3A.

As shown in FIGS. 4A to 4C, as the cam 61 rotates counterclockwise while the ejection surface 21*a* opposes the nozzle cap 31, the cap holder 63 is pushed up by the profile of the cam 61. Thereafter, as the lip portions 31*b* and 31*c* contact with the ejection surface 21*a*, the nozzles 10*a* to 10*c* become in a capped state of being covered with the respective cap sections 41 to 43. At the same time, by the communication section 44 and the ejection surface 21*a*, a space by which the cap section 42 communicates with the cap section 43 is formed.

Figure 5A:
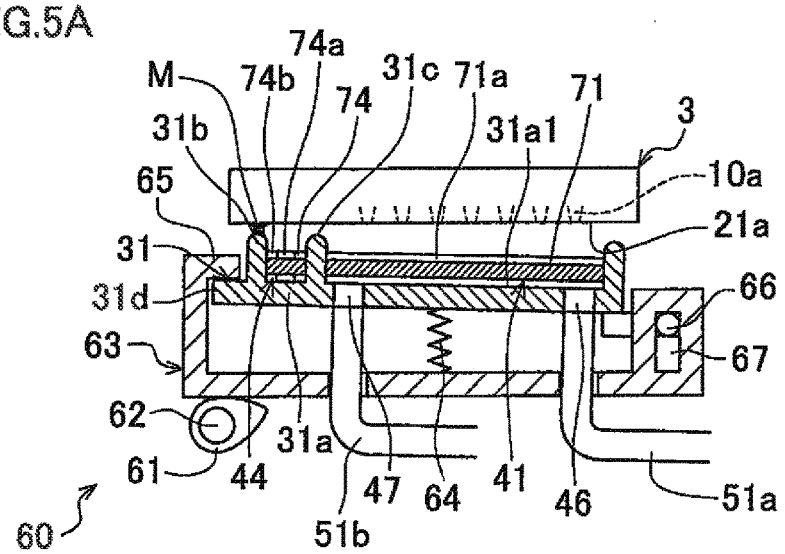
FIG. 5A is a cross section of the nozzle cap corresponding to FIG. 4A when the nozzle cap is detached from an ejection surface.
Figure 5B:
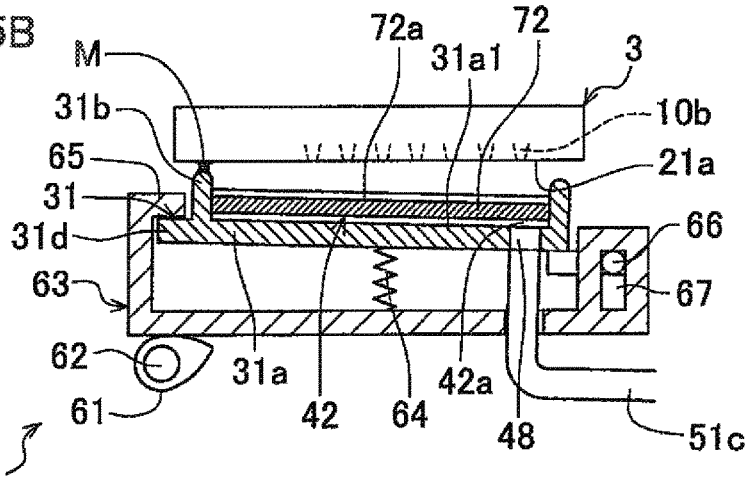
FIG. 5B is a cross section of the nozzle cap corresponding to FIG. 4B when the nozzle cap is detached from an ejection surface.
Figure 5C:
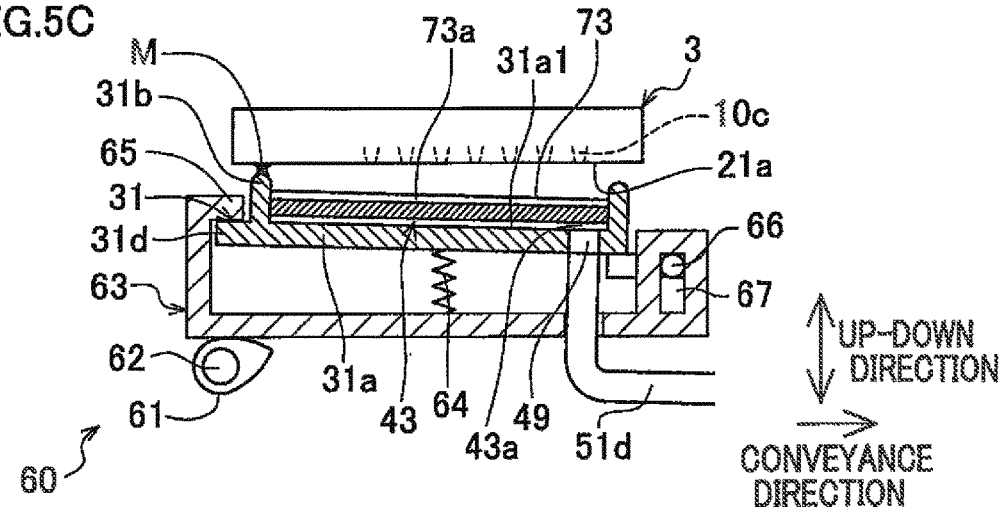
FIG. 5C is a cross section of the nozzle cap corresponding to FIG. 4C when the nozzle cap is detached from an ejection surface.

In the meanwhile, when the cam 61 in the above-described capped state is rotated clockwise, the cap holder 63 falls by its own weight in accordance with the profile of the cam 61. At this stage, because the pivoting shaft 66 contacts with a ceiling part of the shaft supporting portion 67 of the cap holder 63 at the downstream end portion in the conveyance direction of the nozzle cap 31 while the nozzle cap 31 is biased upward by the coil spring 64, the nozzle cap 31 is moved away first from the downstream end portion in the conveyance direction, in accordance with the fall of the cap holder 63. As a result, as shown in FIGS. 5A to 5C, the nozzle cap 31 is moved away from the ejection surface 21*a* while the nozzle cap 31 is inclined such that the downstream end portion in the conveyance direction (i.e., the end portion on the other end side in the first direction in the present invention) is farther from the ejection surface 21*a* than the upstream end portion in the conveyance direction (i.e., the end portion on the one end side in the first direction in the present invention).

The switching unit 32 is connected to the nozzle cap 31 via the connection ports 46 to 49 and the tubes 51*a* to 51*d* (equivalent to the passage members of the present invention) as shown in FIG. 3, and is connected to the suction pump 33 via the tube 52 on the side opposite to the nozzle cap 31, as shown in FIG. 1. The switching unit 32 switches, by the connection port 46 and the tube 51*a* and the connection port 47 and the tube 51*b*, the cap section 41 between a state of being connected to the suction pump 33, a state of communicating with the atmosphere, and a state in which the connection to the suction pump 33 and the communication with the atmosphere are both blocked. Furthermore, the switching unit 32 switches, by the connection port 48 and the tube 51*c* and the connection port 49 and the tube 51*d*, the cap sections 42 and 43 and the communication section 44 between a state of being connected to the suction pump 33, a state of communicating with the atmosphere, and a state in which the connection to the suction pump 33 and the communication with the atmosphere are both blocked. In First Embodiment, the switching unit 32 is equivalent to a combination of a second switching device and a third switching device of the present invention.

The suction pump 33 is a tube pump or the like, and is connected with the switching unit 32 via the tube 52 and connected with the waste liquid tank 34 via the tube 53 on the side opposite to the switching unit 32, as shown in FIG. 1. The waste liquid tank 34 stores ink discharged in a later-described maintenance operation.

Figure 6A:
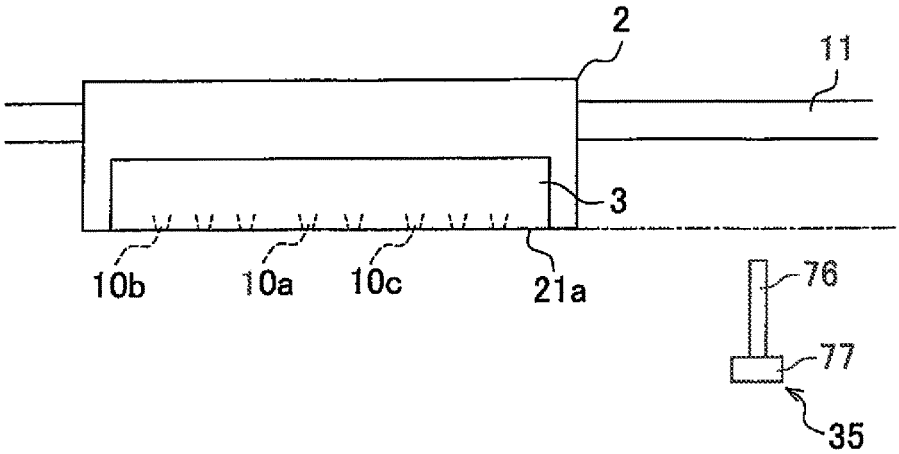
FIG. 6A shows the positional relationship between the carriage, the inkjet head, and the wiper at a state in which the wiper is lowered when
Figure 6B:
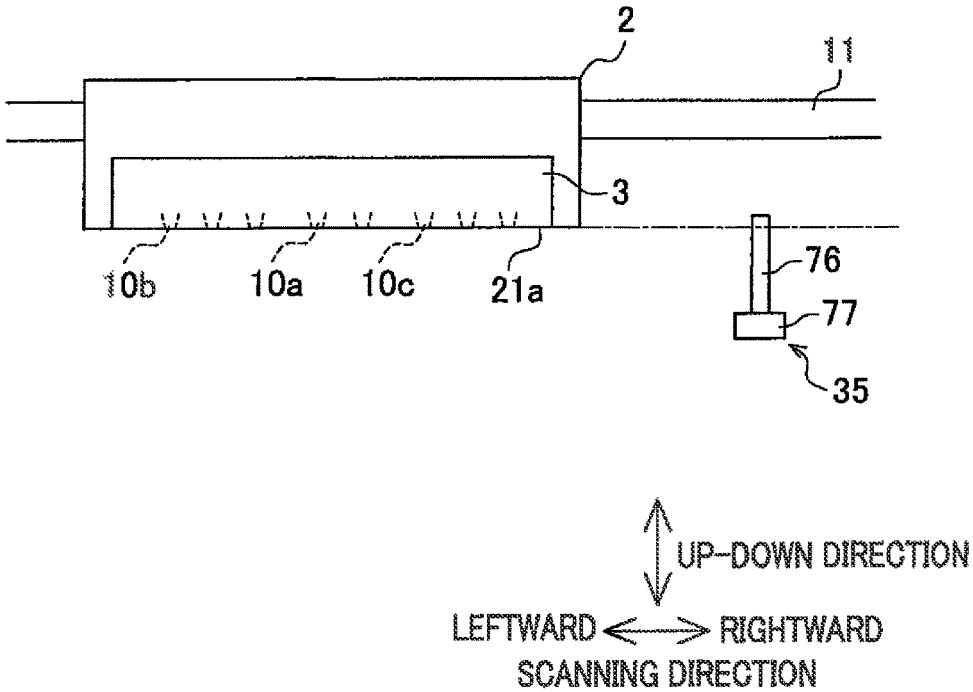
FIG. 6B shows the positional relationship between the carriage, the inkjet head, and the wiper at a state in which the wiper is elevated when

As shown ion FIG. 1 and FIG. 6, the wiper 35 is provided to the left of the nozzle cap 31 in the scanning direction, and includes a wiper blade 76 and a blade holder 77. The wiper blade 76 is a plate member made of rubber or the like, and the surfaces of this wiper blade 76 face in the conveyance direction and the up-down direction. The blade holder 77 supports a lower end portion of the wiper blade 76. Furthermore, the wiper 35 is arranged to be elevatable by a wiper elevating mechanism 78 (see FIG. 7). When the wiper 35 is lowered, as shown in FIG. 6A, the upper end of the wiper blade 76 is below the ejection surface 21*a*. In the meanwhile, when the wiper 35 is elevated, as shown in FIG. 6B, the upper end of the wiper blade 76 is above the ejection surface 21*a*.

(Controller)

Figure 7:
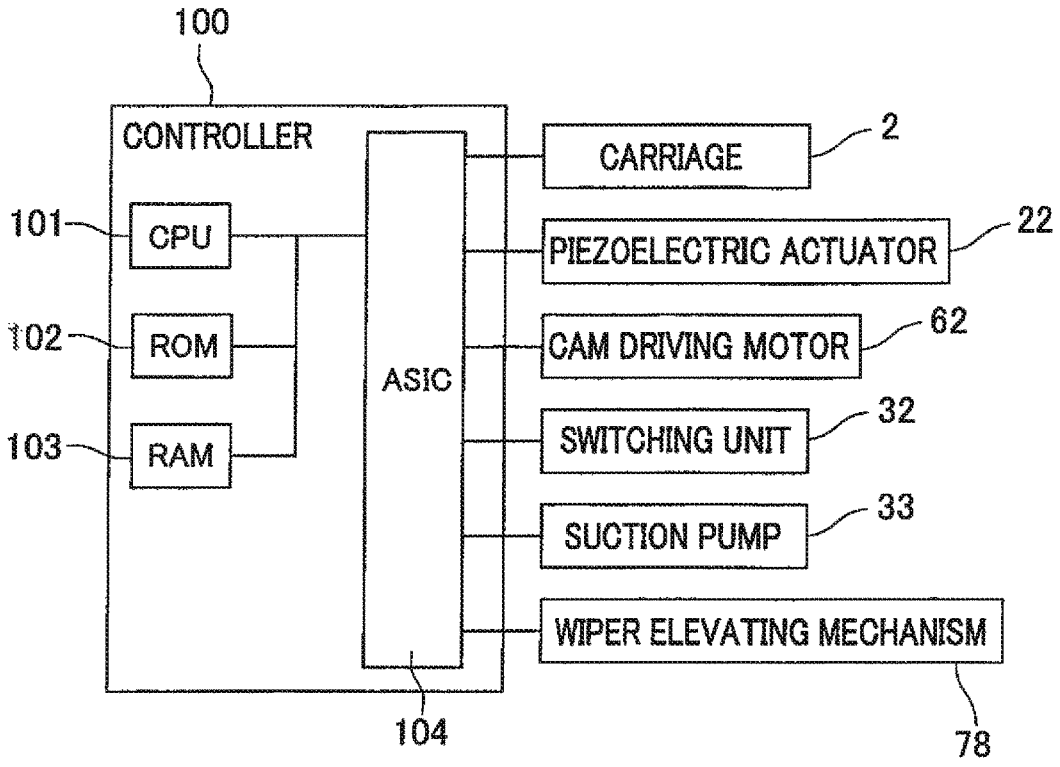
FIG. 7 is a block diagram of the controller.

Now, the following will describe a controller 100 which is configured to control the operation of the printer 1. As shown in FIG. 7, the controller 100 includes members such as a CPU (Central Processing Unit) 101, a ROM (Read Only Memory) 102, a RAM (Random Access Memory) 103, and an ASIC (Application Specific Integrated Circuit) 104, and these members cooperate to control the operations of the carriage 2, the piezoelectric actuator 22, the switching unit 32, the suction pump 33, the cam driving motor 62, the wiper elevating mechanism 78, or the like. With this, the printer 1 performs operations such as the above-described printing onto the record sheet S and a later-described maintenance operation. While FIG. 7 shows only one CPU 101, the controller 100 may include only one CPU 101 which performs necessary processes in a batch or plural CPUs 101 which perform necessary processes in a shared manner. Furthermore, while FIG. 7 shows only one ASIC 104, the controller 100 may include only one ASIC 104 which performs necessary processes in a batch or plural ASICs 104 which perform necessary processes in a shared manner.

(Maintenance Operation)

Figure 8:
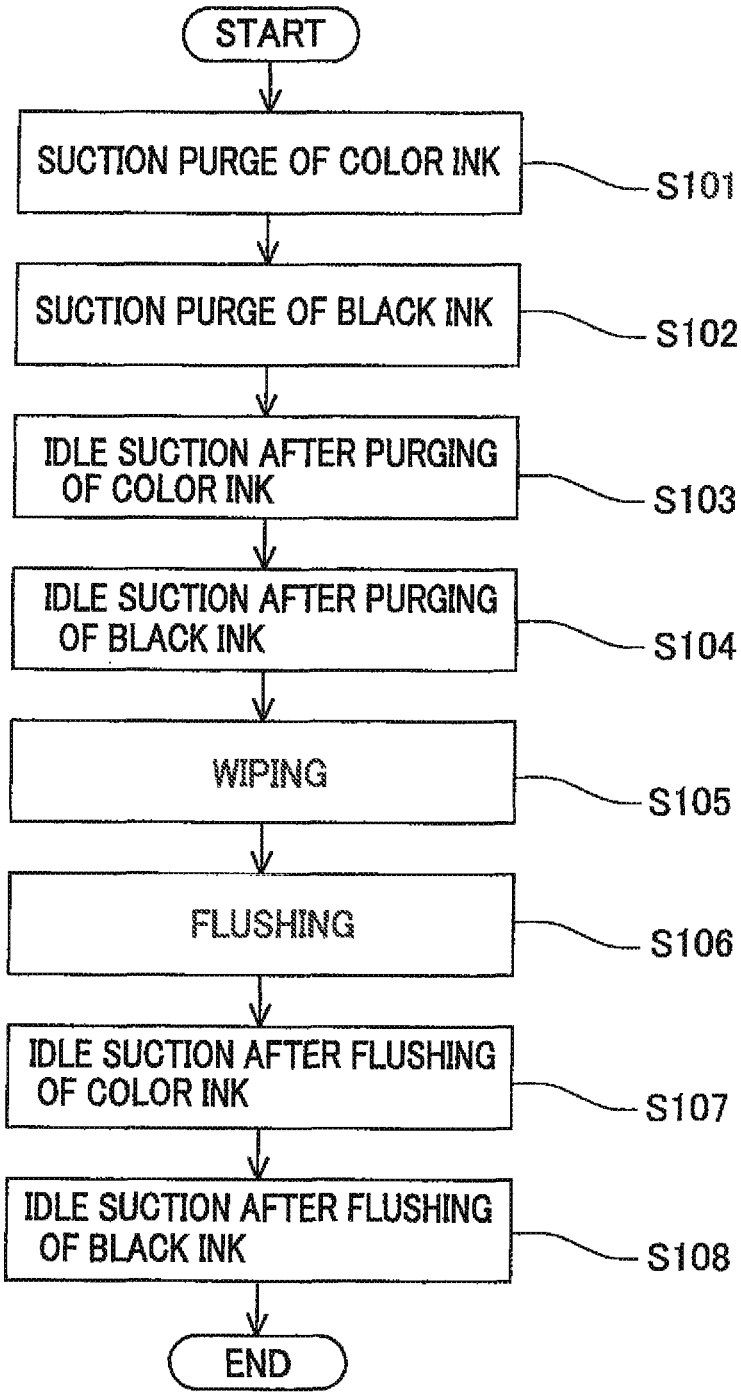
FIG. 8 is a flowchart of the steps of a maintenance operation.

Now, a maintenance operation in the printer 1 will be described. In the printer 1, the ink in the nozzles 10*a* to 10*c* may be thickened and poor ink ejection may occur in the nozzles 10*a* to 10*c*, when, for example, the printer 1 has not been used for a long time. On this account, the maintenance operation is performed in the printer 1 either regularly or in response to an input to an unillustrated operation panel of the printer 1 from a user. FIG. 8 is a flowchart showing the flow of the maintenance operation. Hereinafter, for example, "the cap section 41 is connected with the suction pump 33 by the switching unit 32 via the connection port 46 and the tube 51*a*" may be described as "the cap section 41 is connected with the suction pump 33 via the connection port 46". As such, the switching unit 32 and the tubes 51*a* to 51*d* may be omitted from the description.

Figure 9A:
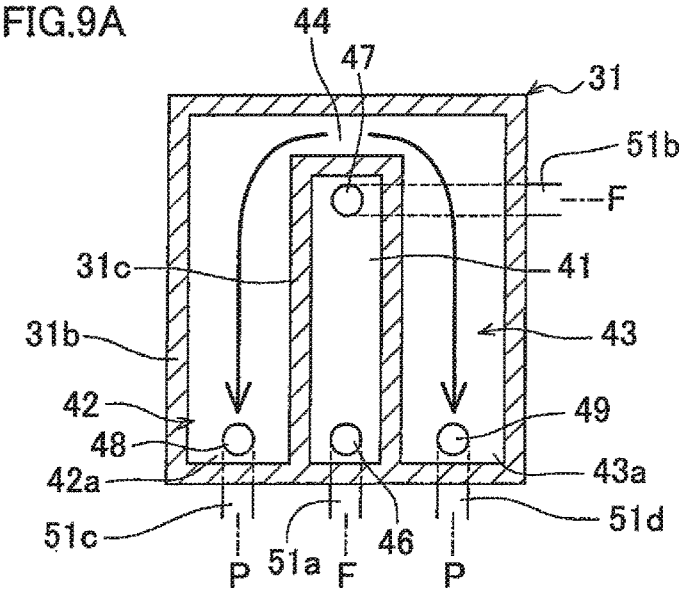
FIG. 9A is a plan view of the nozzle cap when suction purge of color ink is performed.

As shown in FIG. 8, in the maintenance operation, to begin with, suction purge (equivalent to second suction purge of the present invention) of color ink is carried out (step S101). More specifically, the nozzle cap 31 is set in the above-described capped state. Furthermore, as shown in FIG. 9A, the connection of the cap section 41 with the suction pump 33 and the communication of the cap section 41 with the atmosphere via the connection ports 46 and 47 are blocked. Furthermore, the cap sections 42 and 43 and the communication section 44 are connected with the suction pump 33 via the connection ports 48 and 49. In this state, the suction pump 33 is driven. As a result, the color ink in the inkjet head 3 is discharged from the nozzles 10*b* and 10*c*. In this regard, the ink is discharged from the nozzles 10*b* and the nozzles 10*c* at once. Note that "P" in FIG. 9A indicates that the connection with the suction pump 33 is established. In the meanwhile, "F" indicates that the connection with the suction pump 33 and the communication with the atmosphere are blocked. Furthermore, in FIG. 9A and later-described FIG. 9B, FIGS. 10A to 10D, and FIGS. 12A to D, the engaging protrusion 31*d* of the nozzle cap 31 and the pivoting shaft 66 are not illustrated in line with the omission of the cap holder 63 from the figures. Furthermore the terms such as "step S101" may be simply referred to as, for example, "S101" as the word "step" is omitted therefrom.

In regard to the above, the passage resistance of the communication section 44 is higher than the passage resistances of the cap sections 42 and 43. For this reason, when, being different from First Embodiment, the cap sections 42 and 43 and the communication section 44 are connected with the suction pump 33 via only one of the connection ports 48 and 49, the suction is performed in only one of the connection ports 48 and 49. In such a case, the difference between the cap section 42 and the cap section 43 in atmospheric pressure may become large and the discharge amount of the ink from the nozzle 10*b* may be significantly different from the discharge amount of the ink from the nozzle 10*c*. In First Embodiment, the ink is sucked from both of the connection ports 48 and 49 as the cap sections 42 and 43 and the communication section 44 are connected with the suction pump 33 via both of the connection ports 48 and 49. With this, the atmospheric pressures in the cap sections 42 and 43 and the communication section 44 become uniform and the ink is discharged evenly from the nozzles 10*b* and 10*c*.

Figure 9B:
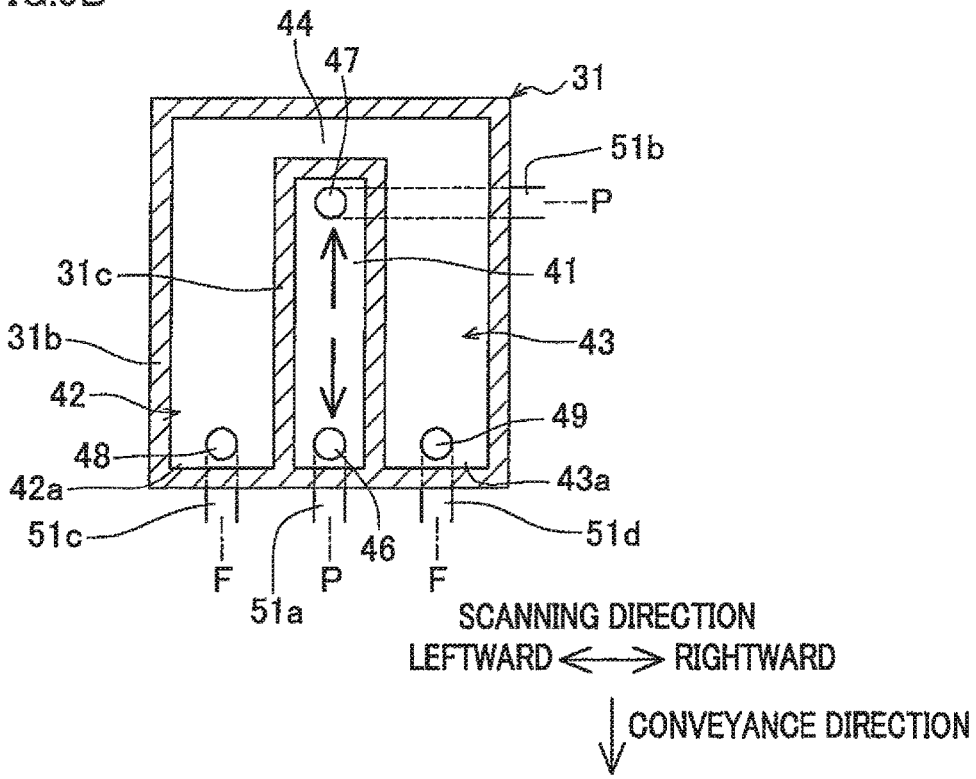
FIG. 9B is a plan view of the nozzle cap when suction purge of black ink is performed.

Subsequently, as shown in FIG. 8, suction purge of black ink is performed (S102). More specifically, while the nozzle cap 31 is kept in the capped state, as shown in FIG. 9B, the cap section 41 is connected with the suction pump 33 via the connection ports 46 and 47. Furthermore, the connection of the cap sections 42 and 43 and the communication section 44 with the suction pump 33 and the communication thereof with the atmosphere via the connection ports 48 and 49 are blocked. In this state, the suction pump 33 is driven. As a result, the black ink in the inkjet head 3 is discharged from the nozzles 10*a*.

Figures 10A, 10B, 10C, 10D:
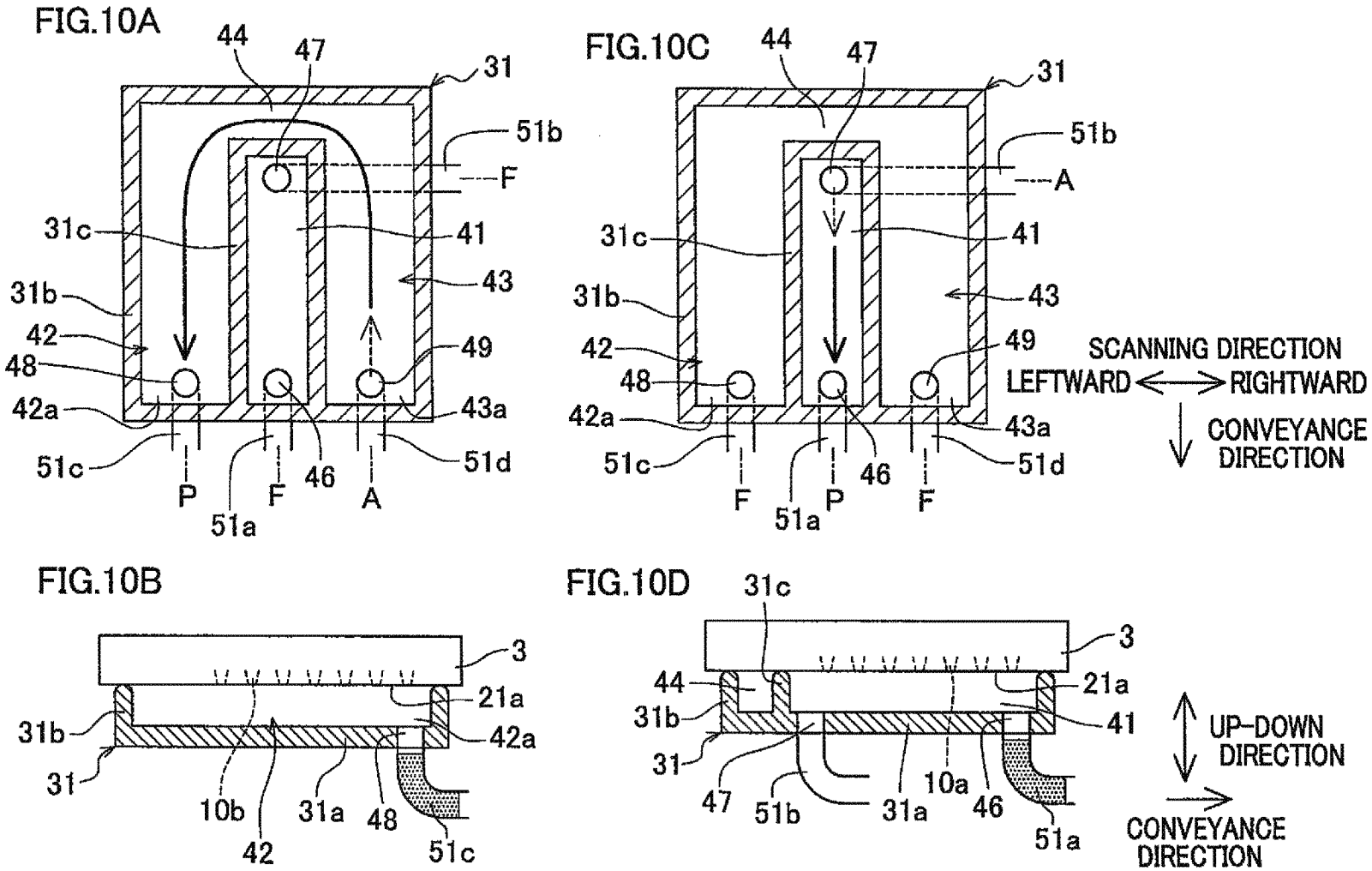
FIG. 10A is a plan view of the nozzle cap when idle suction after purging of color ink is performed.
FIG. 10B is a cross section taken along the conveyance direction of the first cap section immediately after the idle suction after purging of color ink.
FIG. 10C is a plan view of the nozzle cap when idle suction after purging of black ink is performed.
FIG. 10D is a cross section taken at the conveyance direction of the third cap section and the connection portion immediately after the idle suction after purging of black ink.

Subsequently, as shown in FIG. 8, idle suction after purging of color ink (equivalent to second idle suction after purging in the present invention) is carried out (S103). To be more specific, while the nozzle cap 31 is kept in the capped state, as shown in FIG. 10A, the connection of the cap section 41 with the suction pump 33 and the communication thereof with the atmosphere via the connection ports 46 and 47 are blocked. Furthermore, via the connection port 48, the cap sections 42 and 43 and the communication section 44 are connected to the suction pump 33. Furthermore, via the connection port 49, the cap sections 42 and 43 and the communication section 44 are caused to communicate with the atmosphere. In this state, the suction pump 33 is driven. With this, the outside air is introduced from the connection port 49, and the ink remaining in the cap section 42, the cap section 43, and the communication section 44 due to suction purge is discharged from the connection port 48. At this stage, in the cap sections 42 and 43 and the communication section 44, the ink flows along a non-branching single passage from the connection port 49 formed in the cap section 43 to the connection port 48 formed in the cap section 42 via the cap section 43, the communication section 44, and the cap section 42 in order. As such, the flow of the ink to the connection port 48 does not branch, and the ink remaining in the cap sections 42 and 43 and the communication section 44 is certainly discharged at once. Note that "A" in FIG. 10A indicates the communication with the atmosphere.

In addition to the above, at the stage above, as the suction pump 33 is stopped before the ink discharged from the connection port 48 to the tube 51*c* is completely discharged to the waste liquid tank 34, the ink is arranged to remain in the tube 51*c* as shown in FIG. 10B. In FIG. 10B and subsequent figures similar to FIG. 10B, the cap chips 71 to 74 are omitted for the sake of convenience.

Subsequently, as shown in FIG. 8, idle suction after purging of black ink is carried out (S104). To be more specific, while the nozzle cap 31 is kept in the capped state, as shown in FIG. 10C, the cap section 41 is connected with the suction pump 33 via the connection port 46. Furthermore, the cap section 41 is caused to communicate with the atmosphere via the connection port 47. Furthermore, the connection with the suction pump 33 and the communication with the atmosphere of the cap sections 42 and 43 and the communication section 44 via the connection ports 48 and 49 are blocked. In this state, the suction pump 33 is driven. With this, the outside air is introduced from the connection port 47, and the ink remaining in the cap section 41 due to suction purge is discharged from the connection port 46. At this stage, as the suction pump 33 is stopped before the ink discharged from the connection port 46 to the tube 51*a* is completely discharged to the waste liquid tank 34, the ink is arranged to remain in the tube 51*a* as shown in FIG. 10D.

The suction purge in S101 and S102 and the idle suction after purging in S103 and S104 may be carried out in a different order, e.g., the idle suction after purging in S103 is carried out after the suction purge in S101 and the idle suction after purging in S104 is carried out after the suction purge in S102.

Figure 11:
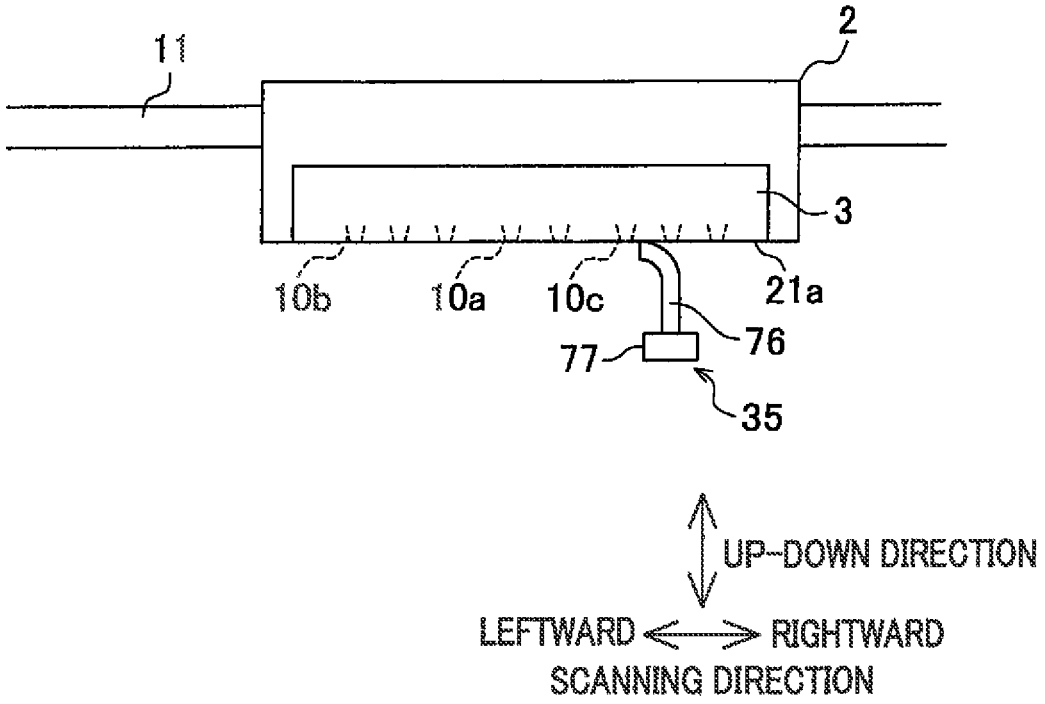
FIG. 11 illustrates a wiping operation.

Subsequently, wiping is carried out as shown in FIG. 8 (S105). To be more specific, as shown in FIG. 11, after the nozzle cap 31 is detached from the ejection surface 21*a* and the wiper 35 is elevated, the carriage 2 is moved in the scanning direction so that the ejection surface 21*a* passes over the wiper 35. With this, as shown in FIG. 11, the wiper blade 76 moves on the ejection surface 21*a* while the upper end portion of the wiper blade 76 is elastically deformed and contacts with the ejection surface 21*a*, with the result that the ink adhered to the ejection surface 21*a* is wiped away.

Figure 12A:
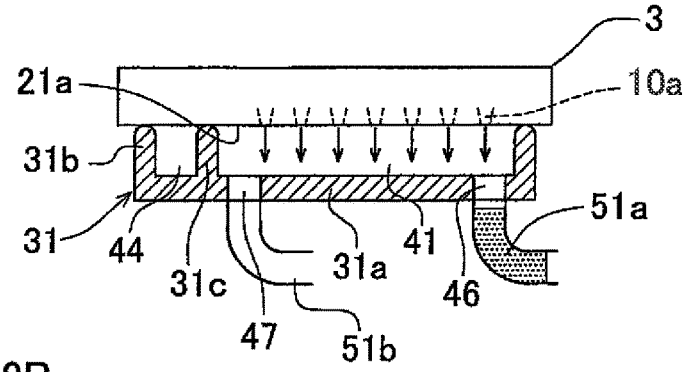
FIG. 12A is a cross section of the third cap section taken along the conveyance direction of the nozzle cap when flushing is performed.
Figure 12B:
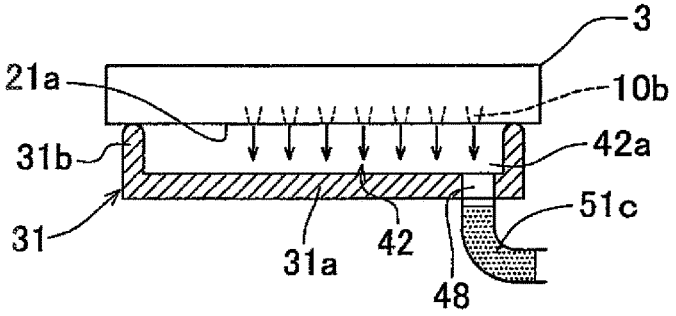
FIG. 12B is a cross section of the first cap section taken along the conveyance direction of the nozzle cap when flushing is performed.
Figure 12C:
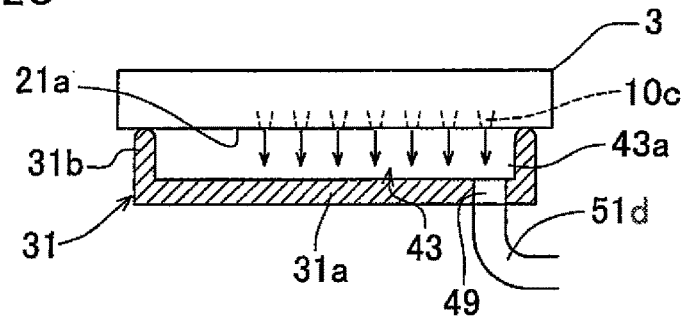
FIG. 12C is a cross section of the second cap section taken along the conveyance direction of the nozzle cap when flushing is performed.
Figure 12C:
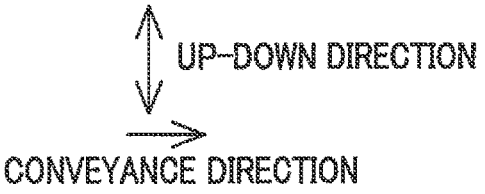

Subsequently, flushing is carried out as shown in FIG. 8 (S106). To be more specific, as shown in FIGS. 12A to 12C, the ink is ejected from the nozzles 10*a* to 10*c* toward the cap sections 41 to 43 while the ejection surface 21*a* opposes the nozzle cap 31. When the ink adhered to the ejection surface 21*a* is wiped away in the above-described wiping, ink with a color different from the color of the ink to be ejected may flow into the nozzles 10*a* to 10*c*. For this reason, the flushing is performed after the wiping, to discharge the ink having flowed into the nozzles 10*a* to 10*c* in the wiping. While in FIGS. 12A to 12C the flushing is performed in the capped state, the ejection surface 21*a* may be detached from the nozzle cap 31 in the flushing.

Figures 13A, 13B, 13C, 13D:
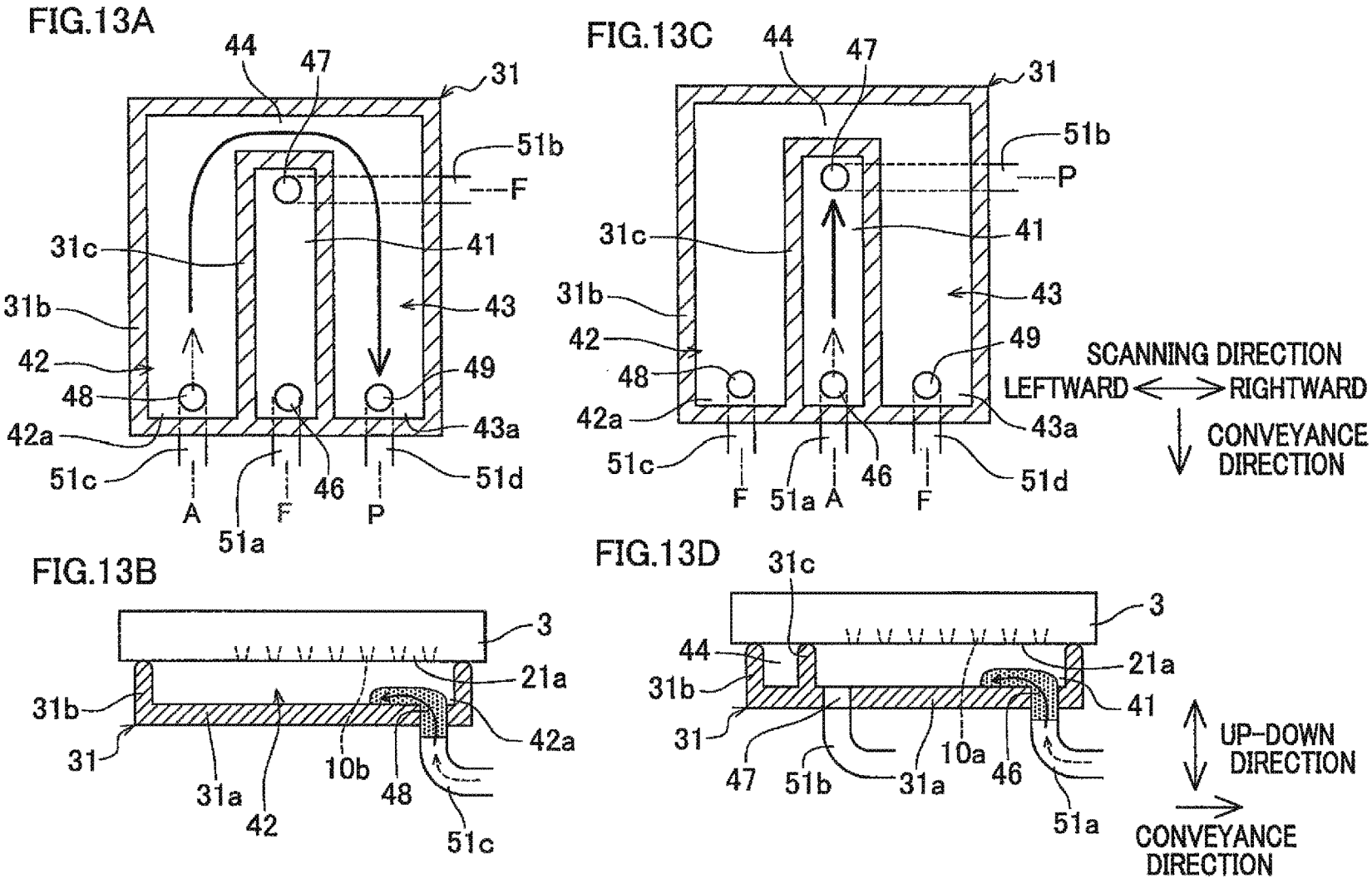
FIG. 13A is a plan view of the nozzle cap when idle suction after flushing of color ink is performed.
FIG. 13B is a cross section taken along the conveyance direction of the first cap section immediately after the idle suction after flushing of color ink.
FIG. 13C is a plan view of the nozzle cap when idle suction after flushing of black ink is performed.
FIG. 13D is a cross section taken along the conveyance direction of the third cap section and the connection portion immediately after the idle suction after flushing of black ink.

Subsequently, idle suction after flushing of color ink is carried out as shown in FIG. 8 (S107). To be more specific, the nozzle cap 31 is set in the above-described capped state. Furthermore, as shown in FIG. 13A, the connection with the suction pump 33 and the communication with the atmosphere of the cap section 41 via the connection ports 46 and 47 are blocked. Furthermore, via the connection port 48, the cap sections 42 and 43 and the communication section 44 are caused to communicate with the atmosphere. Furthermore, via the connection port 49, the cap sections 42 and 43 and the communication section 44 are connected with the suction pump 33. In this state, the suction pump 33 is driven. With this, the outside air is introduced from the connection port 48 into the cap section 42, and the ink arranged to remain in the tube 51*c* in the idle suction after purging flows into the cap section 42 as shown in FIG. 13B. Thereafter, together with the ink flowing into the cap section 42, the ink remaining in the cap section 42, the cap section 43, and the communication section 44 due to flushing is discharged from the connection port 49.

In connection with the above, the discharge amount of ink in flushing is typically smaller than the discharge amount of ink in suction purge. For this reason, when, being different from First Embodiment, only the ink remaining in the cap section 42, the cap section 43, and the communication section 44 due to flushing is discharged in the idle suction after flushing of color ink, the connection port 49 may disadvantageously communicate with the air in the cap section 43, and hence the ink remaining in the cap sections 42 and 43 and the communication section 44 may not be discharged.

In First Embodiment, the ink is arranged to remain in the tube 51*c* in the idle suction after purging of color ink, and the ink remaining in the tube 51*c* is caused to flow in the cap section 42 in the idle suction after flushing of color ink. With this, the total amount of the ink in the cap sections 42 and 43 and the communication section 44 is increased and the communication of the connection port 49 with the air becomes less likely to occur. As such, the ink remaining in the cap sections 42 and 43 and the communication section 44 due to flushing is certainly discharged.

Subsequently, as shown in FIG. 8, idle suction after flushing of black ink is carried out (S108). To be more specific, while the nozzle cap 31 is kept in the capped state, as shown in FIG. 13C, the cap section 41 is caused to communicate with the atmosphere via the connection port 46. Furthermore, the cap section 41 is connected with the suction pump 33 via the connection port 47. Furthermore, the connection with the suction pump 33 and the communication with the atmosphere of the cap sections 42 and 43 and the communication section 44 via the connection ports 48 and 49 are blocked. In this state, the suction pump 33 is driven. With this, the outside air is introduced from the connection port 46 into the cap section 41, and, as shown in FIG. 13D, the ink arranged to remain in the tube 51*a* in the idle suction after purging of black ink flows into the cap section 41. Thereafter, together with the ink having flowed in, the ink remaining in the cap section 41 due to flushing is discharged from the connection port 47.

In First Embodiment, the process performed by the controller 100 to cause the printer 1 to perform suction purge of color ink is equivalent to a second suction purge process of the present invention. Furthermore, the process performed by the controller 100 to cause the printer 1 to perform idle suction after purging of color ink is equivalent to a second idle suction process after purging of the present invention. Furthermore, the process performed by the controller 100 to cause the printer 1 to perform flushing is equivalent to a flushing process of the present invention. Furthermore, the process performed by the controller 100 to cause the printer 1 to perform idle suction after flushing of color ink is equivalent to an idle suction process after flushing of the present invention.

In regard to the above, in idle suction after purging and in idle suction after flushing, the ink remaining in the cap sections 41 to 43 and the communication section 44 is discharged. However, even if the idle suction after purging or the idle suction after flushing is performed, some amount of ink still remains in the nozzle cap 31. For this reason, as described above, when the inclined nozzle cap 31 is moved away from the ejection surface 21*a*, as shown in FIGS. 5A to 5C, an ink film M (bridge) is locally formed between the ejection surface 21*a* and the upstream end portion in the conveyance direction of the lip portion 31*b*, at which portion the nozzle cap 31 is detached from the ejection surface 21*a* at last. When the nozzle cap 31 is further moved away from the ejection surface 21*a*, the ink film M is broken and the ink scatters around. The ink forming the ink film M is discharged by the suction purge or the flushing, and often includes bubbles or the like. For this reason, as the ink having scattered when the ink film M is broken reaches the nozzles 10*a* to 10*c* and flows into the nozzles 10*a* to 10*c*, poor ink ejection may occur in the nozzles 10*a* to 10*c*.

In First Embodiment, the connection portion 44 is provided in the nozzle cap 31. As this connection portion 44 is connected with the upstream end portion in the conveyance direction of the cap section 42 and the upstream end portion in the conveyance direction of the cap section 43, the cap section 42 is communicated with the cap section 43. For this reason, the nozzle cap 31 extends to be long in the upstream side in the conveyance direction as compared to a case where the communication section 44 is not provided. As a result, the distance between the upstream end portion in the conveyance direction of the nozzle cap 31 and the most upstream nozzles 10*a* to 10*c* in the conveyance direction is longer than the distance between the downstream end portion in the conveyance direction of the nozzle cap 31 and the most downstream nozzles 10*a* to 10*c* in the conveyance direction.

On this account, in First Embodiment, the nozzle cap 31 is moved away from the ejection surface 21*a* while the nozzle cap 31 is inclined such that the downstream end portion in the conveyance direction is farther from the ejection surface 21*a* than the upstream end portion. The ink film M is therefore formed to be more distant from the nozzles 10*a* to 10*c* than in a case where, on the contrary to First Embodiment, the nozzle cap 31 is moved away from the ejection surface 21*a* while the nozzle cap 31 is inclined such that the upstream end portion in the conveyance direction is farther from the ejection surface 21*a* than the downstream end portion. With this, the ink scattered due to the breaking of the ink film M is less likely to reach the nozzles 10*a* to 10*c*.

[Second Embodiment]

Figure 14:
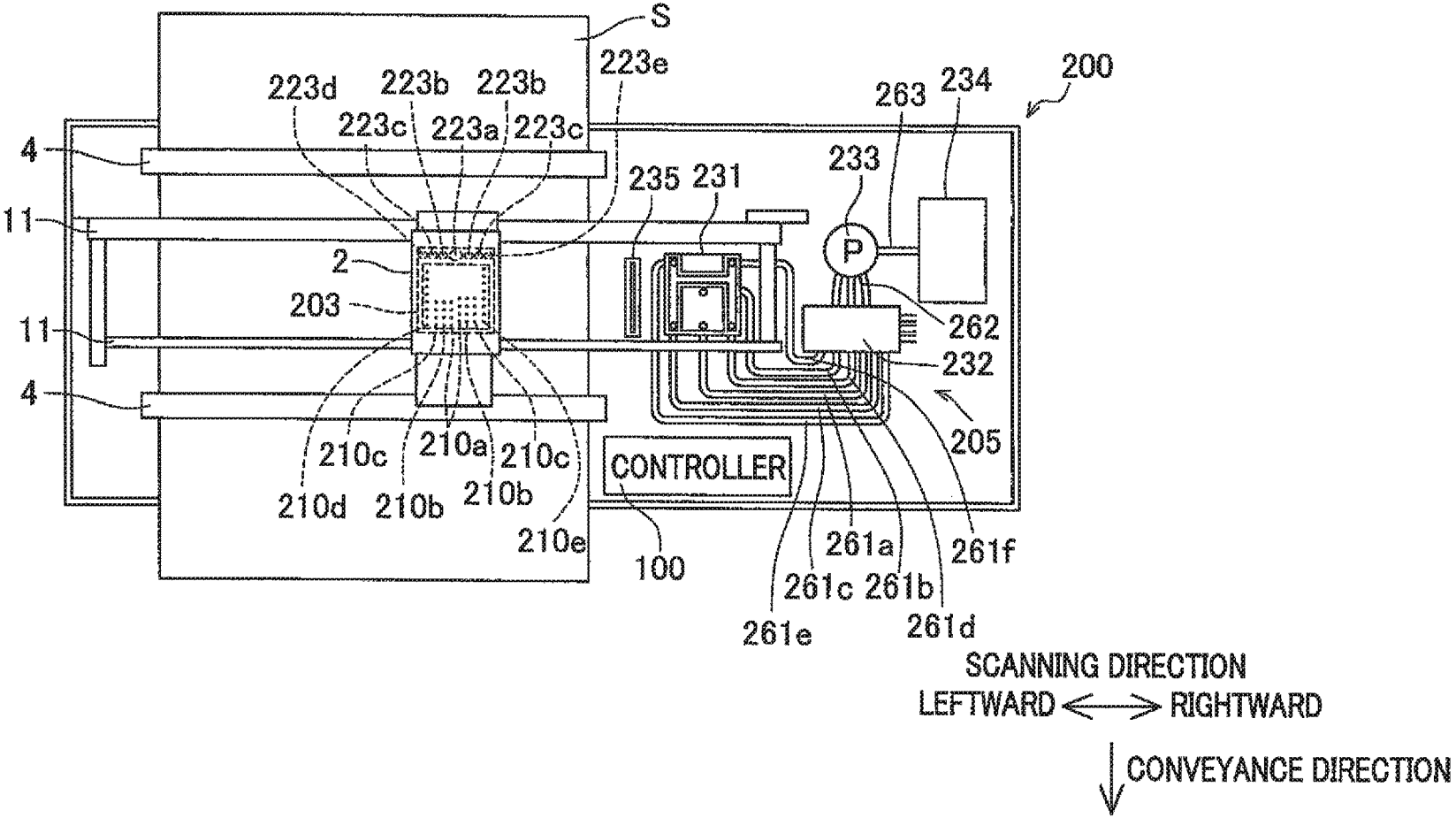
FIG. 14 is a schematic diagram of a printer of Second Embodiment.

The following will describe preferred Second Embodiment of the present invention. As shown in FIG. 14, a printer 200 of Second Embodiment is identical with the printer 1 of First Embodiment except that the inkjet head 3 is replaced with an inkjet head 203 and the maintenance unit 5 is replaced with a maintenance unit 205. The following will therefore mainly focus on the inkjet head 203 and the maintenance unit 205.

(Inkjet Head)

Figure 15:
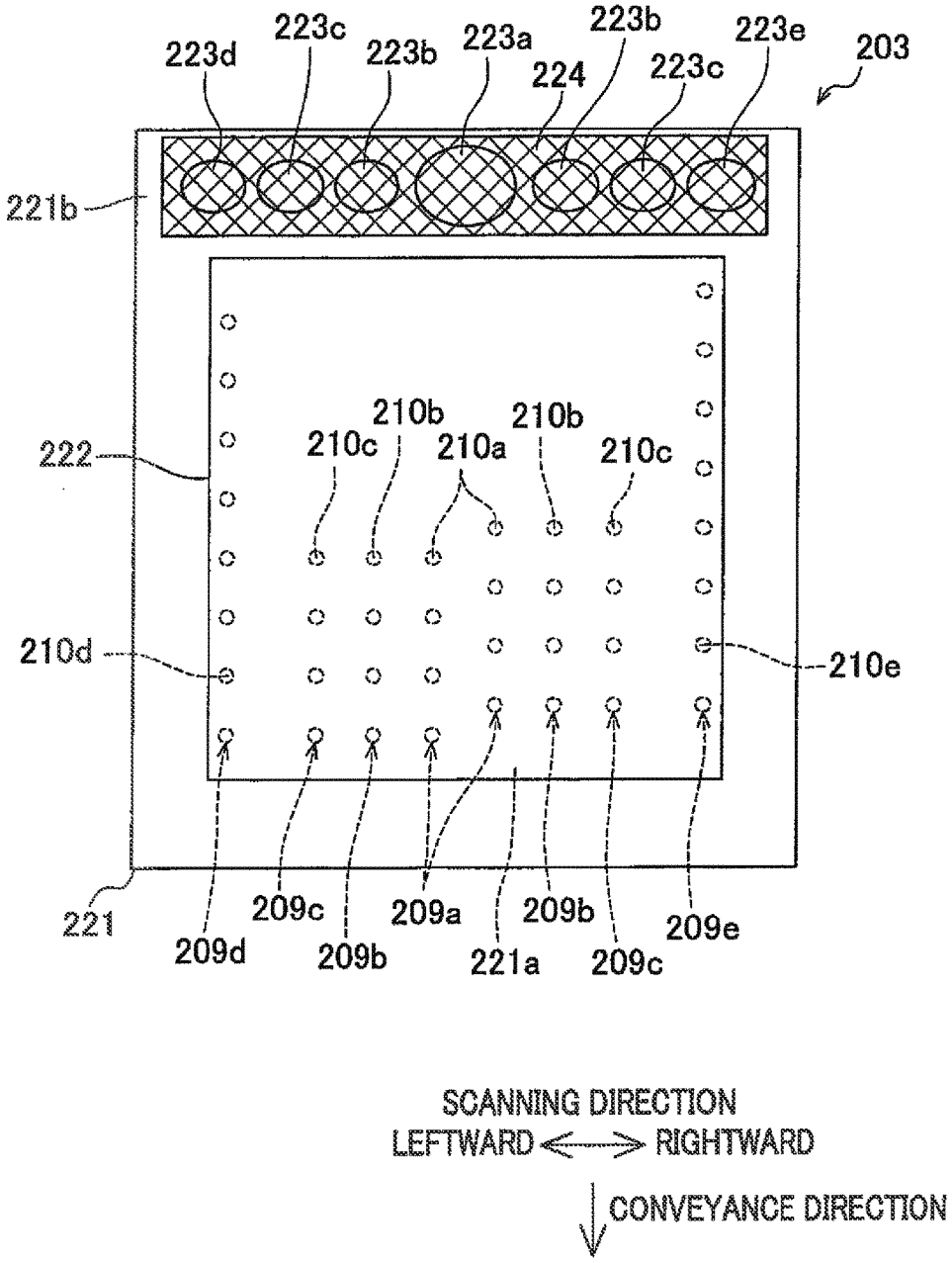
FIG. 15 is a plan view of the inkjet head of FIG. 14.

As shown in FIGS. 14 and 15, the inkjet head 203 of Second Embodiment includes a passage unit 221 and a piezoelectric actuator 222. In the passage unit 221, ink passages including nozzles 210*a* to 210*e* and ink supply openings 223*a* to 223*e* are formed.

The nozzles 210*a* are formed at a central part in the scanning direction of an ejection surface 221*a* which is the lower surface of the passage unit 221. The nozzles 210*a* are lined up in the conveyance direction to form nozzle rows 209*a*. On the passage unit 221, two nozzle rows 209*a* are lined up in the scanning direction. The nozzles 210*a* eject magenta dye ink.

The nozzles 210*b* are formed on the outer sides of the nozzles 210*a* in the scanning direction on the ejection surface 221*a*. The nozzles 210*b* are lined up in the conveyance direction at positions to the left of the left nozzle row 209*a* and to the right of the right nozzle row 209*a*, so as to form nozzle rows 209*b*. The nozzles 210*b* eject cyan dye ink.

The nozzles 210*c* are formed on the outer sides of the nozzles 210*b* in the scanning direction on the ejection surface 221*a*. The nozzles 210*c* are lined up in the conveyance direction at positions to the left of the left nozzle row 209*b* and to the right of the right nozzle row 209*b*, so as to form nozzle rows 209*c*. The nozzles 210*c* eject yellow dye ink.

In Second Embodiment, the nozzles 210*a* to 210*c* are equivalent to the third nozzles of the present invention.

The nozzles 210*d* (equivalent to the second nozzles of the present invention) are formed to the left of the left nozzles 210*c* in the scanning direction on the ejection surface 221*a*. The nozzles 210*d* are lined up in the conveyance direction to form a nozzle row 209*d*. The nozzles 210*e* (equivalent to the first nozzles of the present invention) are provided to the right of the right nozzles 210*c* in the scanning direction on the ejection surface 221*a*. The nozzles 210*e* are lined up in the conveyance direction to form a nozzle row 209*e*. The number of the nozzles 210*d* and 210*e* is about twice as much as the number of the nozzles 210*a* to 210*c*. In the conveyance direction, each of the nozzle rows 209*d* and 209*e* is longer than each of the nozzle rows 209*a* to 209*c*. The nozzles 210*d* and 210*e* eject black pigment ink.

In the printer 200 of Second Embodiment, monochrome printing is possible by the ejection of black ink from the nozzles 210*d* and 210*e* and color printing is possible by the ejection of color ink from the nozzles 210*a* to 210*c*. According to Second Embodiment, the monochrome printing is faster than the color printing because the nozzle rows 209*d* and 209*e* are longer than the nozzle rows 209*a* to 209*c* in the conveyance direction.

The ink supply opening 223*a* is formed at a central part in the scanning direction of an upstream end portion in the conveyance direction of the upper surface of the passage unit 221. The ink supply opening 223*a* is connected with an unillustrated ink cartridge filled with magenta ink, via an unillustrated tube or the like. With this, magenta ink to be ejected from the nozzles 210*a* is supplied to the inkjet head 203 from the three ink supply opening 223*a*.

The ink supply openings 223*b* are formed to the left and to the right of the ink supply opening 223*a* on the upper surface 221*b* of the passage unit 221. The ink supply openings 223*a* are connected to an unillustrated ink cartridge filled with cyan ink via an unillustrated tube or the like. With this, the cyan ink to be ejected from the nozzles 210*b* is supplied to the inkjet head 203 from the ink supply openings 223*b*.

The ink supply openings 223*c* are formed to the left of the left ink supply opening 223*b* and to the right of the right ink supply opening 223*b* on the upper surface 221*b* of the passage unit 221. The ink supply opening 223*c* are connected to an unillustrated ink cartridge filled with yellow ink via an unillustrated tube or the like. With this, the yellow ink to be ejected from the nozzles 210*c* is supplied to the inkjet head 203 from the ink supply openings 223*c*.

The ink supply opening 223*d* is formed to the left of the left ink supply opening 223*c* on the upper surface 221*b* of the passage unit 221. The ink supply opening 223*d* is connected to an unillustrated ink cartridge filled with black ink, via an unillustrated tube or the like. With this, the black ink to be ejected from the nozzles 210*d* is supplied from the ink supply opening 223*d* to the inkjet head 203.

The ink supply opening 223*e* is formed to the right of the right ink supply opening 223*c* on the upper surface 221*b* of the passage unit 221. The ink supply opening 223*e* is connected to an unillustrated ink cartridge filled with black ink, via an unillustrated tube or the like. With this, the black ink to be ejected from the nozzles 210*e* is supplied from the ink supply opening 223*e* to the inkjet head 203.

In addition to the above, on the upper surface 221*b* of the passage unit 221, a filter 224 is provided to cover the ink supply openings 223*a* to 223*e*. With this, the filter 224 captures bubbles, foreign matters or the like in the ink when the ink is supplied from the ink supply openings 223*a* to 223*e* to the inkjet head 203, and hence the bubbles, foreign matters or the like in the ink do not flow into the inkjet head 203.

The piezoelectric actuator 222 is provided on the upper surface 221*b* of the passage unit 221. This piezoelectric actuator 222 imparts an ejection energy to the ink in the passage unit 221. For example, the ink passages of the passage unit 221 have unillustrated pressure chambers between the nozzles 210*a* to 210*c* and the ink supply openings 223*a* to 223*e*, and the piezoelectric actuator 222 pressurizes the ink in the pressure chambers.

(Maintenance Unit)

Now, the maintenance unit 205 will be described. As shown in FIG. 14, the maintenance unit 205 includes a nozzle cap 231, a switching unit 232 (equivalent to a sixth switching device of the present invention), a suction pump 233, and a waste liquid tank 234.

Figure 16B:
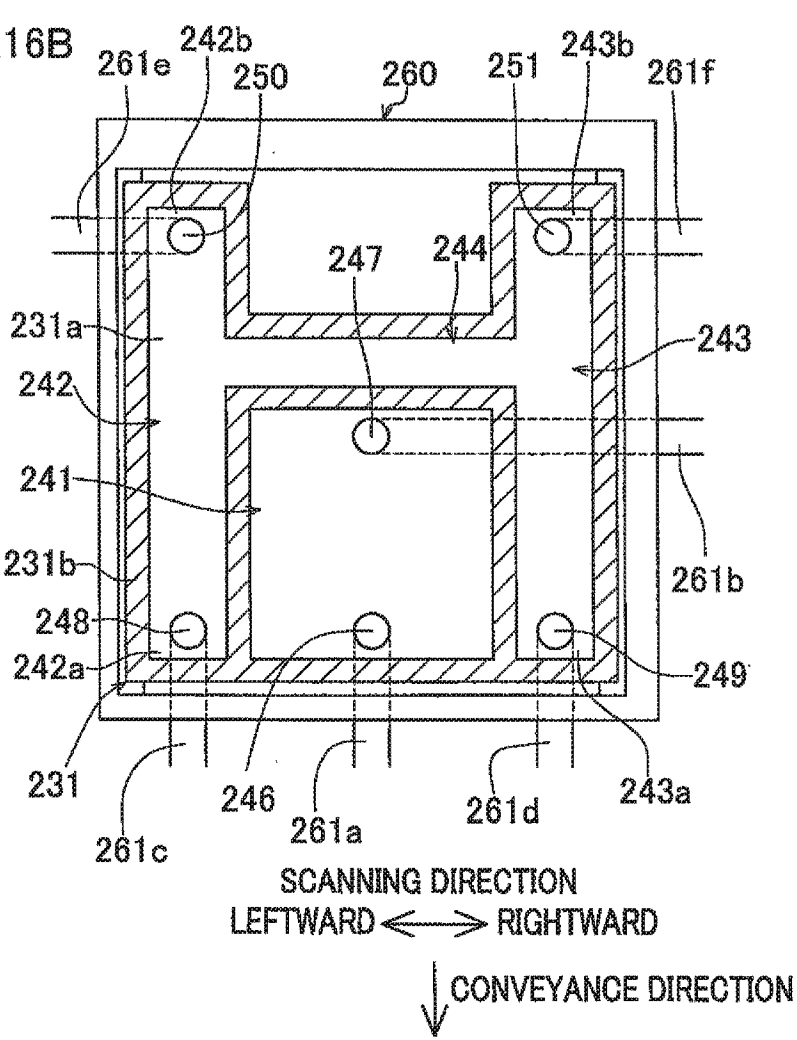
FIG. 16B shows a state that the cap chips are removed from the state shown in FIG. 16A.
Figure 16A:
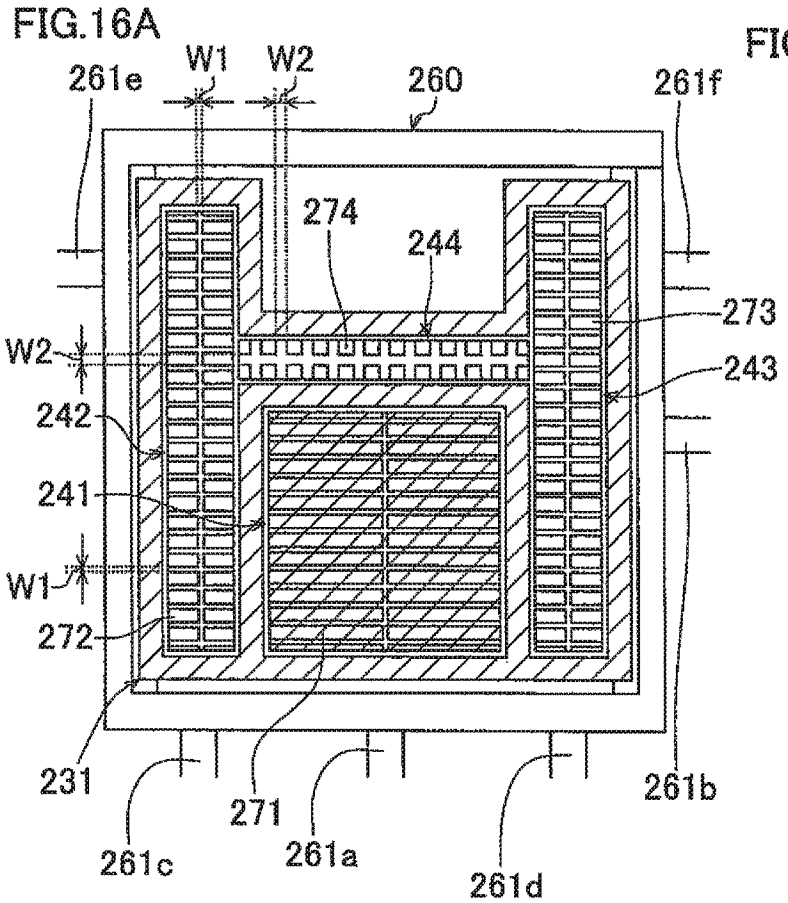
FIG. 16A is a plan view of the nozzle cap of FIG. 14.

The nozzle cap 231 is made of rubber or the like and includes cap sections 241 to 243 and a communication section 244 as shown in FIGS. 16A and 16B. As the carriage 2 is moved to the rightmost position in the scanning direction, the nozzle cap 231 opposes the ejection surface 221*a*. The cap section 241 (equivalent to the third cap section of the present invention) opposes the nozzles 210*a* to 210*c* when the nozzle cap 231 opposes the ejection surface 221*a*. The cap section 242 (equivalent to the second cap section of the present invention) is provided to the left of the cap section 241 and opposes the nozzles 210*d* when the nozzle cap 231 opposes the ejection surface 221*a*. The cap section 243 (equivalent to the first cap section of the present invention) is provided to the right of the cap section 241 and opposes the nozzles 210*e* when the nozzle cap 231 opposes the ejection surface 221*a*. As such, the cap section 241 is provided between the cap section 242 and the cap section 243 in the scanning direction. Furthermore, in Second Embodiment, because the nozzle rows 209*d* and 209*e* are longer than the nozzle rows 209*a* to 209*c* in the conveyance direction as described above, the cap sections 242 and 243 are longer than the cap section 241 in the conveyance direction.

As shown in FIGS. 16A and 16B, the communication section 244 is provided on the upstream of the cap section 241 in the conveyance direction. As such, the communication section 244 is provided between the cap section 242 and the cap section 243 in the scanning direction and is deviated from the cap section 241 in the conveyance direction. The communication section 244 extends in the scanning direction to be connected to an intermediate portion of the cap section 242 in the conveyance direction and an intermediate portion of the cap section 243 in the conveyance direction. The cap section 242 communicates with the cap section 243 via the communication section 244.

As shown in FIGS. 16A and 16B, the cap sections 241 to 243 and the communication section 244 described above are formed by a bottom wall portion 231*a* constituting the inner bottom surfaces of the cap sections 241 to 243 and the communication section 244 and a lip portion 231*b* provided on the upper surface of the bottom wall portion 231*a* to surround the cap sections 241 to 243 and the communication section 244 in plan view.

In addition to the above, as shown in FIG. 16B, at the upstream and downstream end portions in the conveyance direction of the cap section 241 of the bottom wall portion 231*a*, connection ports 246 and 247 are formed. Furthermore, at downstream end portions 242*a* and 243*a* (equivalent to the non-connecting end portion of the present invention) in the conveyance direction of the cap sections 242 and 243 of the bottom wall portion 231*a*, connection ports 248 and 249 (equivalent to the suction port of the present invention) are formed. Furthermore, at the upstream end portions 242*b* and 243*b* (equivalent to the non-connecting end portion of the present invention) in the conveyance direction of the cap sections 242 and 243 of the bottom wall portion 231*a*, connection ports 250 and 251 (equivalent to the atmosphere communication port of the present invention) are formed, respectively. The connection ports 246 to 251 are connected to tubes 261*a* to 261*f*, respectively.

The cap sections 241 to 243 and the communication section 244 house cap chips 271 to 274, respectively.

In addition to the above, the nozzle cap 231 is movable in the up-down direction by the cap driving mechanism 60 which has been described in First Embodiment. As the nozzle cap 231 is elevated while the carriage 2 is provided at the rightmost position in the scanning direction, the nozzles 210*a* to 210*c*, 210*d*, and 210*e* become in a capped state of being covered with the respective cap sections 241 to 243. At the same time, by the communication section 244 and the ejection surface 221*a*, a space by which the cap section 242 communicates with the cap section 243 is formed.

As shown in FIG. 14, the switching unit 232 is connected to the nozzle cap 231 via the connection ports 246 to 251 and the tubes 261*a* to 261*f*, and is connected to the suction pump 233 via the tube 262 on the side opposite to the nozzle cap 231. The switching unit 232 switches between the connection and the disconnection of the cap section 241 with the suction pump 233 via the connection port 246 and the tube 261*a*. Furthermore, the switching unit 232 switches between the connection and the disconnection of the cap sections 242 and 243 and the communication section 244 with the suction pump 233 via the connection ports 248 and 249 and the tubes 261*c* and 261*d*. Furthermore, the switching unit 232 switches between the communication and the non-communication of the cap section 241 with the atmosphere via the connection port 247 and the tube 261*b*. Furthermore, the switching unit 232 switches between the communication and the non-communication of the cap sections 242 and 243 and the communication section 244 with the atmosphere via the connection ports 250 and 251 and the tubes 261*e* and 261*f*.

The suction pump 233 is a tube pump or the like, and is connected with the switching unit 232 via the tube 262 and connected with the waste liquid tank 234 via the tube 263 on the side opposite to the switching unit 232, as shown in FIG. 14. The waste liquid tank 234 stores ink discharged in a later-described maintenance operation.

The wiper 235 is provided to the left of the nozzle cap 231 in the scanning direction.

(Maintenance Operation)

Now, a maintenance operation in the printer 200 will be described. In Second Embodiment, the maintenance operation is executed in accordance with the flow shown in FIG. 8, in a manner similar to the maintenance operation in First Embodiment. In Second Embodiment, however, as described below, the suction purge, the idle suction after purging, and the idle suction after flushing are executed in different ways from First Embodiment. Although not described below, the nozzle cap 231 is in the capped state in the suction purge, the idle suction after purging, and the idle suction after flushing in Second Embodiment, in the same manner as in First Embodiment.

Figure 17A:
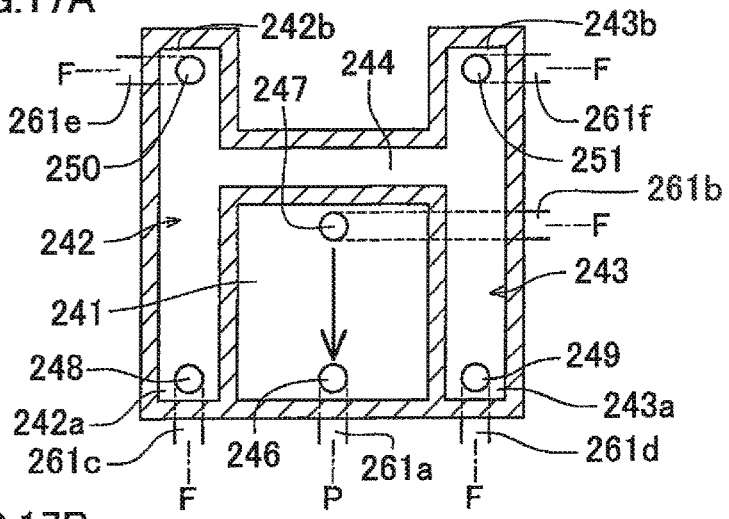
FIG. 17A is a plan view of the nozzle cap when suction purge of color ink is performed in Second Embodiment.

In Second Embodiment, as shown in FIG. 17A, the cap section 241 is connected with the suction pump 233 via the connection port 246 in the suction purge of color ink in S101. Furthermore, the communication of the cap section 241 with the atmosphere via the connection port 247 is blocked. Furthermore, the connection of the cap sections 242 and 243 and the communication section 244 with the suction pump 233 via the connection ports 248 and 249 is blocked. Furthermore, the communication of the cap sections 242 and 243 and the communication section 244 with the atmosphere via the connection ports 250 and 251 is blocked. In this state, the suction pump 233 is driven. As a result, the color ink in the inkjet head 203 is discharged from the nozzles 210*a* to 210*c*.

Figure 17B:
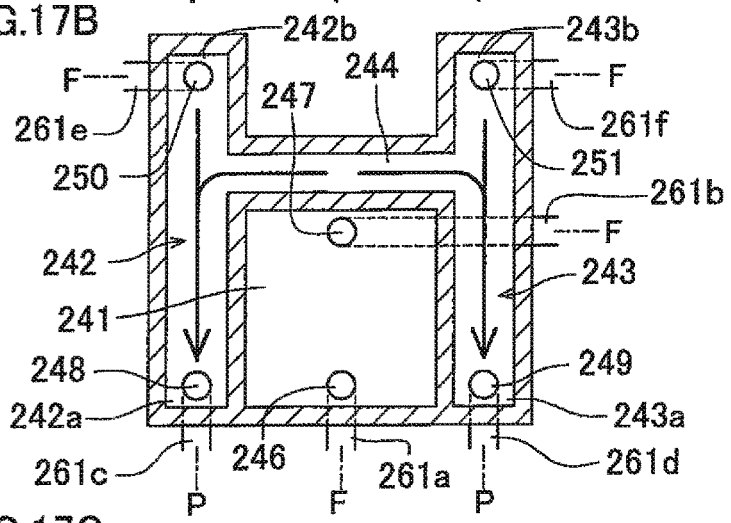
FIG. 17B is a plan view of the nozzle cap when suction purge of black ink is performed in Second Embodiment.

In addition to the above, in Second Embodiment, as shown in FIG. 17B, the connection of the cap section 241 with the suction pump 233 via the connection port 246 is blocked in the suction purge of black ink in S102. Furthermore, the communication of the cap section 241 with the atmosphere via the connection port 247 is blocked. Furthermore, the cap sections 242 and 243 and the communication section 244 are connected with the suction pump 233 via the connection ports 248 and 249. Furthermore, the communication of the cap sections 242 and 243 and the communication section 244 with the atmosphere via the connection ports 250 and 251 is blocked. In this state, the suction pump 233 is driven. As a result, the black ink in the inkjet head 203 is discharged from the nozzles 210*d* and 210*e*.

Figure 17C:
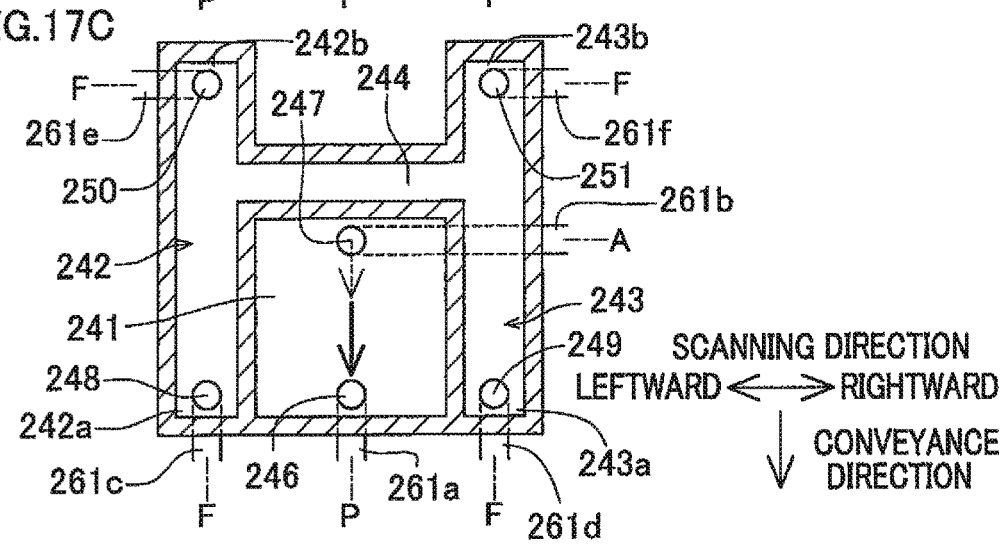
FIG. 17C is a plan view of the nozzle cap when idle suction after purging of color ink and idle suction after flushing is performed in Second Embodiment.

In addition to the above, in Second Embodiment, in the idle suction after purging of color ink in S103 and the idle suction after flushing of color ink in S107, the cap sections 242 and 243 and the communication section 244 are connected with the suction pump 233 via the connection port 246 as shown in FIG. 17C. Furthermore, via the connection port 247, the cap sections 242 and 243 and the communication section 244 are caused to communicate with the atmosphere. Furthermore, the connection of the cap sections 242 and 243 and the communication section 244 with the suction pump 233 via the connection ports 248 and 249 is blocked. Furthermore, the communication of the cap sections 242 and 243 and the communication section 244 with the atmosphere via the connection ports 250 and 251 is blocked. In this state, the suction pump 233 is driven. With this, the outside air is introduced from the connection port 247, and the color ink remaining in the cap section 241 due to suction purge or flushing is discharged from the connection port 246.

Figure 18A:
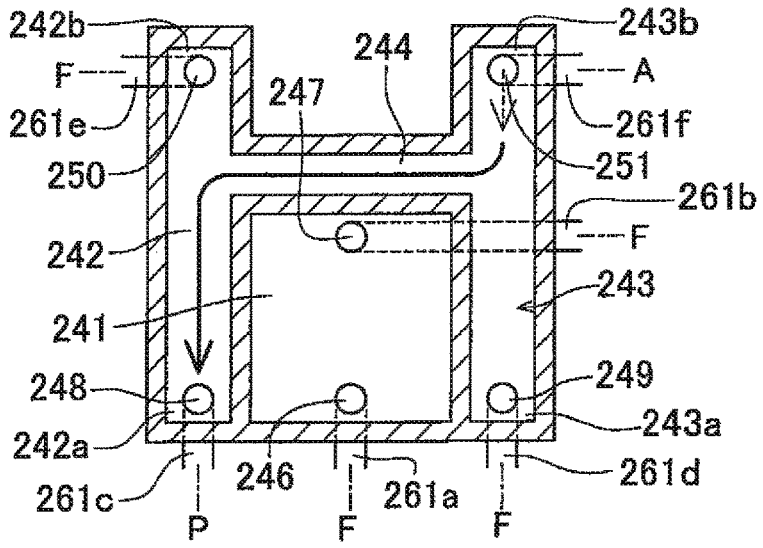
FIG. 18A is a plan view of the nozzle cap when idle suction after purging of black ink and idle suction after flushing is performed in Second Embodiment, and shows a state in first idle suction which is performed first.

In addition to the above, in Second Embodiment, in the idle suction after purging of black ink in S104 and the idle suction after flushing of black ink in S108, the connection of the cap section 241 with the suction pump 233 via the connection port 246 is blocked as shown in FIG. 18A. Furthermore, the communication of the cap section 241 with the atmosphere via the connection port 247 is blocked. Furthermore, the cap sections 242 and 243 and the communication section 244 are connected with the suction pump 233 via the connection port 248. Furthermore, the connection of the cap sections 242 and 243 and the communication section 244 with the suction pump 233 via the connection port 249 is blocked. Furthermore, the communication of the cap sections 242 and 243 and the communication section 244 with the atmosphere via the connection port 250 is blocked. Furthermore, via the connection port 251, the cap sections 242 and 243 and the communication section 244 are caused to communicate with the atmosphere. In this state, the suction pump 233 is driven. As a result, the outside air is introduced from the connection port 251, and among the black ink remaining in the cap sections 242 and 243 and the communication section 244, the ink remaining mainly in a part of the cap section 242 which part is on the downstream in the conveyance direction of the communication section 244, a part of the cap section 243 which part is on the upstream in the conveyance direction of the communication section 244, and the communication section 244 due to suction purge or flushing is discharged from the connection port 248.

Figure 18B:
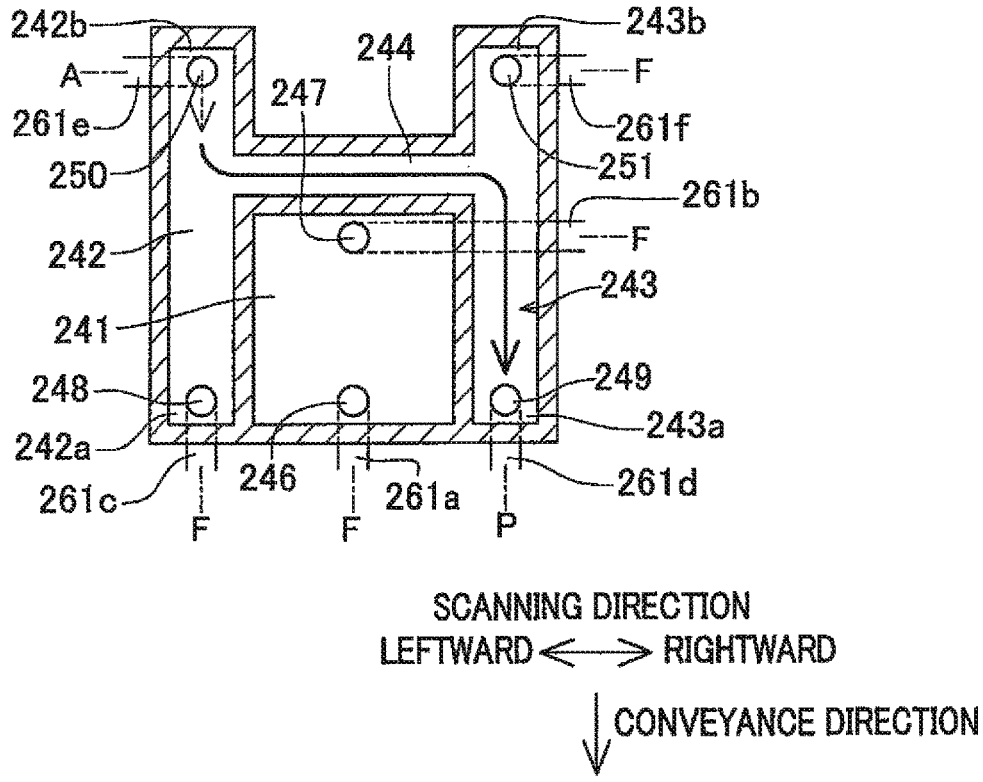
FIG. 18B is a plan view of the nozzle cap when idle suction after purging of black ink and idle suction after flushing is performed in Second Embodiment, and shows a state in second idle suction.

Subsequently, as shown in FIG. 18B, the connection of the cap sections 242 and 243 and the communication section 244 with the suction pump 233 via the connection port 248 is blocked. Furthermore, the cap sections 242 and 243 and the communication section 244 are connected with the suction pump 233 via the connection port 249. Furthermore, via the connection port 250, the cap sections 242 and 243 and the communication section 244 are caused to communicate with the atmosphere. Furthermore, the communication of the cap sections 242 and 243 and the communication section 244 with the atmosphere via the connection port 251 is blocked. The connection of the cap section 241 with the suction pump 233 via the connection port 246 is kept blocked. Furthermore, the communication of the cap section 241 with the atmosphere via the connection port 247 is kept blocked. In this state, the suction pump 233 is driven. With this, the outside air is introduced from the connection port 250, and among the black ink remaining in the cap sections 242 and 243 and the communication section 244, the ink remaining mainly in a part of the cap section 242 which part is on the upstream in the conveyance direction of the communication section 244, a part of the cap section 243 which part is on the downstream in the conveyance direction of the communication section 244, and the communication section 244 due to suction purge or flushing is discharged from the connection port 249.

In the operation shown in FIG. 18A, the flow of the ink is unlikely to occur at the part of the cap section 242 on the upstream in the conveyance direction of the communication section 244 and the part of the cap section 243 on the downstream in the conveyance direction of the communication section 244. The ink remaining in these parts may not therefore be sufficiently discharged. In the meanwhile, in the operation shown in FIG. 18B, the flow of the ink is unlikely to occur at the part of the cap section 242 on the downstream in the conveyance direction of the communication section 244 and the part of the cap section 243 on the upstream in the conveyance direction of the communication section 244. The ink remaining in these parts may not therefore be sufficiently discharged. For these reasons, when, being different from Second Embodiment, only one of the operations shown in FIG. 18A and FIG. 18B is executed in the idle suction of black ink, the ink remaining in the cap sections 242 and 243 and the communication section 244 may not be sufficiently discharged.

In this regard, in Second Embodiment, as described above, the operation shown in FIG. 18A and the operation shown in FIG. 18B are executed in order so as to discharge the black ink remaining in the cap sections 242 and 243 and the communication section 244. As such, the black ink remaining in the cap sections 242 and 243 and the communication section 244 is certainly discharged.

Now, modifications of First and Second Embodiments will be described. It is noted that, hereinafter, the explanations of the switching of the connection of the cap section 41 with the suction pump 33 and the communication of the cap section 41 with the atmosphere via the connection ports 46 and 47 and the switching of the connection of the cap section 241 with the suction pump 233 and the communication of the cap section 241 with the atmosphere via the connection ports 246 and 247 will be suitably omitted. Furthermore, although the connection port of the nozzle cap is connected with the switching unit by the tube also in the modifications below, the explanation of the tube will be suitably omitted.

Figure 19A:
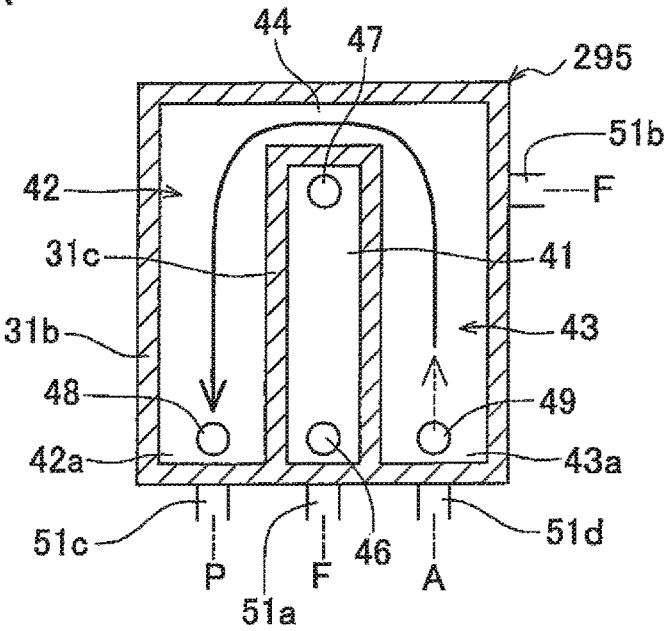
FIG. 19A is a plan view of the nozzle cap when idle suction after second purging is performed in a modification 1.
Figure 19B:
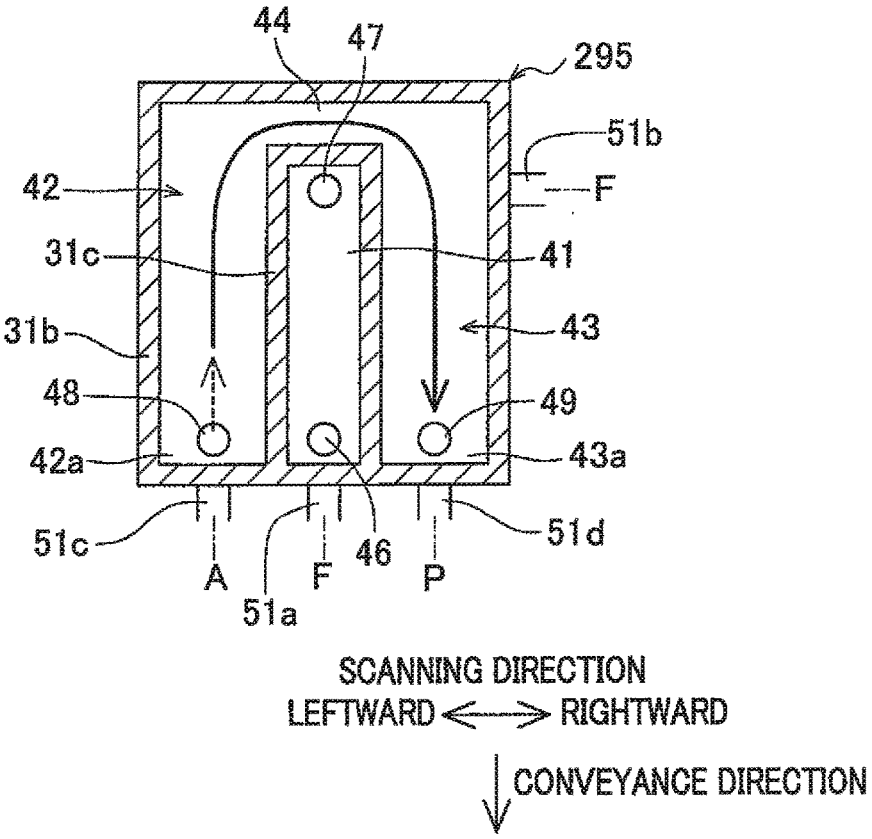
FIG. 19B is a plan view of the nozzle cap when idle suction after third purging is performed in the modification 1.

The idle suction after purging of color ink in the printer 1 including a nozzle cap such as the nozzle cap 31 may be executed in a manner different from that in First Embodiment. In a modification 1, as shown in FIGS. 19A and 19B, a nozzle cap 295 has a structure similar to that of the nozzle cap 31. In the idle suction after purging of color ink, to begin with, as shown in FIG. 19A, the cap sections 42 and 43 and the communication section 44 are connected with the suction pump 33 via the connection port 48. Furthermore, the cap sections 42 and 43 and the communication section 44 are caused to communicate with the atmosphere via the connection port 49. In this state, the suction pump 33 is driven. With this, the ink remaining in the cap sections 42 and 43 and the communication section 44 is discharged from the connection port 48 as the ink flows along a passage from the connection port 49 to the connection port 48 via the cap section 43, the communication section 44, and the cap section 42 in order.

Subsequently, as shown in FIG. 19B, the cap sections 42 and 43 and the communication section 44 are caused to communicate with the atmosphere via the connection port 48. Furthermore, the cap sections 42 and 43 and the communication section 44 are connected to the suction pump via the connection port 49. In this state, the suction pump 33 is driven. With this, the ink remaining in the cap sections 42 and 43 and the communication section 44 flows along a passage from the connection port 48 to the connection port 49 via the cap section 42, the communication section 44, and the cap section 43 in order, with the result that the ink is discharged from the connection port 49 (third idle suction after purging of the present invention).

In regard to the above, in the operations shown in FIGS. 19A and 19B, there may be parts of the cap sections 42 and 43 and the communication section 44 where the ink is unlikely to flow. In this regard, because the direction of the ink flow in the operation shown in FIG. 19A is opposite to the direction of the ink flow in the operation shown in FIG. 19B, these operations are typically different from each other in the parts of the cap sections 42 and 43 and the communication section 44 where the ink is unlikely to flow. Therefore, as the two operations shown in FIGS. 19A and 19B are executed in order as in the modification 1, the ink remaining in the cap sections 242 and 243 and the communication section 244 is certainly discharged as compared to the case where only one of the two operations is performed.

Figures 20A, 20B:
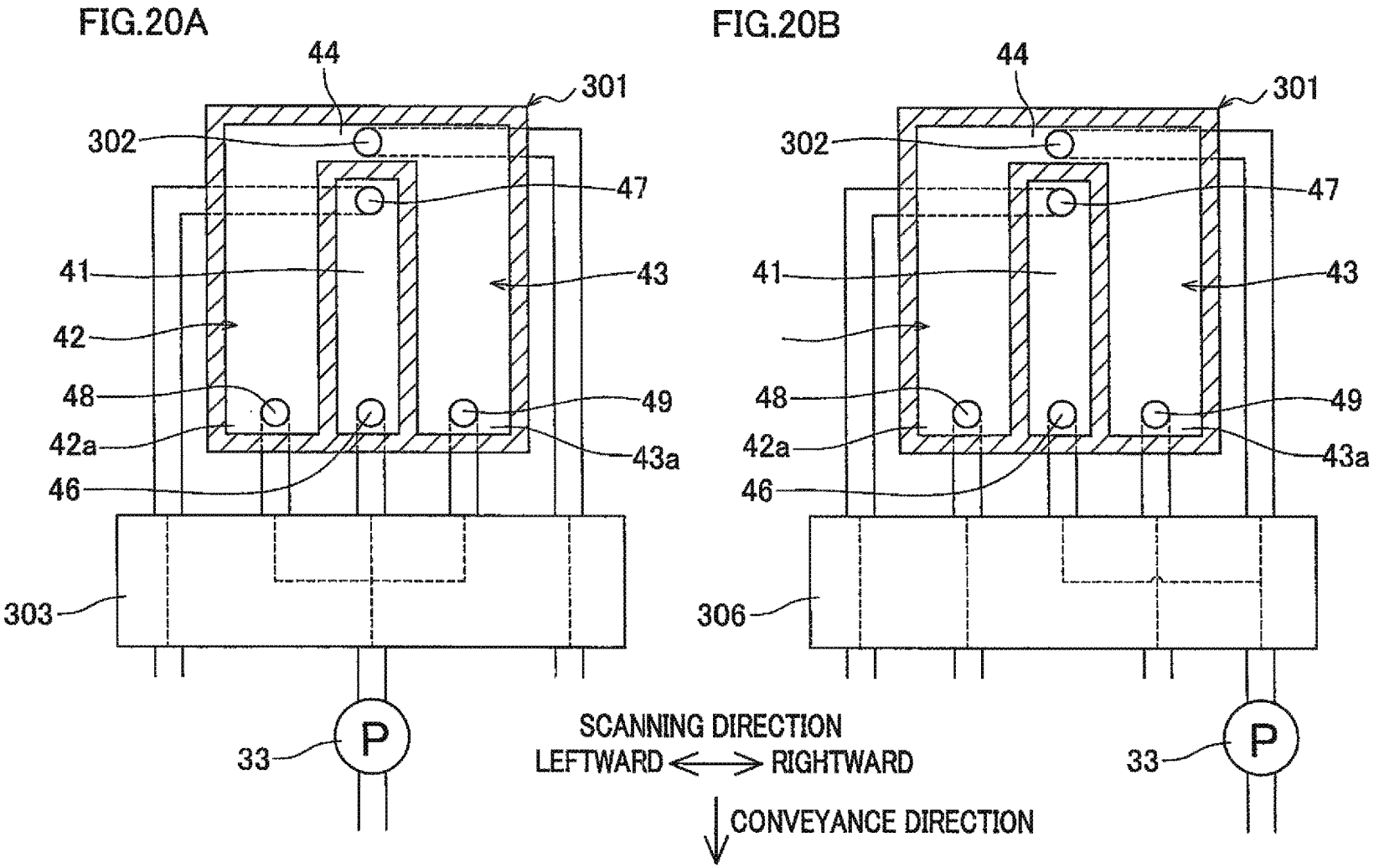
FIG. 20A shows the relationship in switching between the connection of a connection port of a nozzle cap with a suction pump and the atmosphere communication in a modification 2.
FIG. 20B relates to a modification 3 and is equivalent to FIG. 20A.

In addition to the above, while in First Embodiment the cap sections 42 and 43 and communication section 44 is connected with the suction pump 33 via one of the connection ports 48 and 49, the cap sections 42 and 43 and communication section 44 is caused to communicate with the atmosphere via the other one of the connection ports, and the suction pump 33 is driven in this state in the idle suction after purging of color ink and the idle suction after flushing, the disclosure is not limited to this arrangement. In a modification 2, as shown in FIG. 20A, a nozzle cap 301 is basically identical with the nozzle cap 31 but additionally includes a connection port 302 provided in the communication section 44. Furthermore, a switching unit 303 (equivalent to a fifth switching device of the present invention) switches between the connection and the disconnection of the cap sections 42 and 43 and the communication section 44 with the suction pump 33 via the connection port 48. Furthermore, the switching unit 303 switches between the connection and the disconnection of the cap sections 42 and 43 and the communication section 44 with the suction pump 33 via the connection port 49. Furthermore, the switching unit 303 switches between the communication and the non-communication of the cap sections 42 and 43 and the communication section 44 with the atmosphere via the connection port 302.

In the modification 2, in the suction purge of color ink, the cap sections 42 and 43 and the communication section 44 are connected with the suction pump 33 via the connection ports 48 and 49. Furthermore, the communication of the cap sections 42 and 43 and the communication section 44 with the atmosphere via the connection port 302 is blocked. In this state, the suction pump 33 is driven.

In the modification 2, furthermore, in the idle suction after purging and the idle suction after flushing, to begin with, the cap sections 42 and 43 and the communication section 44 are connected with the suction pump 33 via the connection port 48. Furthermore, the connection of the cap sections 42 and 43 and the communication section 44 with the suction pump 33 via the connection port 49 is blocked. Furthermore, the cap sections 42 and 43 and the communication section 44 are caused to communicate with the atmosphere via the connection port 302. In this state, the suction pump 33 is driven. With this, the ink remaining mainly in the cap section 42 and a part of the communication section 44 which part is on the cap section 42 side of the connection port 302 is discharged. Subsequently, the connection of the cap sections 42 and 43 and the communication section 44 with the suction pump 33 via the connection port 48 is blocked. Furthermore, the cap sections 42 and 43 and the communication section 44 are connected to the suction pump 33 via the connection port 49. Furthermore, the cap sections 42 and 43 and the communication section 44 are caused to communicate with the atmosphere via the connection port 302. In this state, the suction pump 33 is driven. With this, the ink remaining mainly in the cap section 43 and a part of the communication section 44 which part is on the cap section 43 side of the connection port 302 is discharged.

In the modification 2, as the above-described two operations are executed in order, the ink remaining in the cap sections 42 and 43 and the communication section 44 is certainly discharged. Furthermore, in the modification 2, while the connection ports 48 and 49 are provided at the downstream end portions 42*a* and 43*a* in the conveyance direction of the cap sections 42 and 43, the connection port 302 is provided at the communication section 44 which is a midpoint of the passage connecting the connection port 48 with the connection port 49 in the nozzle cap 301. For this reason, the ink remaining in the cap sections 42 and 43 and the communication section 44 as above is efficiently discharged.

In a modification 3, as shown in FIG. 20B, the switching unit 303 of the modification 2 is replaced with a switching unit 306 (equivalent to a fourth switching device of the present invention). The switching unit 306 switches between the communication and the non-communication of the cap sections 42 and 43 and the communication section 44 with the atmosphere via the connection port 48. Furthermore, the switching unit 306 switches between the communication and the non-communication of the cap sections 42 and 43 and the communication section 44 with the atmosphere via the connection port 49. Furthermore, the switching unit 306 switches between the connection and the disconnection of the cap sections 42 and 43 and the communication section 44 with the suction pump 33 via the connection port 302.

In the modification 3, in the suction purge of color ink, the connection of the cap sections 42 and 43 and the communication section 44 with the atmosphere via the connection ports 48 and 49 is blocked. Furthermore, the cap sections 42 and 43 and the communication section 44 are connected with the suction pump 33 via the connection port 302. In this state, the suction pump 33 is driven.

In addition to the above, in the modification 3, in the idle suction after purging of color ink and the idle suction after flushing, to begin with, the cap sections 42 and 43 and the communication section 44 are caused to communicate with the atmosphere via the connection port 48. Furthermore, the communication of the cap sections 42 and 43 and the communication section 44 with the atmosphere via the connection port 49 is blocked. Furthermore, the cap sections 42 and 43 and the communication section 44 are connected with the suction pump 33 via the connection port 302. In this state, the suction pump 33 is driven. Subsequently, the communication of the cap sections 42 and 43 and the communication section 44 with the atmosphere via the connection port 48 is blocked, the cap sections 42 and 43 and the communication section 44 are caused to communicate with the atmosphere via the connection port 49, and the cap sections 42 and 43 and the communication section 44 are connected to the suction pump 33 via the connection port 302. In this state, the suction pump 33 is driven.

Figure 21:
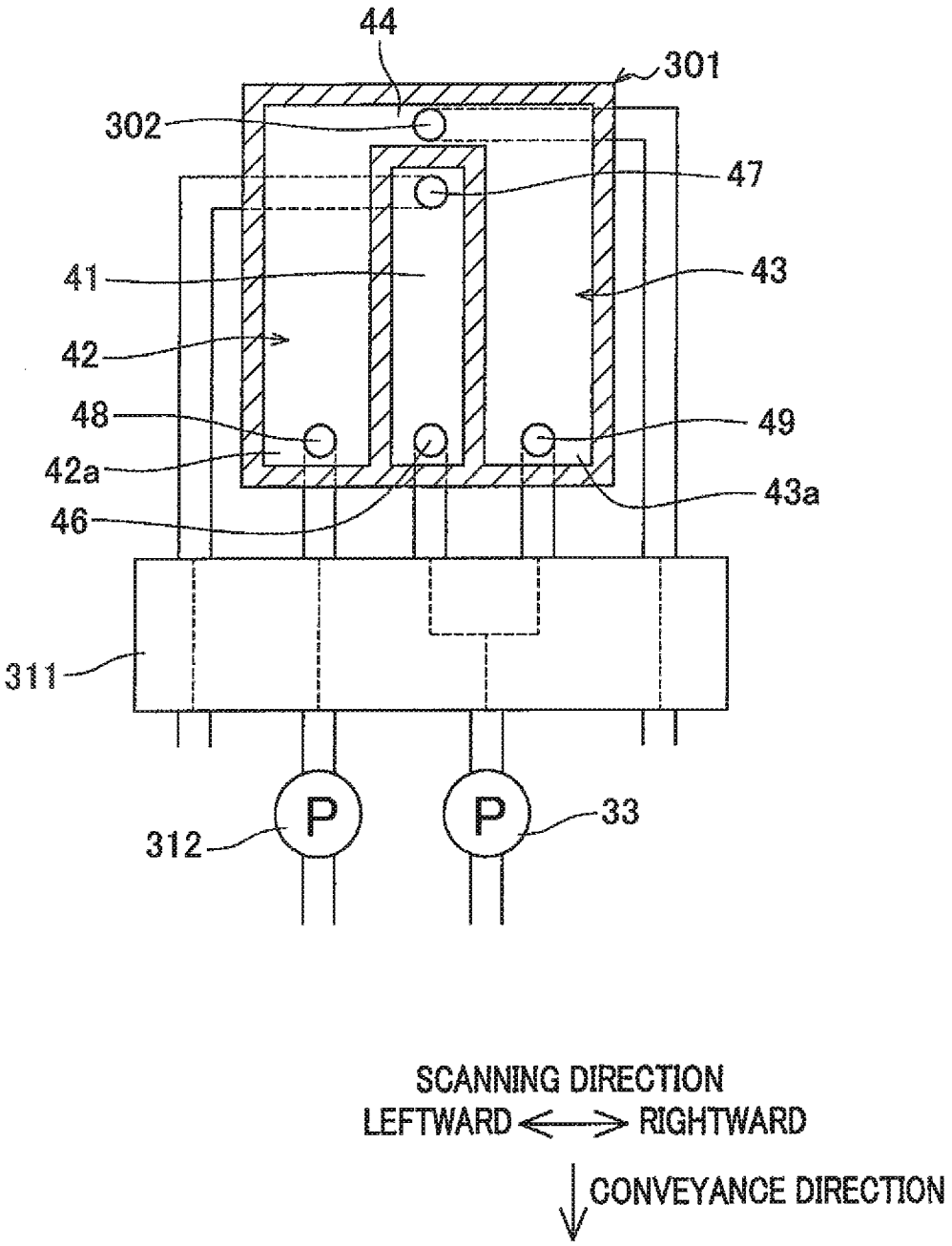
FIG. 21 relates to a modification 4 and is equivalent to FIG. 20A.

A modification 4 is, as shown in FIG. 21, identical with the modification 2 above except that the switching unit 303 is replaced with a switching unit 311. The switching unit 311 switches between the connection and the disconnection of the cap sections 42 and 43 and the communication section 44 with the suction pump 33 via the connection port 49. Furthermore, the switching unit 311 switches between the connection and the disconnection of the cap sections 42 and 43 and the communication section 44 with a suction pump 312 which is different from the suction pump 33 via the connection port 48. Furthermore, the switching unit 311 switches between the communication and the non-communication of the cap sections 242 and 243 and the communication section 244 with the atmosphere via the connection port 302.

In the modification 4, in the suction purge of color ink, the cap sections 42 and 43 and the communication section 44 are connected with the suction pump 312 via the connection port 48. Furthermore, the cap sections 42 and 43 and the communication section 44 and connected with the suction pump 33 via the connection port 49. Furthermore, the communication of the cap sections 42 and 43 and the communication section 44 with the atmosphere via the connection port 302 is blocked. In this state, the suction pumps 33 and 312 are driven.

In addition to the above, in the modification 4, in the idle suction after purging of color ink and the idle suction after flushing, the cap sections 42 and 43 and the communication section 44 are connected with the suction pump 312 via the connection port 48. Furthermore, the cap sections 42 and 43 and the communication section 44 are connected with the suction pump 33 via the connection port 49. Furthermore, the cap sections 42 and 43 and the communication section 44 are caused to communicate with the atmosphere via the connection port 302. In this state, the suction pumps 33 and 312 are driven.

At this stage, in the modification 4, the cap sections 42 and 43 and the communication section 44 are connected with the different suction pumps 33 and 312 via the connection port 48 and the connection port 49. For this reason, even if one of the connection ports 48 and 49 is connected with the connection port 302 by the air while the ink remains in the cap sections 42 and 43 and the communication section 44, the color ink remaining in the cap sections 42 and 43 and the communication section 44 is discharged from the other connection port. As such, the color ink remaining in the cap sections 42 and 43 and the communication section 44 is certainly discharged.

While in the modifications 2 to 4 the connection port 302 is provided in the communication section 44, this arrangement may not be employed. For example, a connection port which is able to cause the cap sections 42 and 43 and the communication section 44 to communicate with the atmosphere may be formed at another part of the passage connecting the connection port 48 with the connection port 49, e.g., at the cap sections 42 and 43.

Figure 22:
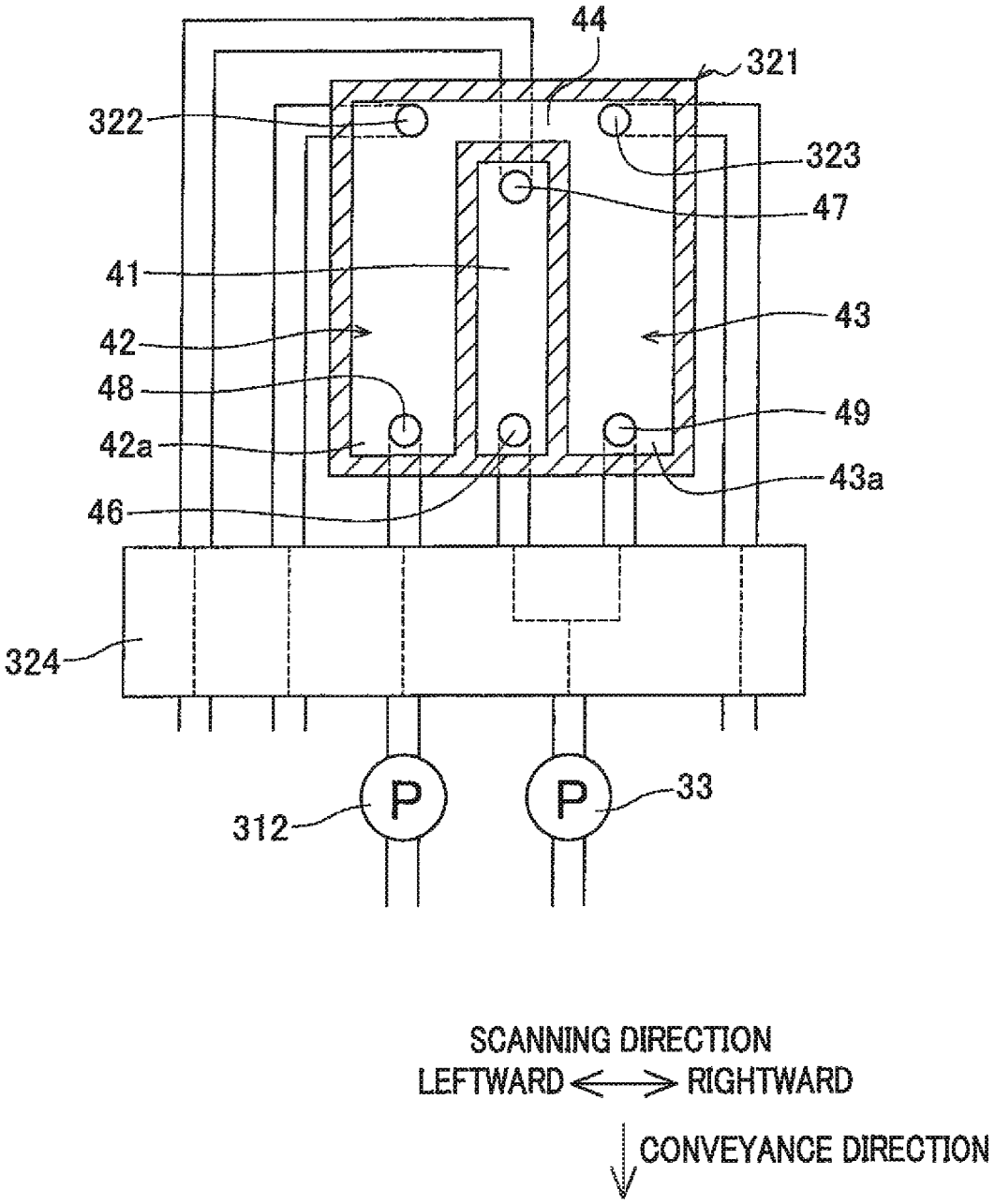
FIG. 22 relates to a modification 5 and is equivalent to FIG. 20A.

In this case, the number of the connection port capable of communicating with the atmosphere, which is provided at a part different from the downstream end portions 42*a* and 43*a* in the conveyance direction of the cap sections 42 and 43, is not limited to one. For example, in a modification 5, as shown in FIG. 22, a nozzle cap 321 is provided in place of the nozzle cap 301 of the modification 4. This nozzle cap 321 is identical with the nozzle cap 301 except that two connection ports 322 and 323 are provided in place of the connection port 302. The connection ports 322 and 323 are provided at the upstream end portions in the conveyance direction of the cap sections 42 and 43. The switching unit 324 switches between the connection and the disconnection of the cap sections 42 and 43 and the communication section 44 with the suction pump 33 via the connection port 49. Furthermore, the switching unit 324 switches between the connection and the disconnection of the cap sections 42 and 43 and the communication section 44 with the suction pump 312 via the connection port 48. Furthermore, the switching unit 324 switches between the communication and the non-communication of the cap sections 42 and 43 and the communication section 44 with the atmosphere via the connection ports 322 and 323.

In the modification 5, in the suction purge of color ink, the cap sections 42 and 43 and the communication section 44 are connected with the suction pump 312 via the connection port 48. Furthermore, the cap sections 42 and 43 and the communication section 44 are connected with the suction pump 33 via the connection port 49. Furthermore, the communication of the cap sections 42 and 43 and the communication section 44 with the atmosphere via the connection ports 322 and 323 is blocked. In this state, the suction pumps 33 and 312 are driven.

In addition to the above, in the modification 5, in the idle suction after purging of color ink and the idle suction after flushing, the cap sections 42 and 43 and the communication section 44 is connected with the suction pump 312 via the connection port 48. Furthermore, the cap sections 42 and 43 and the communication section 44 are connected with the suction pump 33 via the connection port 49. Furthermore, the cap sections 42 and 43 and the communication section 44 are caused to communicate with the atmosphere via the connection ports 322 and 323. In this state, the suction pumps 33 and 312 are driven.

At this stage, in the modification 5, the connection port 48 and the connection port 49 are connected with the different suction pumps 33 and 312. For this reason, even if one of the connection ports 48 and 49 is connected with one of the connection ports 322 and 323 by the air while the ink remains in the cap sections 42 and 43 and the communication section 44, the color ink remaining in the cap sections 42 and 43 and the communication section 44 is discharged from the other connection port. As such, the color ink remaining in the cap sections 42 and 43 and the communication section 44 is certainly discharged.

Figure 23:
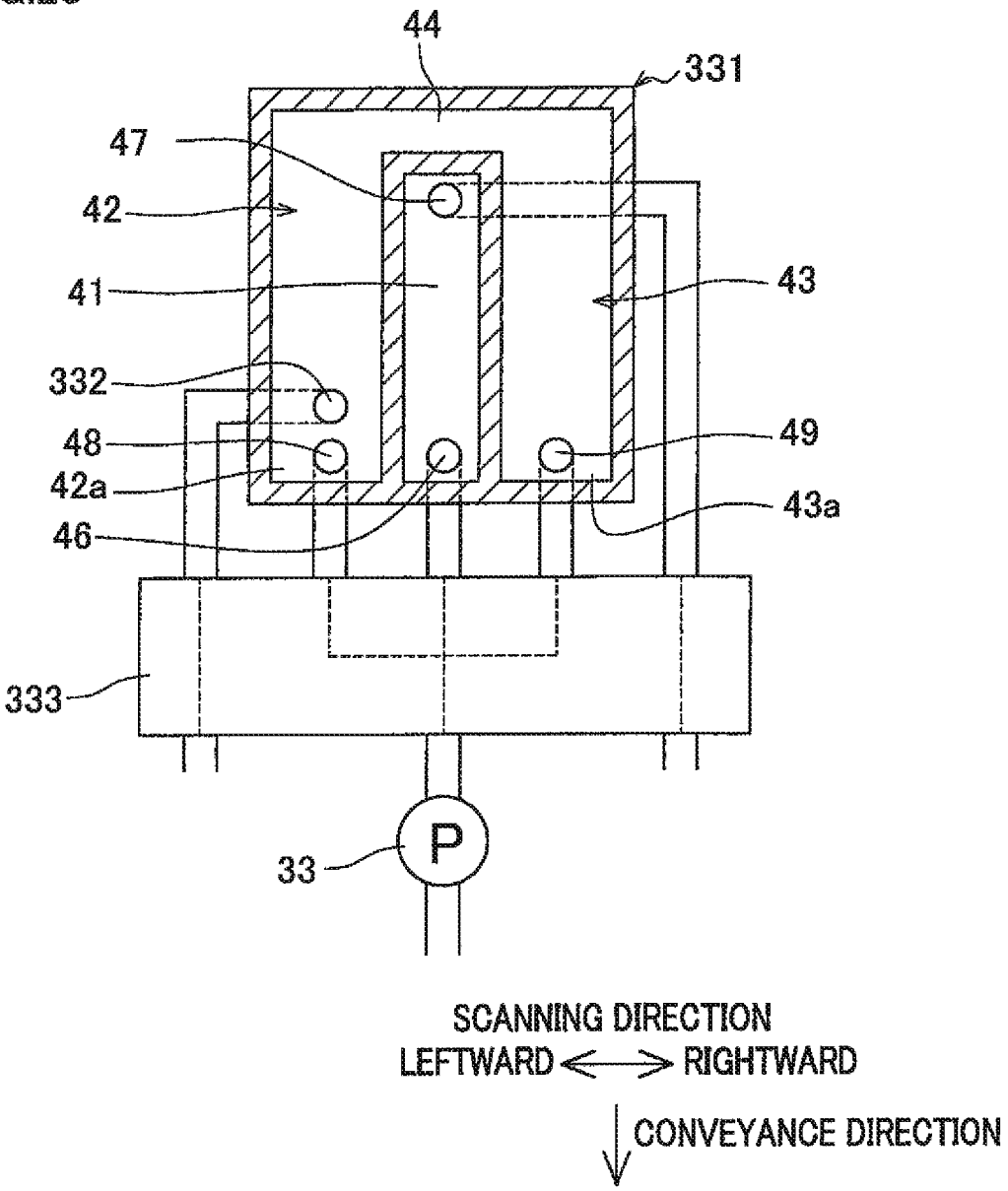
FIG. 23 relates to a modification 6 and is equivalent to FIG. 20A.

In addition to the above, while in First Embodiment, by the switching unit 32, the state in which the cap sections 42 and 43 and the communication section 44 are connected with the suction pump 33 via the connection port 48, the state in which the cap sections 42 and 43 and the communication section 44 are communicated with the atmosphere, and the state in which the connection of the nozzle cap section 31 with the suction pump 33 and the communication of the nozzle cap section 31 with the atmosphere are blocked are switchable, the disclosure is not limited to this arrangement. In a modification 6, as shown in FIG. 23, a nozzle cap 331 is identical with the nozzle cap 31 except that a connection port 332 which is different from the connection port 48 is additionally provided at the downstream end portion 42*a* in the conveyance direction of the cap section 42. Furthermore, a switching unit 333 switches between the connection and the disconnection of the cap sections 42 and 43 and the communication section 44 with the suction pump 33 via the connection ports 48 and 49. Furthermore, the switching unit 333 switches between the communication and the non-communication of the cap sections 42 and 43 and the communication section 44 with the atmosphere via the connection port 332.

In the modification 6, in the suction purge of color ink, the cap sections 42 and 43 and the communication section 44 are connected with the suction pump 33 via the connection ports 48 and 49. Furthermore, the communication of the cap sections 42 and 43 and the communication section 44 with the atmosphere via the connection port 332 is blocked. In this state, the suction pump 33 is driven.

In addition to the above, in the modification 6, in the idle suction after purging of color ink and the idle suction after flushing, the connection of the cap sections 42 and 43 and the communication section 44 with the suction pump 33 via the connection port 48 is blocked. Furthermore, the cap sections 42 and 43 and the communication section 44 are connected with the suction pump 33 via the connection port 49. Furthermore, the cap sections 42 and 43 and the communication section 44 are caused to communicate with the atmosphere via the connection port 332. In this state, the suction pump 33 is driven.

Figure 24:
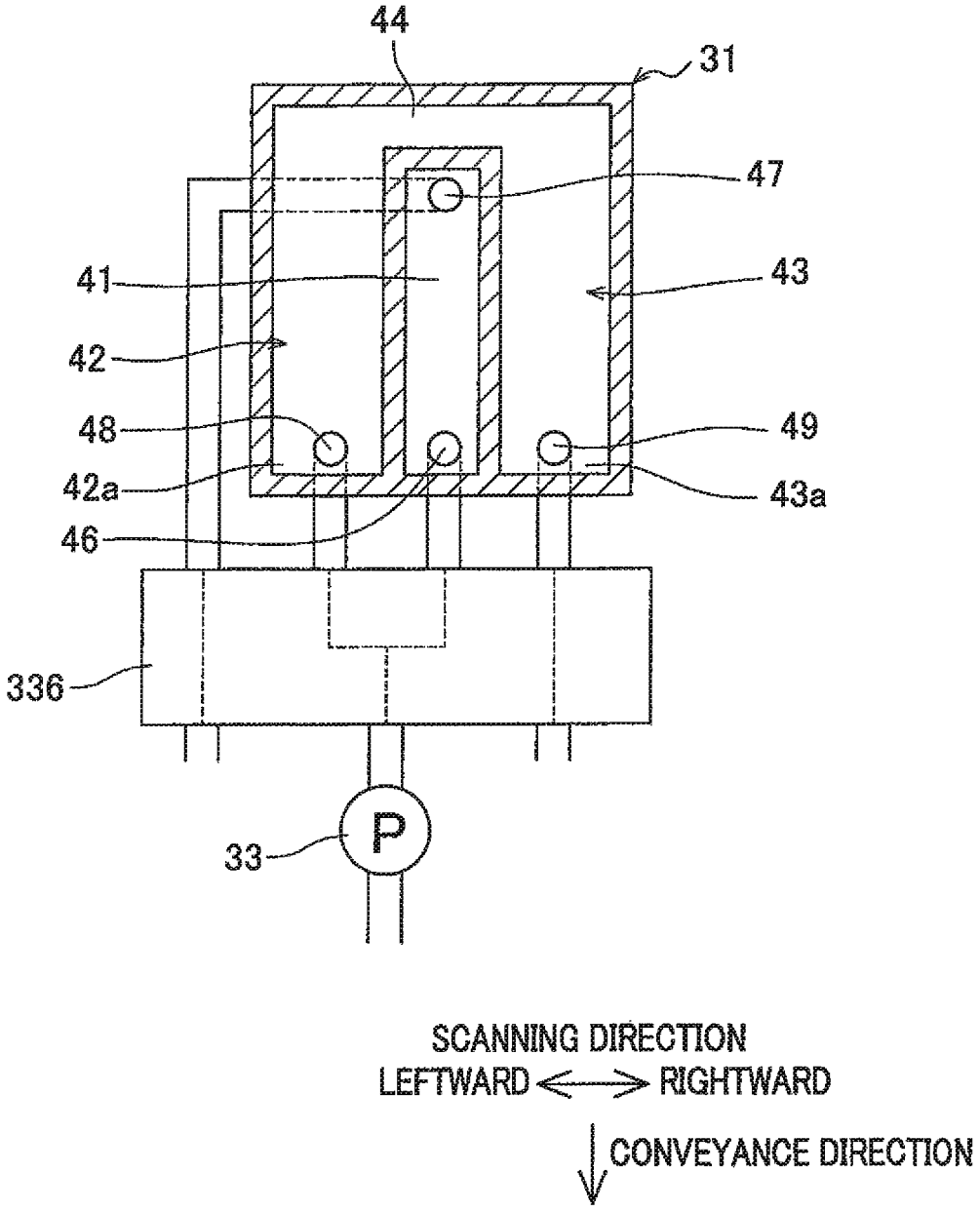
FIG. 24 relates to a modification 7 and is equivalent to FIG. 20A.

While in First Embodiment the cap sections 42 and 43 and the communication section 44 are connected with the suction pump 33 via both of the connection ports 48 and 49 in the suction purge of color ink, the disclosure is not limited to this arrangement. In a modification 7, as shown in FIG. 24, a switching unit 336 (equivalent to the first switching device of the present invention) switches between the connection and the disconnection of the cap sections 42 and 43 and the communication section 44 with the suction pump 33 via the connection port 48. Furthermore, the switching unit 336 switches between the communication and the non-communication of the cap sections 42 and 43 and the communication section 44 with the atmosphere via the suction port 49.

In this case, in the suction purge of color ink (equivalent to the first suction purge in the present invention), the cap sections 42 and 43 and the communication section 44 are connected with the suction pump 33 via the connection port 48. Furthermore, the communication of the cap sections 42 and 43 and the communication section 44 with the atmosphere via the connection port 49 is blocked. In this state, the suction pump 33 is driven. Also in this case, because the cap section 42 communicates with the cap section 43 via the communication section 44, the color ink remaining in the cap sections 42 and 43 and the communication section 44 is discharged.

Furthermore, in the case above, the cap sections 42 and 43 and the communication section 44 are connected with the suction pump 33 via the connection port 48, in the idle suction after purging of color ink (equivalent to the first idle suction after purging in the present invention) and the idle suction after flushing. Furthermore, the cap sections 42 and 43 and the communication section 44 are caused to communicate with the atmosphere via the connection port 49. In this state, the suction pump 33 is driven.

It is noted that, even if the cap sections 42 and 43 and the communication section 44 can be connected with the suction pump 33 via the connection port 48 as in First Embodiment, the suction purge of color ink may be executed in the same manner as in the modification 7. Alternatively, on the contrary to the modification 7, the cap sections 42 and 43 and the communication section 44 may be connected with the suction pump 33 via the connection port 49 and the communication of the cap sections 42 and 43 and the communication section 44 with the atmosphere via the connection port 48 may be blocked, in the suction purge of color ink.

Figure 25:
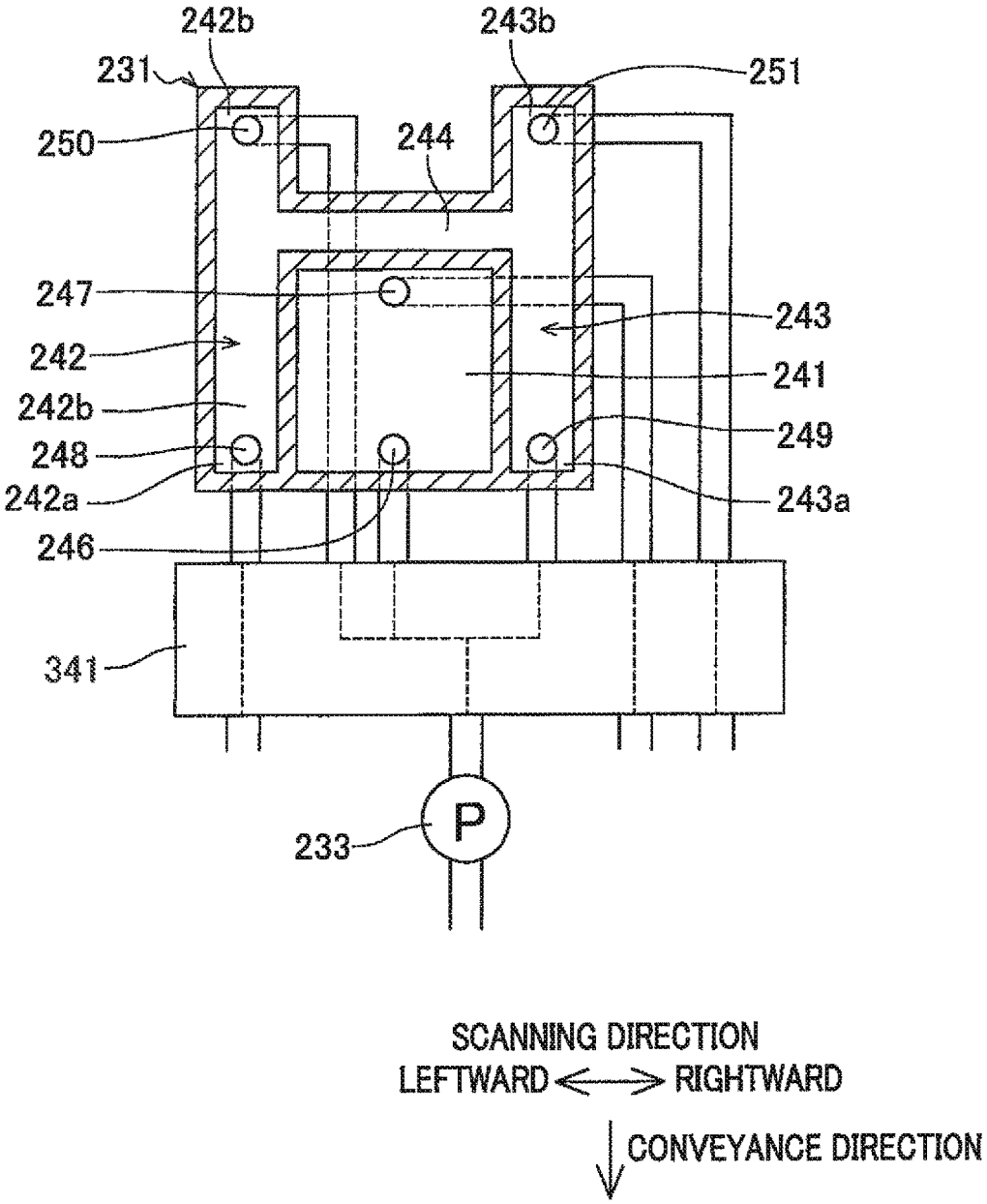
FIG. 25 relates to a modification 8 and is equivalent to FIG. 20A.

In Second Embodiment, the switching unit 232 switches between the connection and the disconnection of the cap sections 242 and 243 and the communication section 244 with the suction pump 233 via the connection ports 248 and 249 and switches between the communication and the non-communication of the cap sections 242 and 243 and the communication section 244 with the atmosphere via the connection ports 250 and 251. The disclosure, however, is not limited to this arrangement. In a modification 8, as shown in FIG. 25, a switching unit 341 switches between the connection and the disconnection of the cap sections 242 and 243 and communication section 244 with the suction pump 233 via connection ports 249 and 250. Furthermore, the switching unit 341 switches between the communication and the non-communication of the cap sections 242 and 243 and the communication section 244 with the atmosphere via connection ports 248 and 251.

In the modification 8, in the suction purge of black ink, the cap sections 242 and 243 and the communication section 244 are connected with the suction pump 233 via the connection ports 249 and 250. Furthermore, the communication of the cap sections 242 and 243 and the communication section 244 with the atmosphere via the connection ports 248 and 251 is blocked. In this state, the suction pump 233 is driven.

Furthermore, in the modification 8, in the idle suction after purging of black ink, to begin with, the cap sections 242 and 243 and the communication section 244 are connected with the suction pump 233 via the connection port 249. Furthermore, the connection of the cap sections 242 and 243 and the communication section 244 with the suction pump 233 via the connection port 250 is blocked. Furthermore, the cap sections 242 and 243 and the communication section 244 are caused to communicate with the atmosphere via the connection port 248. Furthermore, the communication of the cap sections 242 and 243 and the communication section 244 with the atmosphere via the connection port 251 is blocked. In this state, the suction pump 233 is driven. As a result, the ink remaining mainly in parts of the cap sections 242 and 243 which parts are on the downstream in the conveyance direction of the communication section 244 and in the communication section 244 is discharged.

Subsequently, the connection of the cap sections 242 and 243 and the communication section 244 with the suction pump 233 via the connection port 249 is blocked. Furthermore, the cap sections 242 and 243 and the communication section 244 are connected with the suction pump 233 via the connection port 250. Furthermore, the communication of the cap sections 242 and 243 and the communication section 244 with the atmosphere via the connection port 248 is blocked. Furthermore, the cap sections 242 and 243 and the communication section 244 are caused to communicate with the atmosphere via the connection port 251. In this state, the suction pump 233 is driven. With this, the ink remaining mainly in parts of the cap sections 242 and 243 which parts are on the upstream in the conveyance direction of the communication section 244 and in the communication section 244 is discharged.

In the modification 8, these two operations are executed in order, and hence the ink remaining in the cap sections 242 and 243 and the communication section 244 is certainly discharged. These two operations may be executed in the reverse order.

In addition to the above, the switching unit may switch between the connection and the disconnection of the cap sections 242 and 243 and communication section 244 with the suction pump 33 via two connection ports different from those in Second Embodiment and the modification 8, and switch between the communication and the non-communication of the cap sections 242 and 243 and communication section 244 with the atmosphere via the remaining two connection ports, among the four connection ports 248 to 251.

In addition to the above, the switching unit is not limited to the switching between the connection and the disconnection of the cap sections 242 and 243 and communication section 244 with the suction pump 33 via two connection ports and the switching between the communication and the non-communication of the cap sections 242 and 243 and communication section 244 with the atmosphere via the remaining two connection ports, among the four connection ports 248 to 251.

Figure 26:
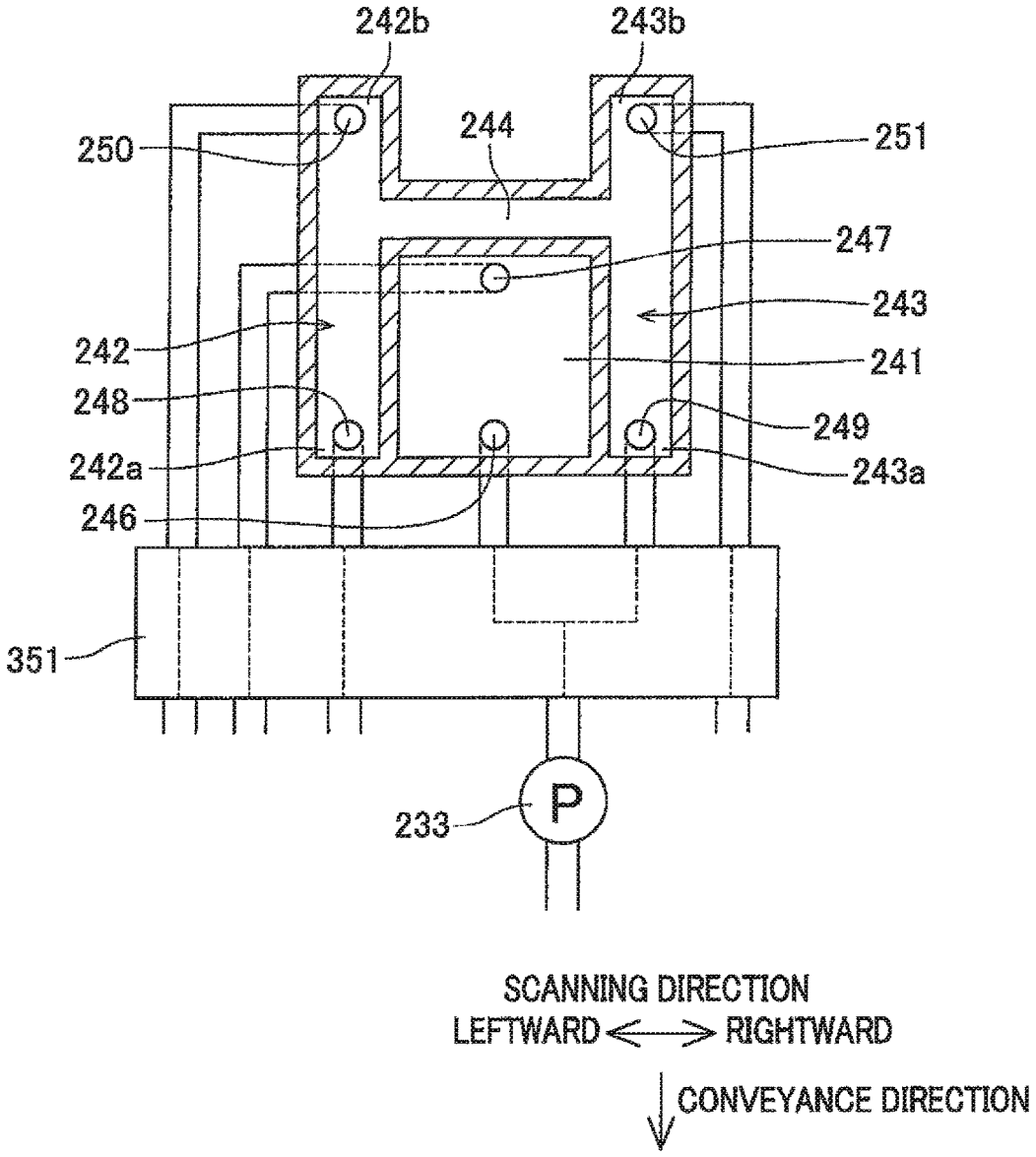
FIG. 26 relates to a modification 9 and is equivalent to FIG. 20A.

In a modification 9, as shown in FIG. 26, a switching unit 351 switches between the connection and the disconnection of the cap sections 242 and 243 and the communication section 244 with the suction pump 233 via the connection port 249. Furthermore, the switching unit 351 switches the communication and the non-communication of the cap sections 242 and 243 and communication section 244 with the atmosphere via the connection ports 248, 250, and 251.

In the modification 9, in the suction purge of black ink, the cap sections 242 and 243 and the communication section 244 are connected with the suction pump 233 via the connection port 249. Furthermore, the communication of the cap sections 242 and 243 and the communication section 244 with the atmosphere via the connection ports 248, 250, and 251 is blocked. In this state, the suction pump 233 is driven.

Furthermore, in the modification 9, in the idle suction after purging, to begin with, the cap sections 242 and 243 and the communication section 244 are connected with the suction pump 233 via the connection port 249. Furthermore, the cap sections 242 and 243 and the communication section 244 are caused to communicate with the atmosphere via the connection port 248. Furthermore, the communication of the cap sections 242 and 243 and the communication section 244 with the atmosphere via the connection ports 250 and 251 is blocked. In this state, the suction pump 233 is driven. With this, the black ink remaining mainly in parts of the cap sections 242 and 243 which parts are on the downstream in the conveyance direction of the communication section 244 and in the communication section 244 is discharged.

Subsequently, while the cap sections 242 and 243 and the communication section 244 are kept connected with the suction pump 233 via the connection port 249, the cap sections 242 and 243 and the communication section 244 are caused to communicate with the atmosphere via the connection port 250. Furthermore, the communication of the cap sections 242 and 243 and the communication section 244 with the atmosphere via the connection ports 249 and 251 is blocked. In this state, the suction pump 233 is driven. With this, the black ink remaining mainly in a part of the cap section 242 which part is on the upstream in the conveyance direction of the communication section 244, in a part of the cap section 243 which part is on the downstream in the conveyance direction of the communication section 244, and in the communication section 244 is discharged.

Subsequently, while the cap sections 242 and 243 and the communication section 244 are kept connected with the suction pump 233 via the connection port 249, the cap sections 242 and 243 and the communication section 244 are caused to communicate with the atmosphere via the connection port 251. Furthermore, the communication of the cap sections 242 and 243 and the communication section 244 with the atmosphere via the connection ports 248 and 250 is blocked. In this state, the suction pump 233 is driven. With this, the black ink remaining mainly in the cap section 243 is discharged.

In the modification 9, the above-described three operations are executed in order, and hence the ink remaining in the cap sections 242 and 243 and the communication section 244 is certainly discharged. These three operations may be executed in an order different from the above.

Figure 27:
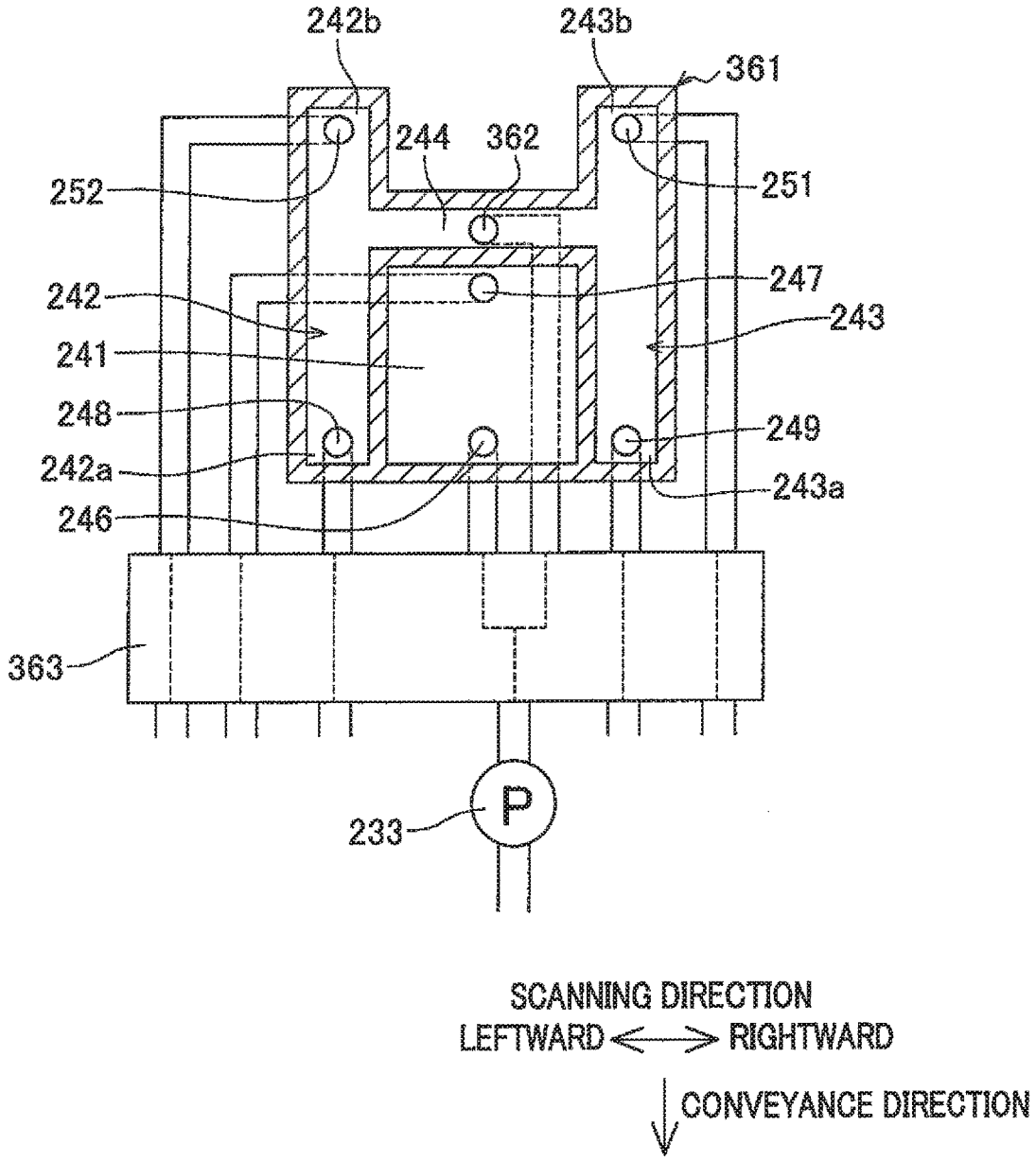
FIG. 27 relates to a modification 10 and is equivalent to FIG. 20A.

In a modification 10, as shown in FIG. 27, a nozzle cap 361 is identical with the nozzle cap 231 except that a connection port 362 is provided in the communication section 244. Furthermore, a switching unit 363 switches between the connection and the disconnection of the cap sections 242 and 243 and the communication section 244 with the suction pump 233 via a connection port 362. Furthermore, the switching unit 363 switches between the communication and the non-communication of the cap sections 242 and 243 and the communication section 244 with the atmosphere via the connection ports 248 to 251.

In the modification 10, in the suction purge of black ink, the cap sections 242 and 243 and the communication section 244 are connected with the suction pump 233 via the connection port 362. Furthermore, the communication of the cap sections 242 and 243 and the communication section 244 with the atmosphere via the connection ports 248 to 251 is blocked. In this state, the suction pump 233 is driven.

In addition to the above, in the modification 10, in the idle suction after purging of black ink, to begin with, the cap sections 242 and 243 and the communication section 244 are connected with the suction pump 233 via the connection port 362. Furthermore, the cap sections 242 and 243 and the communication section 244 are caused to communicate with the atmosphere via the connection port 248. Furthermore, the communication of the cap sections 242 and 243 and the communication section 244 with the atmosphere via the connection ports 249 to 251 is blocked. In this state, the suction pump 233 is driven. With this, the black ink remaining mainly in a part of the cap section 242 which part is on the downstream in the conveyance direction of the communication section 244 and in a part of the communication section 244 which part is to the left of the connection port 362 is discharged.

Subsequently, while the cap sections 242 and 243 and the communication section 244 are kept connected with the suction pump 233 via the connection port 362, the cap sections 242 and 243 and the communication section 244 are caused to communicate with the atmosphere via the connection port 249. Furthermore, the communication of the cap sections 242 and 243 and the communication section 244 with the atmosphere via the connection ports 248, 250, and 251 is blocked. In this state, the suction pump 233 is driven. With this, the black ink remaining a part of the cap section 243 which part is on the downstream in the conveyance direction of the communication section 244 and in a part of the communication section 244 which part is to the right of the connection port 362 is discharged.

Subsequently, while the cap sections 242 and 243 and the communication section 244 are kept connected with the suction pump 233 via the connection port 362, the cap sections 242 and 243 and the communication section 244 are caused to communicate with the atmosphere via the connection port 250. Furthermore, the communication of the cap sections 242 and 243 and the communication section 244 with the atmosphere via the connection ports 248 and 249, 251 is blocked. In this state, the suction pump 233 is driven. With this, the black ink remaining mainly in a part of the cap section 242 which part is on the upstream in the conveyance direction of the communication section 244 and in a part of the communication section 244 which part is to the left of the connection port 362 is discharged.

Subsequently, while the cap sections 242 and 243 and the communication section 244 are kept connected with the suction pump 233 via the connection port 362, the cap sections 242 and 243 and the communication section 244 are caused to communicate with the atmosphere via the connection port 251. Furthermore, the communication of the cap sections 242 and 243 and the communication section 244 with the atmosphere via the connection ports 248 to 250 is blocked. In this state, the suction pump 233 is driven. With this, the black ink remaining mainly in a part of the cap section 243 which part is on the upstream in the conveyance direction of the communication section 244 and a part of the communication section 244 which part is to the right of the connection port 362 is discharged.

In the modification 10, as these four operations are executed in order, the black ink remaining in the cap sections 242 and 243 and the communication section 244 is certainly discharged. These four operations may be executed in an order different from the above.

While in First Embodiment the ink discharged from the connection port 48 is arranged to remain in the tube 51*c* in the idle suction after purging of color ink and the ink arranged to remain in the tube 51*c* is supplied to the cap section 42 in the idle suction after flushing of color ink, the disclosure is not limited to this arrangement. In the idle suction after purging of color ink, all of the ink discharged from the connection port 48 may be discharged to the waste liquid tank 34. In this case, for example, in both of the idle suction after purging of color ink and the idle suction after flushing, the cap sections 42 and 43 and the communication section 44 may be connected with the suction pump 33 via the connection port 48 and the cap sections 42 and 43 and the communication section 44 may be caused to communicate with the atmosphere via the connection port 49.

In First Embodiment, on the ejection surface 21*a*, the nozzles 10*a* are provided between the nozzles 10*b* and the nozzles 10*c* in the scanning direction. Furthermore, corresponding to this arrangement, the cap section 41 is provided between the cap section 42 and the cap section 43 in the scanning direction on the nozzle cap 31. In Second Embodiment, on the ejection surface 221*a*, the nozzles 210*a* to 210*c* are provided between the nozzles 210*d* and the nozzles 210*e* in the scanning direction. Furthermore, corresponding to this arrangement, the cap section 241 is provided between the cap section 242 and the cap section 243 in the scanning direction on the nozzle cap 31. The disclosure, however, is to limited to these arrangements.

Figure 28:
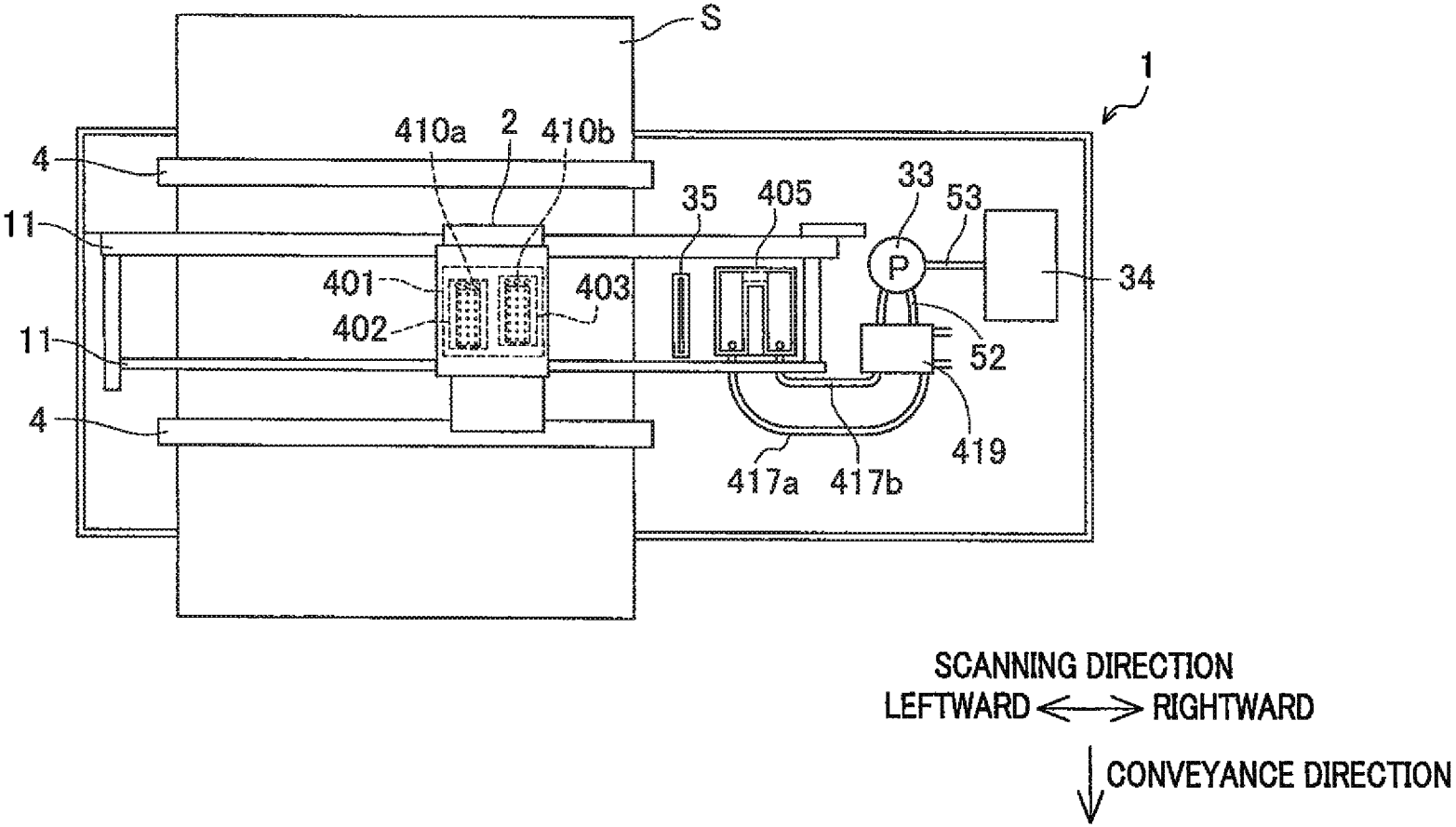
FIG. 28 is a schematic diagram of a printer of a modification 11.
Figure 29:
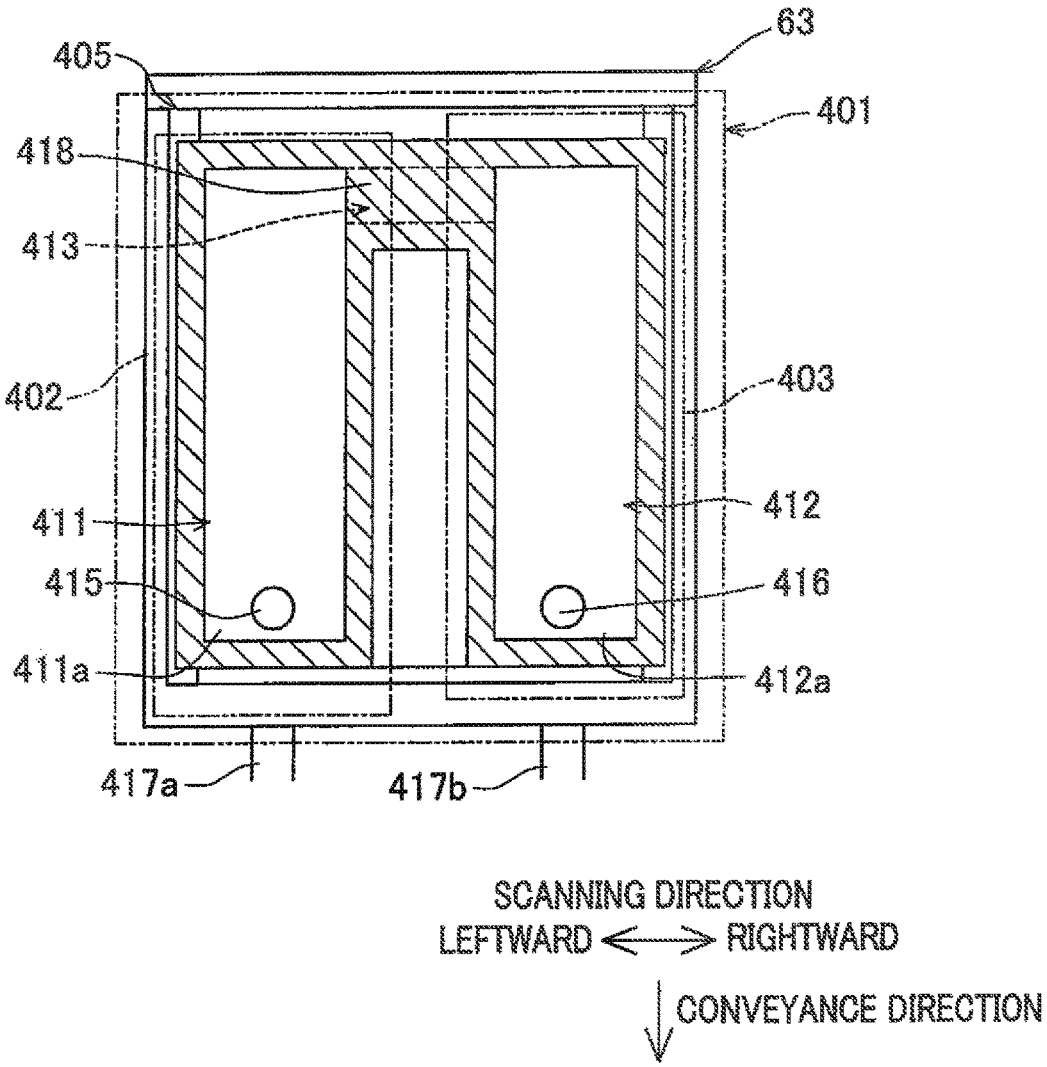
FIG. 29 relates to the modification 11 and is equivalent to FIG. 3B.

In a modification 11, as shown in FIG. 28 and FIG. 29, an inkjet head 401 includes a head unit 402 configured to eject color ink from nozzles 410*a* and a head unit 403 configured to eject color ink droplets from nozzles 410*b*. Corresponding to this arrangement, a nozzle cap 405 includes a cap section 411, a cap section 412, and a communication section 413. In a capped state, the cap section 411 opposes the lower surface of the head unit 402 to cover the nozzles 410*a*. In a capped state, the cap section 412 opposes the lower surface of the head unit 403 to cover the nozzles 410*b*. The communication section 413 extends in the scanning direction to be connected with an upstream end portion in the conveyance direction of the cap section 411 and an upstream end portion in the conveyance direction of the cap section 412, so as to communicate the cap section 411 with the cap section 412. Furthermore, at downstream end portions 411*a* and 412*a* in the conveyance direction of the cap sections 411 and 412, connection ports 415 and 416 are provided, respectively. These connection ports 415 and 416 are connected with tubes 417*a* and 417*b*, respectively. The nozzle cap 405 is provided with a sealing portion 418 which is disposed to seal the upper end opening of the communication section 413.

The tubes 417*a* and 417*b* are connected with the switching unit 419 on the side opposite to the connection ports 415 and 416. The switching unit 419 is connected with the suction pump 33 as in First Embodiment. The switching unit 419 switches between a state in which the cap sections 411 and 412 and the communication section 413 are connected with the suction pump 33 via the connection ports 415 and 416, a state in which the communication with the atmosphere is established via the connection ports 415 and 416, and a state in which the connection with the suction pump 33 and the communication with the atmosphere are blocked.

In the modification 11, the nozzle cap 405 is set in the capped state in suction purge of discharging ink in the head units 402 and 403 from the nozzles 410*a* and 410*b*. Furthermore, the cap sections 411 and 412 and the communication section 413 are connected with the suction pump 33 via the connection ports 415 and 416. In this state, the suction pump 33 is driven.

In addition to the above, in idle suction after purging in which ink remaining in the cap sections 411 and 412 and the communication section 413 due to suction purge is discharged, the cap sections 411 and 412 and the communication section 413 are connected with the suction pump 33 via the connection port 415 while the nozzle cap 405 is kept in the capped state. Furthermore, the cap sections 411 and 412 and the communication section 413 are caused to communicate with the atmosphere via the connection port 416. In this state, the suction pump 33 is driven. At this stage, the ink is arranged to remain in the tube 417*a* in the same manner as in First Embodiment.

In addition to the above, in idle suction after flushing in which ink remaining in the cap sections 411 and 412 and the communication section 413 due to flushing is discharged, the nozzle cap 405 is set in the capped state and the cap sections 411 and 412 and the communication section 413 are caused to communicate with the atmosphere via the connection port 415. Furthermore, the cap sections 411 and 412 and the communication section 413 are connected with the suction pump 33 via the connection port 416. In this state, the suction pump 33 is driven. At this stage, the ink arranged to remain in the tube 417*a* in the idle suction after purging is supplied to the cap section 412 as in the case of First Embodiment.

In regard to the above, while in the modification 11 the communication section 413 causes the cap section 411 to communicate with the cap section 412 by connecting the upstream end portion in the conveyance direction of the cap section 411 with the upstream end portion in the conveyance direction of the cap section 412, the disclosure is not limited to this arrangement. In the modification 11, a communication section which causes the cap section 411 to communicate with the cap section 412 by connecting an intermediate portion in the conveyance direction of the cap section 411 with an intermediate portion in the conveyance direction of the cap section 412 may be provided in place of the communication section 413.

Figure 30A:
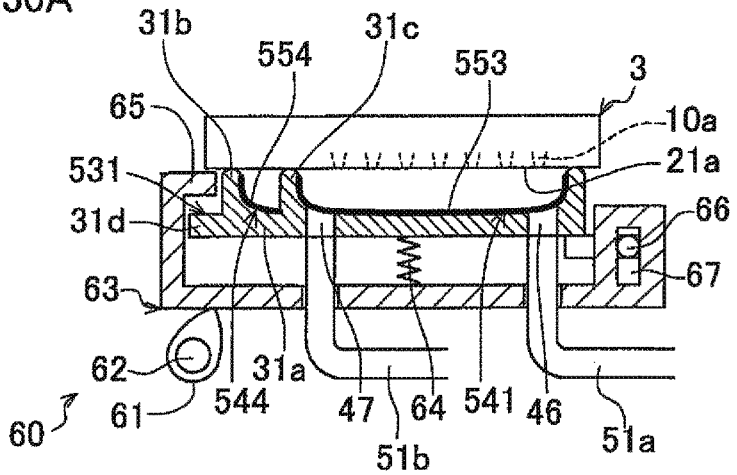
FIG. 30A relates to a modification 12 and is equivalent to FIG. 4A.
Figure 30B:
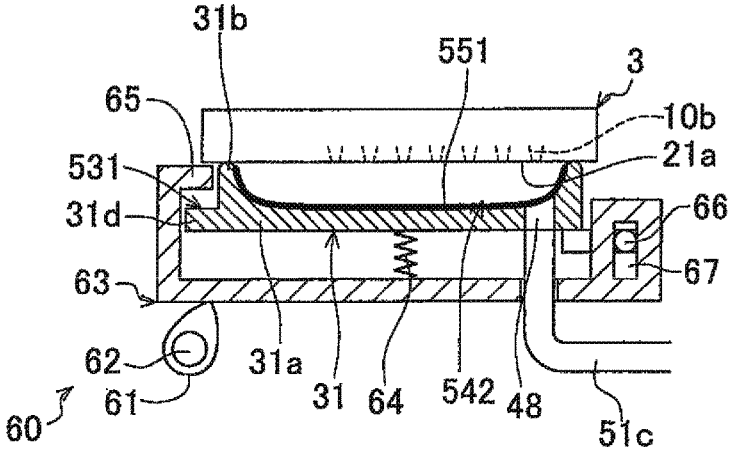
FIG. 30B relates to the modification 12 and is equivalent to FIG. 4B.
Figure 30C:
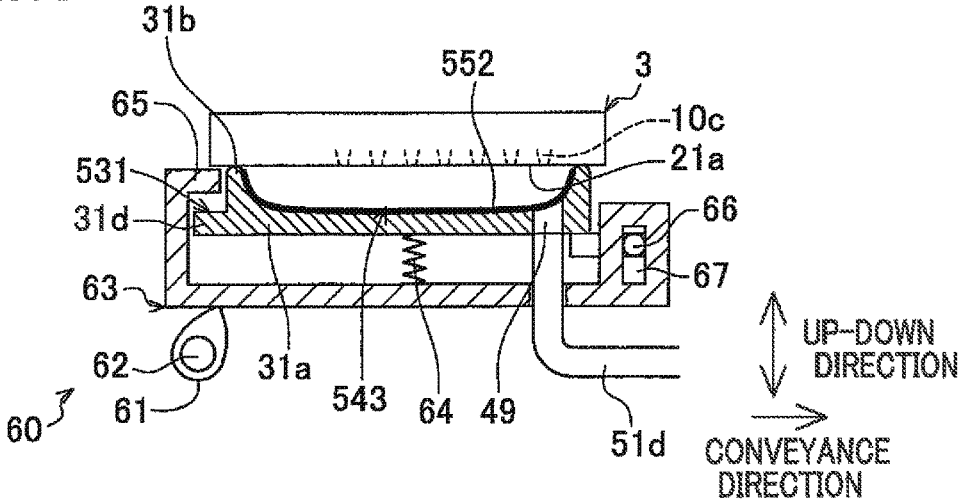
FIG. 30C relates to the modification 12 and is equivalent to FIG. 4C.

While in First and Second Embodiments the inner bottom surfaces of the cap sections 41 to 43 and the communication section 44 are flat for the reason that the upper surface 31*a*1 of the bottom wall portion 31*a* is flat, the disclosure is not limited to this arrangement. In a modification 12, as shown in FIGS. 30A to 30C, upper surfaces of parts of the bottom wall portion which constitute the cap sections 541 to 543 and the communication section 44 in First Embodiment are arranged to be curved surfaces 551 to 554, respectively. In FIGS. 30A to 30C, the cap chips are omitted.

The curved surfaces 551 to 553 are each a curved surface which is lowest at the central part in the conveyance direction and increases its height toward the lip portions 31*b* and 31*c* in the conveyance direction. The curvature of the curved surface 552 is identical with that of the curved surface 553. The curved surface 554 is identical in shape with the curved surfaces 551 and 552 at a part neighboring to the communication section 544 in the scanning direction, and is continuously connected with the curved surfaces 551 and 552. In the modification 12, while the nozzle cap 531 covers the ejection surface 21*a*, the entirety of each of the curved surfaces 551 to 554 (indicated by thick lines in FIGS. 30A to 30C) opposes the ejection surface 21*a*.

In the examples above, the connection port functioning as the suction port may be interchanged with the connection port functioning as the atmosphere communication port. In First Embodiment, on condition that one of the suction port and the atmosphere communication port is provided at each of the end portion 42*a* of the cap section 42 and the end portion 43*a* of the cap section 43, the suction port and the atmosphere communication port may be differently arranged in the cap sections 42 and 43 and the communication section 44.

In Second Embodiment, on condition that one of the suction port and the atmosphere communication port is provided at each of the both end portions 242*a* and 242*b* in the conveyance direction of the cap section 242 and the both end portions 243*a* and 243*b* in the conveyance direction of the cap section 243, the suction port and the atmosphere communication port may be differently arranged in the cap sections 242 and 243 and the communication section 244.

In the cases above, at least one of two or more suction ports and two or more atmosphere communication ports is provided in the nozzle cap. When two or more suction ports are provided in the nozzle cap, the cap sections 242 and 243 and the communication section 244 are connected with the suction pump via only one of the suction ports. Furthermore, the nozzle cap is caused to communicate with the atmosphere via only one atmosphere communication port. In this state, the suction pump is driven and the above-described operations are executed for each suction port. Furthermore, when two or more atmosphere communication ports are provided in the nozzle cap, the above-described operations are executed for each atmosphere communication port. The ink remaining in the nozzle cap is certainly discharged in this way.

In First Embodiment, the communication section 44 is connected with the upstream end portions in the conveyance direction of the cap sections 42 and 43. In Second Embodiment, the communication section 244 is connected with the intermediate portions in the conveyance direction of the cap sections 242 and 243. The disclosure, however, is not limited to these arrangements. For example, the communication section may be connected with downstream end portions in the conveyance direction of two cap sections. Alternatively, the connection portion may be connected with an end portion in the conveyance direction of one of the two cap sections and with an intermediate portion of the other one of the two cap sections.

While in the examples above the inner bottom surface of the communication section and the inner bottom surfaces of the two cap sections connected with each other by the communication section are on the same plane, the disclosure is not limited to this arrangement. For example, the two cap sections may communicate with each other via a tube.

Figure 31A:
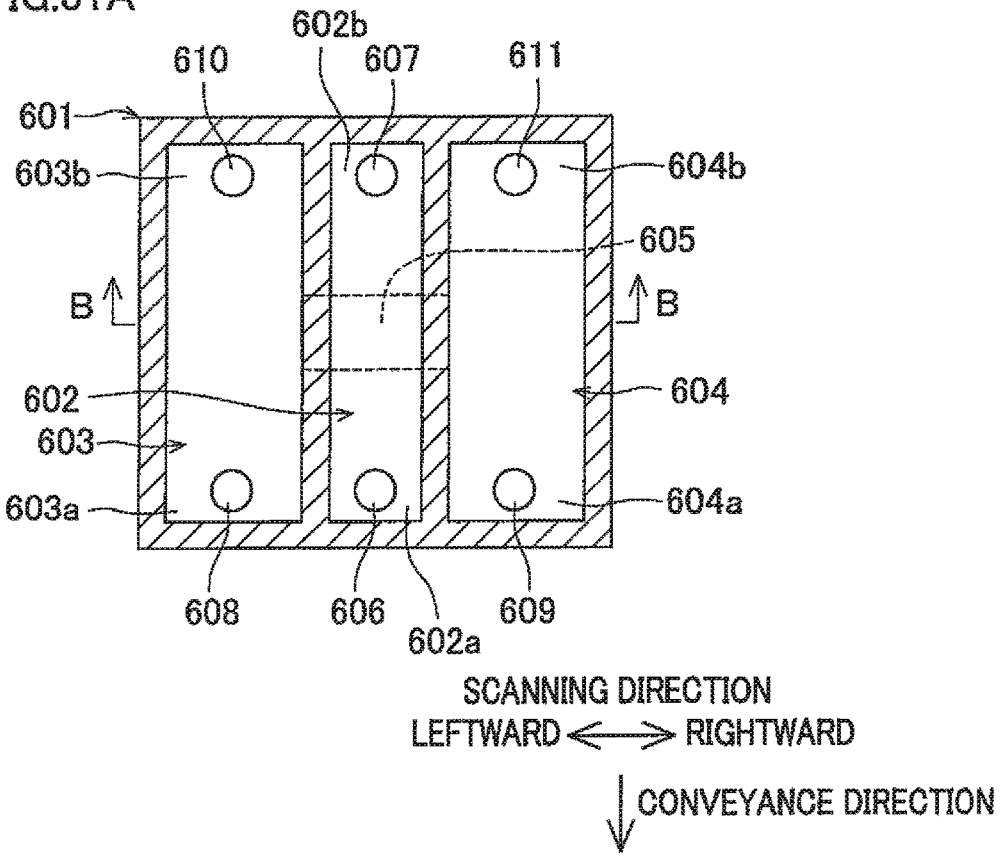
FIG. 31A relates to a modification 13 and is equivalent to FIG. 3B.
Figure 31B:
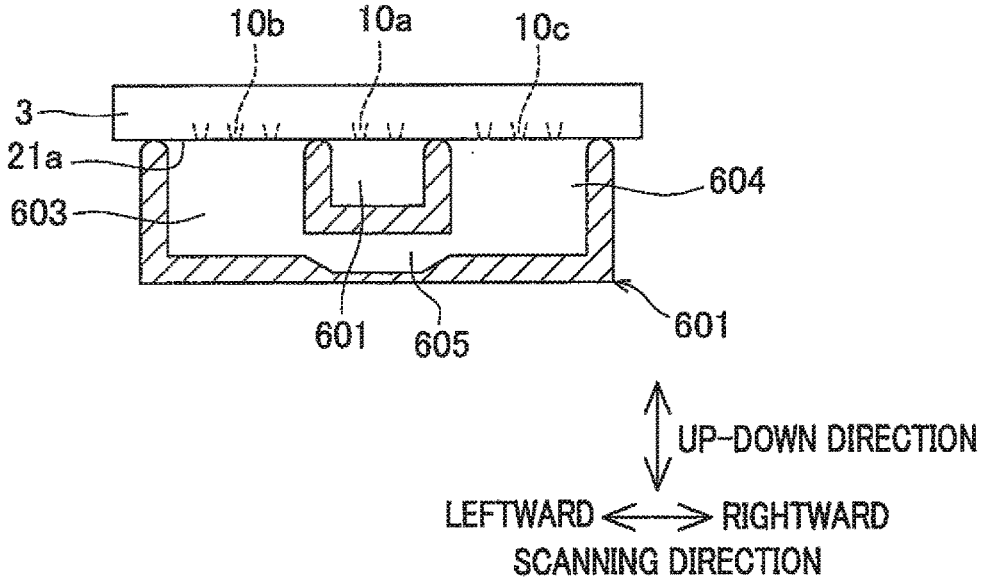
FIG. 31B is a cross section taken at the B-B line in FIG. 31A.

In a modification 13, as shown in FIGS. 31A and 31B, in a nozzle cap 601, a cap section 602 (equivalent to the third cap section of the present invention) covering the nozzles 10*a*, a cap section 603 (which is equivalent to the second cap section of the present invention) covering the nozzles 10*b*, and a cap section 604 (which is equivalent to the first cap section of the present invention) covering the nozzles 10*c* are identical with one another in length in the conveyance direction. The cap sections 603 and 604 extend downward as compared to the cap section 602. Furthermore, the nozzle cap 601 includes a communication section 605 which is provided under the cap section 602 to overlap the cap section 602 in the up-down direction. The communication section 605 extends in the scanning direction to be connected with intermediate portions in the conveyance direction of the cap sections 603 and 604, so as to cause the cap section 603 to communicate with the cap section 604.

In addition to the above, at the end portions 602*a* and 602*b* in the conveyance direction of the cap section 602, connection ports 606 and 607 are formed, respectively. Furthermore, at the downstream end portions 603*a* and 604*a* in the conveyance direction of the cap sections 603 and 604, connection ports 608 and 609 are formed, respectively. Furthermore, at the upstream end portions 603*b* and 604*b* in the conveyance direction of the cap sections 603 and 604, connection ports 610 and 611 are formed, respectively. The connection ports 606 to 611 are, for example, in the same manner as the connection ports 246 to 251 of Second Embodiment (see FIG. 16A), connected to the switching unit 232 (see FIG. 14) via unillustrated tubes. In FIGS. 31A and 31B, the tubes connected to the connection ports 606 to 611, the cap driving mechanism, and the like are omitted.

In the case above, the nozzle cap 601 is downsized in the conveyance direction as compared to the nozzle cap 31 of First Embodiment in which the cap section 41 (see FIG. 3A) and the communication section 44 (see FIG. 3A) are lined up in the conveyance direction.

Figure 32:
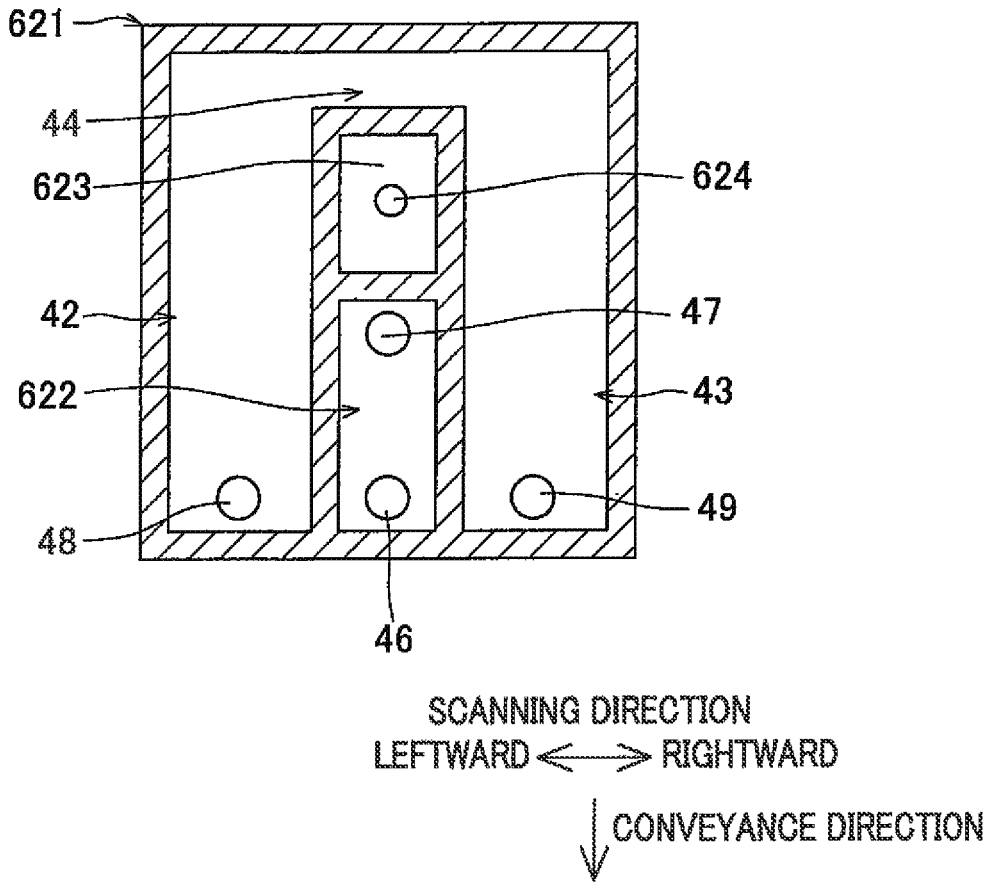
FIG. 32 relates to a modification 14 and is equivalent to FIG. 3B.

While in First and Second Embodiments the third cap section (cap section 41, 241) and the communication section (communication section 44, 244) are provided to neighbor each other in the conveyance direction, the disclosure is not limited to this arrangement. In a modification 14, as shown in FIG. 32, in a nozzle cap 621, the communication section 44 is connected with the upstream end portion in the conveyance direction of the cap section 42 and the upstream end portion in the conveyance direction of the cap section 43 in the same manner as in First Embodiment. In the modification 14, furthermore, nozzle rows corresponding to the nozzle rows 9*a* of First Embodiment (see FIG. 2) are shorter in the conveyance direction than the nozzle rows 9*a* of First Embodiment, and accordingly the cap section 622 for covering the nozzles 10*a* (see FIG. 2) is shorter in the conveyance direction than the cap section 41 (see FIG. 3B) of the nozzle cap 31. With this arrangement, the nozzle cap 621 has a space 623 between the cap section 622 and the communication section 44 in the conveyance direction. Furthermore, an air hole 624 is formed at a part of the nozzle cap 621 which part forms a wall of the space 623. The air hole 624 is provided to take in and out the air in the space 623 in accordance with a change in the surrounding atmospheric pressure, when the ejection surface 21*a* (see FIG. 2) of the nozzle cap 621 is covered. In FIG. 32, the tubes connected to the connection ports 46 to 49, the cap driving mechanism, and the like are omitted.

While in First Embodiment the ink supply openings 23*a* to 23*c* are provided at the upstream end portion in the conveyance direction of the passage unit 21, the communication section 44 is connected with the upstream end portions in the conveyance direction of the cap sections 42 and 43, and the ink supply openings 23*a* to 23*c* and the communication section 44 are overlapped with one another in the up-down direction in the capped state, the disclosure is not limited to this arrangement. The communication section 44 may not overlap the ink supply openings 23*a* to 23*c* in the up-down direction in the capped state.

While in First Embodiment the communication section 44 is connected with the upstream end portions in the conveyance direction of the cap sections 42 and 43 and the nozzle cap 31 is moved away from the ejection surface 21*a* first at the downstream end portion in the conveyance direction when the nozzle cap 31 is detached from the ejection surface 21*a*, the disclosure is not limited to this arrangement. On the contrary to the embodiments above, the nozzle cap 31 may be moved away from the ejection surface 21*a* while the nozzle cap 31 is inclined so that the upstream end portion in the conveyance direction is farther from the ejection surface 21*a* than the downstream end portion, or may be moved away from the ejection surface 21*a* without being inclined.

While in First Embodiment the widths W2 of the grooves 74*a* and 74*b* of the cap chip 74 are wider than the widths W1 of the grooves 71*a* to 74*a* and 71*b* to 74*b* of the cap chips 71 to 73, the disclosure is not limited to this arrangement. For example, the widths W1 of the grooves 71*a* to 73*a* and 71*b* to 73*b* may be more or less identical with the widths W2 of the grooves 74*a* and 74*b*. The same holds true for the cap chips 271 to 274 of Second Embodiment.

While in First Embodiment the cap chips 71 to 74 are housed in the cap sections 41 to 43 and the communication section 44, the disclosure is not limited to this arrangement. For example, a plate-shaped ink absorbing foam may be housed in each of the cap sections 41 to 43 and the communication section 44. Even if the above-described idle suction after purging and idle suction after flushing are executed, a tiny amount of ink still remains in the nozzle cap 31. When the ink absorbing foams are provided in the cap sections 41 to 43 and the communication section 44, the tiny amount of ink remaining in the nozzle cap 31 is absorbed by the ink absorbing foams, and this prevents the ink from adhering to other parts of the printer 1. Furthermore, when, for example, the meshes of the ink absorbing foam housed in the cap section 42 are the finest, the meshes of the ink absorbing foam housed in the communication section 44 are the second finest, and the meshes of the ink absorbing foam housed in the cap section 43 are the third finest, i.e., the capillary forces of these foams decrease in this order, the ink absorbed by the ink absorbing foams is likely to flow into the cap section 42 from the cap section 43 via the communication section 44, on account of the difference in the capillary forces between the ink absorbing foams. With this, in the idle suction after purging of color ink, the discharge of the ink remaining in the cap sections 42 and 43 and the communication section 44 is facilitated. In a similar manner, in Second Embodiment, plate-shaped ink absorbing forms may be housed in the cap sections 241 to 243 and the communication section.

In addition to the above, the cap sections 41 to 43 and the communication section 44 of First Embodiment and the cap sections 241 to 243 and the communication section 244 of Second Embodiment may not house plate-shaped members such as cap chips and ink absorbing foams.

In addition to the above, while in First and Second Embodiments the nozzle cap 31, 231 is elevated or lowered by rotationally driving the cam 61 by the cam driving motor 62 in the cap driving mechanism 60, the disclosure is not limited to this arrangement. For example, a carriage driving mechanism may be arranged such that, when the carriage 2 approaches the nozzle cap 31, 231, the nozzle cap 31, 231 is elevated by the force of the carriage 2 pressing the cap driving mechanism in the scanning direction.

In addition to the above, the movement of causing the nozzle cap 31, 231 to contact with or move away from the ejection surface 21*a*, 321*a* may not be done by elevating or lowering the nozzle cap 31, 231. For example, the carriage 2 may be arranged to be elevatable, and the movement of causing the nozzle cap 31, 231 to contact with or move away from the ejection surface 21*a*, 321*a* may be done by elevating or lowering the carriage 2.

While in the examples above the present invention is employed in an inkjet printer configured to perform printing by ejecting ink from nozzles, the disclosure is not limited to this arrangement. The present invention may be employed in a liquid ejection apparatus which is not an inkjet printer and ejects liquid which is not ink from nozzles.

What is claimed is:

1. A liquid ejection apparatus comprising:

a liquid ejection head including;

first nozzles which are lined up in predetermined one direction; and second nozzles which are lined up in the one direction and positionally deviated from the first nozzles in a direction orthogonal to the one direction;

a nozzle cap configured to contact with and move away from the liquid ejection head, and cover the first nozzles and the second nozzles when contacting with the liquid ejection head;

a moving device configured to cause the nozzle cap to contact with or move away from the liquid ejection head by moving at least one of the liquid ejection head and the nozzle cap; and a suction pump connected with the nozzle cap;

wherein, the nozzle cap includes:

a first cap section for covering the first nozzles;

a second cap section for covering the second nozzles;

a communication section connected with the first cap section and the second cap section;

a first port provided at the first cap section: and a second port provided at the second cap section;

wherein the liquid ejection apparatus further comprises:

a switching device connected to the first port, the second port, and the suction pump; and a controller configured to control the liquid election head, the moving device, the suction pump, and the switching device; and wherein the controller is configured to execute:

a suction purge process of performing suction purge of discharging the liquid in the liquid ejection head from the nozzles by driving the suction pump, in a state in which the nozzle cap is caused to contact with the liquid ejection head by controlling the moving device and the nozzle cap is connected with the suction pump via both the first port and the second port by controlling the switching device; and an idle suction after purging process of performing idle suction after purging of discharging the liquid remaining in the nozzle cap by driving the suction pump after the suction purge process, in a state in which the nozzle cap is kept in contact with the liquid ejection head by controlling the moving device and the nozzle cap is connected with the suction pump via the second port by controlling the switching device, and the nozzle cap is caused to communicate with the atmosphere via the first port by controlling the switching device.

2. The liquid ejection apparatus according to claim 1;

wherein the controller is configured to execute, after the suction purge process:

a first idle suction after purging process of performing first idle suction after purging of discharging the liquid remaining in the nozzle cap by driving the suction pump, in a state in which the nozzle cap is kept in contact with the liquid ejection head by controlling the moving device and the nozzle cap is connected with the suction pump via the second port by controlling the switching device, and the nozzle cap is caused to communicate with the atmosphere via the first port by controlling the switching device; and a second idle suction after purging process of performing second idle suction after purging of discharging the liquid remaining in the nozzle cap by driving the suction pump, in a state in which the nozzle cap is kept in contact with the liquid ejection head by controlling the moving device, the nozzle cap is connected with the suction pump via the first port by controlling the switching device, and the nozzle cap is caused to communicate with the atmosphere via the second port by controlling the switching device.

3. The liquid ejection apparatus according to claim 1, further comprising:

a passage member connecting the nozzle cap with the switching device via the second port;

wherein the controller is configured to execute:

a flushing process of performing flushing of ejecting the liquid from the nozzles toward the nozzle cap after the idle suction after purging process; and an idle suction after flushing process of performing idle suction after flushing of discharging the liquid remaining in the nozzle cap by driving the suction pump after the flushing process, in a state in which the nozzle cap is caused to contact with the liquid ejection head by controlling the moving device, the nozzle cap is connected with the suction pump via the first port by controlling the switching device, and the nozzle cap is caused to communicate with the atmosphere via the second port by controlling the switching device;

wherein the idle suction after purging process is executed to cause the liquid discharged from the nozzle cap to remain in the passage member in the idle suction after purging; and wherein the idle suction after flushing process is executed to cause the liquid remaining in the passage member to flow into the nozzle cap via the second port in the idle suction after flushing.

4. The liquid ejection apparatus according to claim 1;

wherein the liquid ejection head further includes:

third nozzles which are lined up in the one direction and provided between the first nozzles and the second nozzles in the direction orthogonal to the one direction;

wherein the nozzle cap further includes:

a third cap section for covering the third nozzles;

wherein the communication section and the third cap section are provided between the first cap section and the second cap section in the direction orthogonal to the one direction; and wherein the communication section is positionally deviated from the third cap section in the one direction.

5. The liquid ejection apparatus according to claim 1;

wherein the communication section is connected with an end portion on one side in the one direction of the first cap section and an end portion on the one side in the one direction of the second cap section;

wherein the first port is provided at an end portion on the other side in the one direction of the first cap section;

wherein the second port is provided at an end portion on the other side in the one direction of the second cap section; and wherein the nozzle cap is configured to incline such that the end portion on the other side in the one direction is farther from the liquid ejection head than the end portion on the one side in the one direction, when the nozzle cap moves away from the liquid ejection head.

6. The liquid ejection apparatus according to claim 1;

wherein the communication section is connected with an end portion on one side in the one direction of the first cap section and an end portion on the one side in the one direction of the second cap section;

wherein the first port is provided at an end portion on the other side in the one direction of the first cap section;

wherein the second port is provided at an end portion on the other side in the one direction of the second cap section; and wherein the liquid ejection head further includes:

a liquid supply opening through which the liquid is supplied; and a filter provided at the liquid supply opening;

wherein the liquid supply opening is provided at an end portion on the one side in the one direction of the liquid ejection head to overlap the communication section when the nozzle cap contacts with the liquid ejection head.

7. The liquid ejection apparatus according to claim 1;

wherein the communication section forms a space by which the first cap section communicates with the second cap section, when the nozzle cap contacts with the liquid ejection head.

8. The liquid ejection apparatus according to claim 1, further comprising:

a first plate-shaped member housed in the first cap section;

a second plate-shaped member housed in the second cap section; and a third plate-shaped member housed in the communication section.

9. The liquid ejection apparatus according to claim 8;

wherein each of the first plate-shaped member, the second plate-shaped member, and the third plate-shaped member has a groove in which the liquid flows; and wherein the groove of the third plate-shaped member is wider than the groove of the first plate-shaped member and the groove of the second plate-shaped member in a direction orthogonal to the direction in which the liquid flows.

10. A liquid ejection apparatus comprising:

a liquid ejection head including:

first nozzles which are lined up in predetermined one direction; and second nozzles which are lined up in the one direction and positionally deviated from the first nozzles in a direction orthogonal to the one direction;

a nozzle cap configured to contact with and move away from the liquid ejection head, and cover the first nozzles and the second nozzles when contacting with the liquid ejection head;

a moving device configured to cause the nozzle cap to contact with or move away from the liquid ejection head by moving at least one of the liquid ejection head and the nozzle cap; and a suction pump connected with the nozzle cap;

wherein the nozzle cap includes:

a first cap section for covering the first nozzles;

a second cap section for covering the second nozzles;

a communication section connected with the first cap section and the second cap section;

a first port provided at each of the first cap section and the second cap section; and a second port provided in the communication section; and wherein the liquid ejection apparatus further comprises:

a switching device connected to the first ports, second port and suction pump, the switching device being configured to allow:

connection of the nozzle cap with atmosphere selectively via one first port and block connection of the nozzle cap with atmosphere via the other first port, among the first port provided at the first cap section and the first port provided at the second cap section; or connection of the nozzle cap with the suction pump selectively via one first port and block connection of the nozzle cap with the suction pump via the other first port, among the first port provided at the first cap section and the first port provided at the second cap section.

* * * * *